US008859179B2

(12) United States Patent
Santo et al.

(10) Patent No.: US 8,859,179 B2
(45) Date of Patent: Oct. 14, 2014

(54) DEVELOPER FOR ELECTROPHOTOGRAPHY, IMAGE FORMING APPARATUS AND PROCESS CARTRIDGE

(71) Applicants: Hideyuki Santo, Shizuoka (JP); Masahide Yamada, Shizuoka (JP); Kazumi Suzuki, Shizuoka (JP); Shinya Nakayama, Shizuoka (JP); Atsushi Yamamoto, Shizuoka (JP); Tatsuya Morita, Kanagawa (JP); Shingo Sakashita, Shizuoka (JP); Yukiko Nakajima, Kanagawa (JP); Keiji Makabe, Shizuoka (JP); Daiki Yamashita, Kanagawa (JP)

(72) Inventors: Hideyuki Santo, Shizuoka (JP); Masahide Yamada, Shizuoka (JP); Kazumi Suzuki, Shizuoka (JP); Shinya Nakayama, Shizuoka (JP); Atsushi Yamamoto, Shizuoka (JP); Tatsuya Morita, Kanagawa (JP); Shingo Sakashita, Shizuoka (JP); Yukiko Nakajima, Kanagawa (JP); Keiji Makabe, Shizuoka (JP); Daiki Yamashita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/679,057

(22) Filed: Nov. 16, 2012

(65) Prior Publication Data

US 2013/0157183 A1 Jun. 20, 2013

(30) Foreign Application Priority Data

Dec. 20, 2011 (JP) ..... 2011-278846

(51) Int. Cl.

| | |
|---|---|
| ***G03G 9/107*** | (2006.01) |
| ***G03G 9/113*** | (2006.01) |
| ***G03G 9/087*** | (2006.01) |
| ***G03G 9/083*** | (2006.01) |

(52) U.S. Cl.

CPC ..... *G03G 9/0832* (2013.01); *G03G 9/1131* (2013.01); *G03G 9/08797* (2013.01); *G03G 9/107* (2013.01)

USPC ..... 430/109.4; 430/109.1; 430/111.3; 430/111.41; 430/123.58

(58) Field of Classification Search

CPC ..... G03G 9/08764; G03G 9/08766; G03G 9/08755; G03G 9/08759

USPC ..... 430/109.4, 111.3, 111.41, 109.1, 430/123.58; 399/335

See application file for complete search history.

(56) References Cited

U.S. PATENT DOCUMENTS

| | | | | |
|---|---|---|---|---|
| 4,444,487 | A * | 4/1984 | Miller et al. | 399/337 |
| 5,491,545 | A * | 2/1996 | Kopp et al. | 399/322 |
| 5,698,320 | A * | 12/1997 | Ebisu et al. | 430/124.34 |
| 2004/0143036 | A1* | 7/2004 | Takano et al. | 523/216 |
| 2008/0050669 | A1* | 2/2008 | Ohmura et al. | 430/109.4 |
| 2009/0263738 | A1* | 10/2009 | Kaya et al. | 430/108.2 |
| 2011/0045398 | A1* | 2/2011 | Sekikawa et al. | 430/108.22 |
| 2011/0065039 | A1* | 3/2011 | Ota et al. | 430/109.3 |
| 2011/0129775 | A1* | 6/2011 | Sawada et al. | 430/109.2 |
| 2012/0202147 | A1* | 8/2012 | Suzuki et al. | 430/106.1 |
| 2012/0282000 | A1 | 11/2012 | Nakayama et al. | |

FOREIGN PATENT DOCUMENTS

| | | |
|---|---|---|
| JP | 59-104663 | 6/1984 |
| JP | 62-070859 | 4/1987 |
| JP | 62-070860 | 4/1987 |
| JP | 63-038955 | 2/1988 |
| JP | 6-035232 | 2/1994 |
| JP | 8-095308 | 4/1996 |
| JP | 9-329917 | 12/1997 |
| JP | 2001-305796 | 11/2001 |
| JP | 2004-038115 | 2/2004 |
| JP | 2005-215397 | 8/2005 |
| JP | 2006-276305 | 10/2006 |
| JP | 2008-268489 | 11/2008 |
| JP | 2010-077419 | 4/2010 |
| JP | 2012-042939 | 3/2012 |

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

A developer, including a toner including a binder resin comprising a crystalline resin; and a colorant, and a resin carrier comprising a resin; a magnetic particulate material having a magnetic anisotropy, dispersed in the resin, and having a saturated magnetization of from 16 to 30 emu/g, a coercive force of from 15 to 40 kA/m and an average particle diameter not less than 15 μm and less than 100 μm.

10 Claims, 4 Drawing Sheets

DEVELOPER FOR ELECTROPHOTOGRAPHY, IMAGE FORMING APPARATUS AND PROCESS CARTRIDGE

CROSS-REFERENCE TO RELATED APPLICATIONS

This patent application is based on and claims priority pursuant to 35 U.S.C. §119 to Japanese Patent Application No. 2011-278846, filed on Dec. 20, 2011, in the Japan Patent Office, the entire disclosure of which is hereby incorporated by reference herein.

BACKGROUND OF THE INVENTION

1. Field of the Invention

The present invention relates to a developer for electrophotography, an image forming apparatus and a process cartridge.

2. Description of the Related Art

Conventionally, in an electrophotographic image forming apparatus or the like, an electrically or magnetically formed latent image is visualized with a toner for electrophotography (may be merely referred to as a "toner" hereinafter). For example, in electrophotography, a latent electrostatic image (latent image) is formed on a photoreceptor, followed by developing the latent image with the toner, to form a toner image. The toner image is typically transferred onto a transfer material such as paper, followed by fixing onto the transfer material. In the fixing image for fixing the toner image on the transfer paper, a thermal fixing system, such as a heating roller fixing system or heating belt fixing system, has been generally and widely used because of its excellent energy efficiency. The electrophotographic developer includes a one-component developer formed of a toner and a two-component developer formed of a toner and a carrier. The former is said to be suitable for small apparatuses which do not have much inner space and the latter is said to be suitable for large apparatuses capable of forming high-quality images such as high-resolution images and color images at high speed because the toner is well charged when stirred with the carrier. However, recently, needs for the two-component developer capable of complying with demands for higher-quality images more easily than the one-component developer have been increasing. Further, in addition to demands for smaller image forming apparatuses, higher speed and higher quality images, demands for energy saving and low-temperature quick fixability have been increasing, and the developer, i.e., the toner and the carrier are exposed to acute stress because of being circulated at high speed in order to comply these. Furthermore, the toner and the carrier are required to have smaller sizes, particularly the toner is required to have higher durability and the developer is required not to give an excessive stress to the toner. In addition, the toner is required to have better storage stability before used, which is inconsistent with the low-temperature quick fixability of the toner.

Namely, recently, there are increasing demands from the market for image forming apparatuses of high speed and energy saving, and therefore a toner having excellent low-temperature fixability and capable of providing high quality images is desired. To achieve the low-temperature fixability of the toner, the softening point of the binder resin contained in the toner needs to be low, but use of the binder resin having a low softening point tends to occur deposition of part of a toner image onto a surface of a fixing member during fixing, which will then be transferred to photocopy paper, which is so-called offset (also referred to as hot offset hereinafter). In addition to this, the heat resistant storage stability of the toner reduces, and therefore toner particles are fused to each other particularly in high temperature environments, which is so called blocking. Other than the above, use of the binder resin having a low softening point causes problems that the toner is fused to an inner area of a developing unit, or to a carrier, and the toner tends to cause filming on a surface of a photoreceptor.

As for the technique for solving the aforementioned problems, it has been known that a crystalline resin is used as a binder resin of the toner. Specifically, the crystalline resin is capable of decreasing the softening point of the toner to around the melting point thereof by sharply softening at the melting point of the resin, while maintaining the heat resistant storage stability at the temperature equal to or lower than the melting point. Accordingly, use of the crystalline resin in the toner realizes both the low-temperature fixability and heat resistant storage stability of the toner.

As for the toner using the crystalline resin, for example, there is disclosed a toner in which a crystalline resin obtained by elongating crystalline polyester with diisocyanate is used as a binder resin (see Japanese published examined application Nos. JP-04-024702-B and JP-04-024703-B). In the case of these proposed toners, the low-temperature fixability of the toner is excellent, but the hot offset resistance of the toner is insufficient, and therefore these toners do not meet the quality required by the market of recent years.

There is disclosed a toner using a crystalline resin which has a crosslink structure due to an unsaturated bond containing sulfonic acid groups (see Japanese Patent No. JP-3910338-B1 (Japanese published unexamined application No. JP-2001-305796-A). This toner improves its hot offset resistance compared to that achieved by the conventional technique. Moreover, there is disclosed a technique related resin particles having excellent low temperature fixing ability and heat resistant storage stability, in which a ratio of a softening point to a peak temperature of heat of melting, and viscoelasticity are specified (see Japanese published unexamined application No. JP-2010-077419-A).

In the case of the aforementioned toners each of which uses the crystalline resin as a main component of the binder resin, however, the toner has excellent shock resistance owing to the characteristics of the crystalline resin, but has insufficient indentation hardness, such as Vickers hardness. Accordingly, there are problems that due to the stress caused by stirring in a developing unit, depositions of the toner to the carrier or inner side of the developing unit and filming onto a photoconductor tend to occur, and deterioration in charging ability and flowability of the toner tends to occur due to buried external additives in the toner particles. Therefore, the carrier needs to give low stress to the toner to stabilize images.

As a carrier giving low stress to a toner, a carrier formed by a polymerization method is disclosed in Japanese published unexamined application No. JP-2005-215397-A.

It is preferable that the carrier typically has low specific gravity to decrease stress to the toner, and a carrier including a dispersed magnetic material has been increasing recently. The carrier including a dispersed magnetic material keeps has a low specific gravity while keeping magnetism because a magnetic powder having strong magnetism is dispersed in a resin having los specific gravity. Japanese published unexamined application No. JP-2005-215397-A discloses this carrier including a dispersed magnetic material and having low specific gravity. Japanese published unexamined application No. JP-8-95308-A discloses a carrier including a dispersed magnetic material, formed of associated a particulate copolymer of an ethylenic unsaturated monomer and a crosslinker, and plural magnetic particulate materials. Japanese published unexamined application No. JP-2008-268489-A discloses a carrier including a mother particle and child particles melted and bonded thereto.

However, they are effective for toner transferability and decreasing stress thereto to some extent, but not enough.

Because of these reasons, a need exist for a developer for electrophotography, including a toner including a crystalline resin in an amount of 50% by weight or more per 100% by weight of a binder resin, as a substantial main component, which produces high-quality images while preventing the toner form contaminating a carrier and inner apparatus and an external additive from being buried in the toner due to insufficient resistance thereof to stress because of the crystalline resin.

SUMMARY OF THE INVENTION

Accordingly, one object of the present invention to provide a developer for electrophotography, including a toner including a crystalline resin in an amount of 50% by weight or more per 100% by weight of a binder resin, as a substantial main component, which produces high-quality images while preventing the toner form contaminating a carrier and inner apparatus and an external additive from being buried in the toner due to insufficient resistance thereof to stress because of the crystalline resin.

Another object of the present invention to provide an image forming apparatus using the developer.

A further object of the present invention to provide a process cartridge using the developer.

These objects and other objects of the present invention, either individually or collectively, have been satisfied by the discovery of a developer, comprising:

a toner comprising:

a binder resin comprising a crystalline resin; and a colorant, and a resin carrier comprising:

a resin;

a magnetic particulate material having a magnetic anisotropy, dispersed in the resin, and having a saturated magnetization of from 16 to 30 emu/g, a coercive force of from 15 to 40 kA/m and an average particle diameter not less than 15 μm and less than 100 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
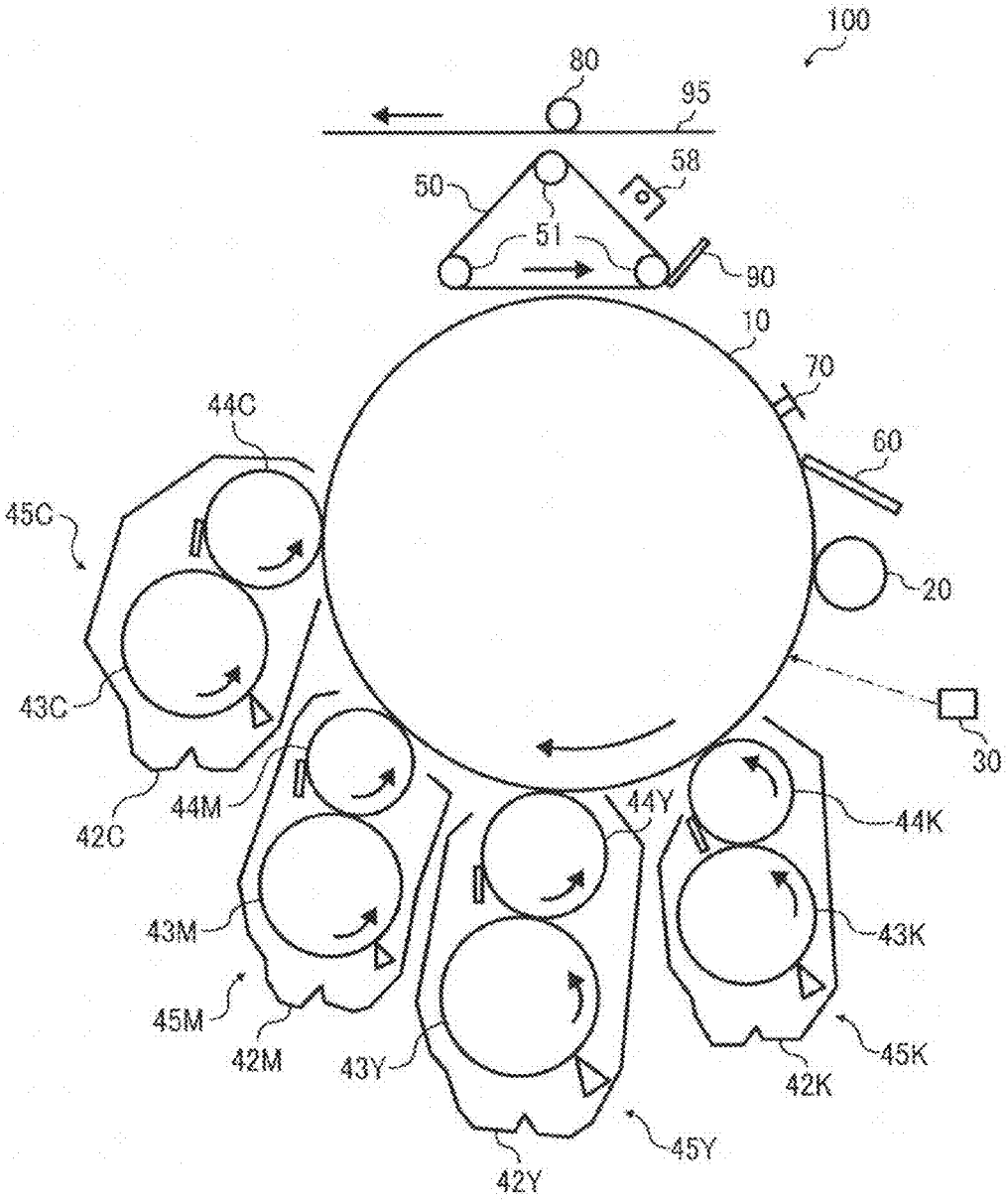
FIG. 1 is a schematic view illustrating an embodiment of image forming apparatus using the image forming method of the present invention.

The present invention provides a developer for electrophotography, including a toner including a crystalline resin in an amount of 50% by weight or more per 100% by weight of a binder resin, as a substantial main component, which produces high-quality images while preventing the toner form contaminating a carrier and inner apparatus and an external additive from being buried in the toner due to insufficient resistance thereof to stress because of the crystalline resin.

More particularly, the present invention relates to a developer, comprising:

a toner comprising:

a binder resin comprising a crystalline resin; and a colorant, and a resin carrier comprising:

a resin;

a magnetic particulate material having a magnetic anisotropy, dispersed in the resin, and having a saturated magnetization of from 16 to 30 emu/g, a coercive force of from 15 to 40 kA/m and an average particle diameter not less than 15 μm and less than 100 μm.

[Resin Carrier]

The resin carrier of the present invention includes: a magnetic particulate material; and a binder resin in which at least the magnetic particulate material are dispersed, wherein the resin carrier has a magnetic anisotropy where magnetic fields of the magnetic particulate material are orientated in the same direction, and wherein the resin carrier has a saturated magnetization of from 16 to 30 emu/g, a coercive force of from 15 to 40 kA/m, and a number-average particle diameter of 15 μm or more but less than 100 μm. The resin carrier may optionally contain other ingredients than the binder resin and the magnetic particulate material.

<Binder Resin for Carrier>

Next will be given exemplary materials suitably used for the carrier of the present invention. The binder resin used for the resin carrier of the present invention is not particularly limited and may be appropriately selected from those known in the art depending on the intended purpose. Examples thereof include thermoplastic resins obtained through polymerization of vinyl monomers.

The vinyl monomer is not particularly limited and may be appropriately selected depending on the intended purpose. Examples thereof include styrene; styrene derivatives such as o-methylstyrene, m-methylstyrene, p-methylstyrene, p-phenylstyrene and p-ethylstyrene; unsaturated monoolefins such as ethylene, propylene, butylene and isobutylene; unsaturated diolefins such as butadiene and isoprene; halogenated vinyls such as vinyl chloride, vinylidene chloride, vinyl bromide and vinyl fluoride; vinyl esters such as vinyl acetate, vinyl propionate and vinyl benzoate; methacrylic acid and α-methylene aliphatic monocarboxylic acid esters such as methyl methacrylate and ethyl methacrylate; acrylic acid and acrylic acid esters such as methyl acrylate and ethyl acrylate; maleic acid and maleic acid half esters; vinyl ethers such as vinyl methyl ether and vinyl ethyl ether; vinyl ketones such as vinyl methyl ketone and vinyl hexyl ketone; N-vinyl compounds such as N-vinylpyrrole and N-vinylcarbazole; vinyl naphthalenes; acrylic acid or methacrylic acid derivatives such as acrylonitrile, methacrylonitrile and acrylamide; and acrolein.

These may be polymerized alone or in combination.

Besides the thermoplastic resins obtained through polymerization of the vinyl monomers, further examples of the binder resin include non-vinyl condensed resins such as polyester resins, epoxy resins, phenol resins, urea resins, polyurethane resins, polyimide resins, cellulose resins and polyether resins; and mixtures of these resins and the above vinyl resins.

<Magnetic Particulate Material>

The magnetic particulate material is not particularly limited and may be appropriately selected from those known in the art depending on the intended purpose. They are preferably at least one of rare-earth magnetic powder and anisotropic ferrite magnetic powder.

The rare-earth magnetic powder is not particularly limited and may be appropriately selected depending on the intended purpose. Examples thereof include rare earth-transition metal magnetic powder such as anisotropic SmCo powder, anisotropic SmFeN powder and anisotropic NdFeB powder. In addition, various rare earth-iron-nitrogen magnet powder containing as elements a rare earth, iron and nitrogen may be used since it is a rare earth-transition metal magnet alloy containing as elements a rare earth and a transition metal. The rare-earth magnetic powder preferably contains as the rare earth at least one selected from Sm, Gd, Tb and Ce, more preferably further contains as the rare earth at least one selected from Pr, Nd, Dy, Ho, Er, Tm and Yb.

In particular, Sm-containing magnetic particulate material can remarkably achieve the effects of the present invention.

The rare earth elements may be used alone or in combination. The amount of the rare earth element(s) is preferably 5 at. % to 40 at. %, more preferably 11 at. % to 35 at. %. The transition metal is not particularly limited and may be appropriately selected depending on the intended purpose. Examples thereof include Fe, Co, Ni and Mn, with Fe being preferred. In particular, magnetic particulate material containing Fe in an amount of from 50 to 90 at. % are preferred. Also, part of Fe may be substituted with Co for the purpose of improving the formed magnet in temperature characteristics without impairing magnetic characteristics.

Furthermore, one or more selected from Mn, Ca, Cr, Nb, Mo, Sb, Ge, Zr, V, Si, Al, Ta, Cu, and other elements may be added for the purposes of improving coercive force, increasing productivity and reducing cost. In this case, the amount of such additional element(s) is preferably 7% by weight or less relative to the total amount of the transition element(s).

Moreover, unavoidable impurities such as carbon and boron may be contained in an amount of 5% by weight or lower.

The rare earth-transition metal magnet may be mixed with various magnet powder such as ferrite and alnico which are generally used as raw materials of a bond magnet. This magnet powder preferably has an anisotropic magnetic field (HA) of 50 kOe (4.0 MA/m) or more.

The magnetic particulate material preferably has a number-average particle diameter of from 0.5 to 8 μm, more preferably from 1 to 3 μm. When the number-average particle diameter thereof is less than 0.5 μM, the magnetic particulate material is degraded in processability, especially dispersibility in resin. When it is more than 8 μM, the magnetic material-dispersed powder tends to involve variation in distribution, resulting in variation between the particles in magnetization intensity.

The magnetic anisotropy where magnetic fields of the magnetic particles are orientated in the same direction is preferably provided, for example, in the following manner. Specifically, at least a magnetic particulate material is mixed and melt-kneaded with a binder resin and then the resultant bulk or resin powder is left for 10 sec or longer in a magnetic flux density of 2 T (tesla) or higher.

The anisotropy of the resin carrier of the present invention means that the magnetisms of particles of a resin containing a magnetic particulate material dispersed therein are oriented in the same direction. When measuring the saturated magnetization of resin particles the magnetisms of which are oriented in different directions, it is necessary to orient the magnetisms of the resin particles in the same direction. Thus, the magnetism of the carrier of the present invention is measured as follows.

First, a cell having a volume of 5.655 $cm^3$ (cc) is charged with the carrier in substantially the closest packed state and closed with a cap to prepare a first sample. Then, the amount of the carrier charged in the first sample is measured. Next, another cell is charged with the carrier in an amount of 75% by weight of the amount of the carrier in the first sample and closed with a cap to prepare a sample (a second sample). Further, another cell is charged with the carrier in an amount of 50% by weight of the amount of the carrier in the first sample and closed with a cap to prepare a sample (a third sample).

Each of these samples is set in a sample holder of VSM-C7-10A (product of TOEI INDUSTRY CO., LTD.) and measured for hysteresis curve at a magnetic field of ±5 kOe.

When the carrier having magnetic anisotropy is charged in the closest packed state, it cannot rotate in the direction of the magnetic field, resulting in that the maximum value is not observed. In other words, when the carrier has magnetic anisotropy, the second or third sample has a higher saturated magnetization than the first sample in which the carrier is charged in the closest packed state. That is, in the case of the resin carrier of the present invention, the second or third sample has a higher saturated magnetization than the first sample in which the carrier is charged in the closest packed state.

The saturated magnetization of the resin carrier of the present invention is from 16 to 30 emu/g when the carrier is charged in an amount of 75% by weight of the amount of the carrier charged in the closest packed state. When the saturated magnetization thereof is lower than 16 emu/g, the magnetization is insufficient to cause carrier adherence. When the saturated magnetization thereof is higher than 30 emu/g, the carrier and the developer easily aggregate.

The residual magnetization of the resin carrier of the present invention is equal to or higher than 50% of the saturated magnetization. When the residual magnetization is lower than 50% of the saturated magnetization, magnetic characteristics as a ferromagnet are insufficient to easily cause problems in durability and stability.

The coercive force of the resin carrier of the present invention is 15 kA/m to 40 kA/m. When the coercive force thereof is 15 kA/m or higher, it is possible to prevent the occurrence of carrier adherence. When it is 40 kA/m or lower, it is hard to cause entrainment occurring on the developing sleeve.

The ratio by weight of the binder resin to the magnetic particulate material (i.e., binder resin/magnetic particulate material) is not particularly limited and may be appropriately selected depending on the intended purpose, but is preferably 65/35 to 80/20. When the above ratio by weight is less than 65/35, the specific resistance becomes too low. When it is more than 80/20, the amount of the magnetic material is insufficient to potentially lead to insufficient intensity of magnetism.

The specific resistance of the resin carrier of the present invention is not particularly limited and may be appropriately selected depending on the intended purpose, but is preferably $10^8$ Ω·cm to $10^{13}$ Ω·cm. When the specific resistance is less than $10^8$ Ω·cm, leakage of current from the sleeve to the photoconductor surface easily occurs in the developing region when employing the developing method of applying bias voltage, making is difficult to form good images. When it is higher than $10^{13}$ Ω·cm, a charge-up phenomenon easily occurs under low-humidity conditions, causing image degradation such as low image density, transfer failure and fogging.

The specific resistance changes depending on the mixing ratio of the magnetic material and the dispersion state of the magnetic material. To adjust the resistance, fine conductive particles such as carbon black and titanium oxide may be kneaded and dispersed in the binder resin.

The average circularity of the resin carrier of the present invention is not particularly limited and may be appropriately selected depending on the intended purpose, but is preferably from 0.85 to 0.94. When the average circularity thereof is lower than 0.85, the flowability of the carrier tends to decrease and also the carrier is easily broken. When it is higher than 0.94, the self-aggregated carrier becomes difficult to return to a non-aggregated state since the carrier of the present invention is ferromagnetic.

The average circularity can easily be adjusted by pulverizing the carrier into particles having a predetermined diameter using a pulverizer such as a ball mill and a jet mill.

The number average particle diameter of the resin carrier of the present invention is 15 μm or more but less than 100 μm, preferably from 15 μm to 80 μm. When the number average particle diameter thereof is less than 15 μm, the self-aggregated carrier may become difficult to return to a non-aggregated state or carrier adherence onto the photoconductor may easily occur. When it is 100 μm or more, magnetic brushes in the development pole become coarse to be hard to obtain high-quality images.

The average circularity and the number average particle diameter can be measured with FPIA3000 (product of SYSMEX CORPORATION).

The resin carrier of the present invention is preferably produced through a process including: a step of melt-kneading a magnetic particulate material in a binder resin; a step of pulverizing and/or classifying the resultant kneaded product so as to have a predetermined particle diameter; and a step of applying a magnetic field of 2 T (tesla) or more to the pulverized and/or classified magnetic material-dispersed resin particles for 10 sec or longer at a temperature equal to or lower than the glass transition temperature of the binder resin. Notably, the upper limit of the magnetic field is preferably 10 T.

The step of melt-kneading a magnetic particulate material in a binder resin is a step of melt-kneading the magnetic material with the binder resin using, for example, a two open-roll kneader or a biaxially kneader extruder. The melt-kneading temperature is preferably equal to or lower than 10° C.+the softening point Tm of the resin.

The step of pulverizing and/or classifying the resultant kneaded product is a step in which the kneaded product obtained in the melt-kneading step is cooled to a temperature equal to or lower than the glass transition temperature of the resin and then coarsely pulverized, and further pulverized to a predetermined particle diameter using a pulverizer such as a ball mill or a jet mill; and optionally, the fine particles and coarse particles are classified to an intended granularity using, for example, a sieve, an elbow-jet classifier or a cyclone classifier.

The magnetic material-dispersed powder produced through the above step is charged into a non-magnetic container, and is subjected to a step in which a uniform parallel magnetic field having a magnetic flux density of 2 T or more is applied to the magnetic material-dispersed powder for 10 sec or longer at a temperature equal to or lower than the glass transition temperature of the resin using a high magnetic field application apparatus (product of Sumitomo Heavy Industries, Ltd.). As a result, the magnetic material dispersed in the resin is provided with magnetic anisotropy.

[Toner]

The toner for electrophotography of the present invention contains at least a binder resin, a colorant, and may further contain other components, if necessary. In the toner of the present invention, the binder resin contains a crystalline resin in an amount of 50% by weight or greater. The binder resin, the crystalline resin, the colorant and other components are explained in detail.

[Binder Resin for Toner]

The binder resin is appropriately selected depending on the intended purpose without any limitation, provided that the binder resin contains a crystalline resin in an amount of 50% by weight or greater, specifically, a main component of the binder resin is substantially the crystalline resin. For example, the binder resin may further contain a non-crystalline resin.

An amount of the crystalline resin in the binder resin is appropriately selected depending on the intended purpose without any limitation, provided that it is 50% by weight or greater. The amount of the crystalline resin is preferably 65% by weight or greater, more preferably 80% by weight or greater, and even more preferably 95% by weight or greater for attaining the maximum effect of the crystalline resin in both of low fixing ability and heat resistant storage stability. When the amount thereof is less than 50% by weight, the thermal sharpness of the binder resin in the viscoelasticity of the toner cannot be exhibited, which makes it difficult to attain both low fixability and heat resistant storage stability of the resulting toner.

In the present specification, as for the term "crystalline," a resin having a ratio (softening point/maximum peak temperature of heat of melting) of 0.80 to 1.55 is defined as a "crystalline resin," where the ratio is a ratio of a softening point of the resin as measured by a elevated flow tester to a maximum peak temperature of heat of melting the resin as measured by a differential scanning calorimeter (DSC). The "crystalline resin" has properties that it is sharply softened by heat.

Moreover, as for "non-crystalline," a resin having a ratio (softening point/maximum peak temperature of heat of melting) of greater than 1.55 is defined as "non-crystalline resin." The "non-crystalline resin" has properties that it is gradually softened by heat.

The softening points of the binder resin and toner can be measured by means of an elevated flow tester (e.g., CFT-500D, manufactured by Shimadzu Corporation). As a sample, 1 g of the binder resin or toner is used. The sample is heated at the heating rate of 6° C./min., and at the same time, load of 1.96 Mpa is applied by a plunger to extrude the sample from a nozzle having a diameter of 1 mm and length of 1 mm, during which an amount of the plunger of the flow tester pushed down relative to the temperature is plotted. The temperature at which half of the sample is flown out is determined as a softening point of the sample.

The maximum peak temperatures of heat of melting the binder resin and toner can be measured by a differential scanning calorimeter (DSC) (e.g., TA-60WS and DSC-60 of Shimadzu Corporation). A sample provided for a measurement of the maximum peak temperature of heat of melting is subjected to a pretreatment. Specifically, the sample is melted at 130° C., followed by cooled from 130° C. to 70° C. at the rate of 1.0° C./min. Next, the sample was cooled from 70° C. to 10° C. at the rate of 0.5° C./min. Then, the sample is heated at the heating rate of 20° C./min. to measure the endothermic and exothermic changes by DSC, to thereby plot "absorption or evolution heat capacity" verses "temperature" in a graph. In the graph, the endothermic peak temperature appeared in the temperature range from 20° C. to 100° C. is determined as an endothermic peak temperature, Ta*. In the case where there are a few endothermic peaks within the aforementioned temperature range, the temperature of the peak at which the absorption heat capacity is the largest is determined as Ta*. Thereafter, the sample is stored for 6 hours at the temperature that is (Ta*−10)° C., followed by storing for 6 hours at the temperature that is (Ta*−15)° C. Next, the sample is cooled to 0° C. at the cooling rate of 10° C./min., and then heated at the heating rate of 20° C./min. to measure the endothermic and exothermic changes by means of DSC, creating a graph in the same manner as the above. In the graph, the temperature corresponding to the maximum peak of the absorption or evolution heat capacity is determined as the maximum peak temperature of heat of melting.

[Crystalline Resin]

The crystalline resin is appropriately selected depending on the intended purpose without any limitation, and examples thereof include a polyester resin, a polyurethane resin, a polyurea resin, a polyamide resin, a polyether resin, a vinyl resin, and a modified crystalline resin. These may be used alone, or in combination. Among them, the polyester resin, polyurethane resin, polyurea resin, polyamide resin, and polyether resin are preferable, the resin having at least either of a urethane backbone or a urea backbone is preferable, and a composite resin containing a linear-chain polyester resin, and a linear-chain polyester resin is more preferable.

As for the resin containing at least either of the urethane backbone or the urea backbone, for example, the aforementioned polyurethane resin, the aforementioned polyurea resin, a urethane-modified polyester resin, and a urea-modified polyester resin are preferably included. The urethane-modified polyester resin is a resin obtained through a reaction between a polyester resin having a terminal isocyanate group, and polyol. The urea-modified polyester resin is a resin obtained through a reaction between a polyester resin having a terminal isocyanate group, and amines.

The maximum peak temperature of heat of melting the crystalline resin is preferably from 45 to 70° C., more preferably from 53 to 65° C., and even more preferably from 58 to 62° C. for attaining both low temperature fixability and heat resistant storage stability of the resulting toner. When the maximum peak temperature thereof is lower than 45° C., the resulting toner has desirable low temperature fixability, but insufficient heat resistant storage stability. When the maximum peak temperature thereof is higher than 70° C., the toner has conversely desirable heat resistant storage stability, but insufficient low temperature fixability.

The crystalline resin has a ratio (softening point/maximum peak temperature of heat of melting) of from 0.80 to 1.55, preferably from 0.85 to 1.25, more preferably from 0.90 to 1.20, and even more preferably from 0.90 to 1.19, where the ratio is a ratio of a softening point of the crystalline resin to a maximum peak temperature of heat of melting the crystalline resin. The smaller value of the ratio is preferable as the smaller the value is more sharply the resin is softened, which can realize to achieve both low temperature fixability and heat resistant storage stability of the resulting toner.

Regarding the viscoelasticity of the crystalline resin, storage elastic modulus G' of the crystalline resin at the temperature that is the maximum peak temperature of heat of melting+20° C. is preferably $5.0\times10^6$ Pa·s or lower, more preferably from $1.0\times10^1$ Pa·s to $5.0\times10^5$ Pa·s, and even more preferably from $1.0\times10^1$ Pa·s to $1.0\times10^4$ Pa·s. Moreover, loss elastic modulus G" of the crystalline resin at the temperature that is the maximum peak temperature of heat of melting+20° C. is preferably $5.0\times10^6$ Pa·s or lower, more preferably from $1.0\times10^1$ Pa·s to $5.0\times10^5$ Pa·s, and even more preferably from $1.0\times10^1$ Pa·s to $1.0\times10^4$ Pa·s. In view of the viscoelasticity of the toner of the present invention, the values of G' and G" at the temperature the maximum peak temperature of heat of melting+20° C. falling into the range of $1.0\times10^3$ Pa·s to $5.0\times10^6$ Pa·s is preferable for giving the fixing strength and hot offset resistance to the resulting toner. Considering that the values of G' and G" increase as the colorant is dispersed in the binder resin, the viscoelasticity of the crystalline resin are preferably within the aforementioned range.

The aforementioned viscoelasticity of the crystalline resin can be achieved by adjusting a mixing ratio between a crystalline monomer and non-crystalline monomer constituting the binder resin, or the molecular weight of the binder resin. For example, the value of G' (Ta+20) degreases as a proportion of the crystalline monomer increases in the monomers constituting the binder resin.

Dynamic viscoelastic values (storage elastic modulus G', loss elastic modulus G") of the resin and toner can be measured by means of a dynamic viscoelastometer (e.g., ARES of TA Instruments Japan Inc.). The measurement is carried out with a frequency of 1 Hz. A sample is formed into a pellet having a diameter of 8 mm, and a thickness of from 1 mm to 2 mm, and the pellet sample is fixed to a parallel plate having a diameter of 8 mm, followed by stabilizing at 40° C. Then, the sample is heated to 200° C. at the heating rate of 2.0° C./min. with frequency of 1 Hz (6.28 rad/s), and strain of 0.1% (in a strain control mode) to thereby measure dynamic viscoelastic values of the sample.

The weight average molecular weight Mw of the crystalline resin is preferably from 2,000 to 100,000, more preferably from 5,000 to 60,000, and even more preferably from 8,000 to 30,000 in view of fixability of the resulting toner. When the weight average molecular weight thereof is smaller than 2,000, the resulting toner is likely to exhibit insufficient hot offset resistance. When the weight average molecular weight thereof is larger than 100,000, low temperature fixability of the resulting toner tends to be degraded.

In the embodiment of the present invention, the weight average molecular weight (Mw) of the binder resin can be measured by means of a gel permeation chromatography (GPC) measuring device (e.g., GPC-8220GPC of Tosoh Corporation). As for a column used for the measurement, TSKgel Super HZM-H, 15 cm, three connected columns (of Tosoh Corporation) are used. The resin to be measured is formed into a 0.15% by weight solution using tetrahydrofuran (THF) (containing a stabilizer, manufactured by Wako Chemical Industries, Ltd.), and the resulting solution is subjected to filtration using a filter having a pore size of 0.2 μm, from which the filtrate is provided as a sample. The THF sample solution is injected in an amount of 100 μL into the measuring device, and the measurement is carried out at a flow rate of 0.35 mL/min. in the environment having the temperature of 40° C. For the measurement of the molecular weight distribution of the sample, a molecular weight distribution of the sample is calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (RI) detector is used.

The toner preferably includes two crystalline resins (A=low-molecular weight) and (B=polymeric) each having a different weight-average molecular weight each other, and more preferably two crystalline resins (A=low-molecular weight) and (B=polymeric) each having a urethane and/or a urea bond and a different weight-average molecular weight each other in terms of its low-temperature fixability and heat resistant storage stability.

The crystalline resin (A) preferably has a weight-average molecular weight (Mw) of from 10,000 to 40,000, more preferably from 15,000 to 35,000, and even more preferably from 20,000 to 30,000 in terms of low-temperature fixability and heat resistant storage stability of the resultant toner. When less than 10,000, the toner tends to deteriorate in heat resistant storage stability. When greater than 40,000, the toner tends to deteriorate in low-temperature fixability.

The crystalline resin (B) preferably has a weight-average molecular weight (Mw) of from 40,000 to 300,000 and more preferably from 50,000 to 150,000 in terms of low-temperature fixability and hot offset resistance of the resultant toner. When less than 40,000, the toner tends to deteriorate in hot offset resistance. When greater than 300,000, the toner does not sufficiently melt particularly at low temperature and the resultant image peels off with ease, resulting in deterioration of the low-temperature fixability of the toner.

The crystalline resin (A) and the crystalline resin (B) preferably have a difference in Mw not less than 5,000, and more preferably not less than 10,000. When less than 5,000, the toner tends to have narrow fixable width.

The content ratio of the crystalline resin (A) to that of the crystalline resin (B) [(A)/(B)] in the toner is preferably from 95/5 to 70/30. When the content ratio of the crystalline resin (A) is larger than this ratio, the toner tends to deteriorate in hot offset resistance. When the content ratio of the crystalline resin (B) is larger than this ratio, the toner tends to deteriorate in low-temperature fixability.

<Polyester Resin>

As for the polyester resin, for example, a polycondensate polyester resin synthesized from polyol and polycarboxylic acid, a lactone ring-opening polymerization product, and polyhydroxycarboxylic acid are included. Among them, the polycondensate polyester resin synthesized from polyol and polycarboxylic acid is preferable in view of exhibition of crystallinity.

<Polyol>

The polyol includes, for example, diol, trihydric to octahydric or higher polyol.

The diol is appropriately selected depending on the intended purpose without any limitation, and examples thereof include: aliphatic diol such as linear-chain aliphatic diol, branched-chain aliphatic diol; C4-C36 alkylene ether glycol; C4-C36 alicyclic diol; alkylene oxide (abbreviated as "AO" hereinafter) of the above-listed alicyclic diol; AO adducts of bisphenols; polylactonediol; polybutadienediol; and diol having a functional group, such as diol having a carboxyl group, diol having a sulfonic acid group or sulfamine group, salts thereof, and diols having other functional groups. Among them, C2-C36 aliphatic diol is preferable, and the linear-chain aliphatic diol is more preferable. These may be used alone, or in combination.

An amount of the linear-chain aliphatic diol is preferably 80 mol % or greater, more preferably 90 mol % or greater relative to the total amount of the diols. Use of the linear-chain aliphatic diol in an amount of 80 mol % or greater is preferable as the crystallinity of the resin is enhanced, both low temperature fixability and heat resistant storage stability are desirably provided to the resulting resin, and the hardness of the resin tends to be increased.

The linear-chain aliphatic diol is appropriately selected depending on the intended purpose without any limitation, and examples thereof include ethylene glycol, 1,3-propanediol, 1,4-butanediol, 1,5-pentanediol, 1,6-hexanediol, 1,7-heptanediol, 1,8-octanediol, 1,9-nanonediol, 1,10-decanediol, 1,11-undecanediol, 1,12-dodecanediol, 1,13-tridecanediol, 1,14-tetradecanediol, 1,18-octadecanediol, and 1,20-eicosanediol. Among them, ethylene glycol, 1,3-propanediol, 1,4-butanediol, 1,6-hexanediol, 1,9-nanonediol, and 1,10-decanediol are preferable, because they are readily available.

The C2-C36 branched-chain aliphatic diol is appropriately selected depending on the intended purpose without any limitation, and examples thereof include 1,2-propylene glycol, butanediol, hexanediol, octanediol, decanediol, dodecanediol, tetradecanediol, neopentyl glycol, and 2,2-diethyl-1,3-propanediol.

The C4-C36 alkylene ether glycol is appropriately selected depending on the intended purpose without any limitation, and examples thereof include diethylene glycol, triethylene glycol, dipropylene glycol, polyethylene glycol, polypropylene glycol, and polytetramethylene ether glycol.

The C4-C36 diol is appropriately selected depending on the intended purpose without any limitation, and examples thereof include 1,4-cyclohexanedimethanol, and hydrogenated bisphenol A.

The alkylene oxide (abbreviated as "AO" hereinafter) of the above-listed alicyclic diol is appropriately selected depending on the intended purpose without any limitation, and examples thereof include adducts (number of moles added: 1 to 30) of ethylene oxide (may be abbreviated as "EO" hereinafter), propylene oxide (may be abbreviated as "PO" hereinafter), butylene oxide (may be abbreviated as "BO").

The bisphenols are appropriately selected depending on the intended purpose without any limitation, and examples thereof include AO (e.g., EO, PO, and BO) adducts (number of moles added: 2 to 30) of bisphenol A, bisphenol F, and bisphenol S.

The polylactone diol is appropriately selected depending on the intended purpose without any limitation, and examples thereof include poly(ϵ-caprolactone)diol.

The diol having a carboxyl group is appropriately selected depending on the intended purpose without any limitation, and examples thereof include: C6-C24 dialkylol alkanoic acid such as 2,2-dimethylol propionic acid (DMPA), 2,2-dimethylol butanoic acid, 2,2-dimethylol heptanoic acid, and 2,2-dimethylol octanoic acid.

The diol having a sulfonic acid group or sulfaminic acid group is appropriately selected depending on the intended purpose without any limitation, and examples thereof include: N,N-bis(2-hydroxyalkyl)sulfamic acid (where the alkyl group is C1-C6 group) and AO adducts thereof (where AO is EO or PO, and the number of moles of AO added is 1 to 6), such as N,N-bis(2-hydroxyethyl) sulfamic acid, and N,N-bis(2-hydroxyethyl) sulfamic acid PO (2 mol) adduct; and bis(2-hydroxyethyl)phosphate.

The neutralized salt group contained in the diol having a neutralized salt group is appropriately selected depending on the intended purpose without any limitation, and examples thereof include C3-C30 tertiary amine (e.g., triethyl amine), and alkali metal (e.g., sodium salt).

Among them, the C2-C12 alkylene glycol, diol having a carboxyl group, AO adduct of bisphenols, and any combination thereof are preferable.

Moreover, the trihydric to octahydric or higher polyol, which is optionally used, is appropriately selected depending on the intended purpose without any limitation, and examples thereof include: C3-C36 trihydric to octahydric or higher polyhydric aliphatic alcohol such as alkane polyol, and its intramolecular or intermolecular dehydrate (e.g., glycerin, trimethylol ethane, trimethylol propane, pentaerythritol, sorbitol, sorbitan, and polyglycerin), saccharide and derivatives thereof (e.g., sucrose, and methylglucoside); AO adduct (number of moles added: 2 to 30) of trisphenols (e.g., trisphenol PA); AO adduct (number of moles added: 2 to 30) of a novolak resin (e.g., phenol novolak, and cresol novolak); and acryl polyol such as a copolymer of hydroxyethyl (meth) acrylate and other vinyl-based monomer. Among them, the trihydric to octahydric or higher aliphatic polyhydric alcohol, and AO adduct of the novolak resin are preferable, and the AO adduct of the novolak resin is more preferable.

<Polycarboxylic Acid>

As for the polycarboxylic acid, for example, dicarboxylic acid, and trivalent to hexavalent, or higher polycarboxylic acid are included.

The dicarboxylic acid is appropriately selected depending on the intended purpose without any limitation, and examples thereof include: aliphatic dicarboxylic acid such as a linear-chain aliphatic dicarboxylic acid, and branched-chain dicarboxylic acid; and aromatic dicarboxylic acid. Among them, the linear-chain aliphatic dicarboxylic acid is preferable.

The aliphatic dicarboxylic acid is appropriately selected depending on the intended purpose without any limitation, and examples thereof preferably include: C4-C36 alkane dicarboxylic acid such as succinic acid, adipic acid, sebacic acid, azelaic acid, dodecane dicarboxylic acid, octadecane dicarboxylic acid, and decyl succinic acid; C4-C36 alkene dicarboxylic acid such as alkenyl succinic acid (e.g., dodecenyl succinic acid, pentadecenyl succinic acid, octadecenyl succinic acid), maleic acid, fumaric acid, citraconic acid; and C6-C40 alicyclic dicarboxylic acid such as dimer acid (e.g., dimeric lenoleic acid).

The aromatic dicarboxylic acid is appropriately selected depending on the intended purpose without any limitation, and examples thereof preferably include C8-C36 aromatic dicarboxylic acid such as phthalic acid, isophthalic acid, terephthalic acid, t-butyl isophthalic acid, 2,6-naphthalene dicarboxylic acid, and 4,4'-biphenyl dicarboxylic acid.

Examples of the optionally used trivalent to hexavalent or higher polycarboxylic acid include C9-C20 aromatic polycarboxylic acid such as trimellitic acid, and pyromellitic acid.

Note that, as the dicarboxylic acid or trivalent to hexavalent or higher polycarboxylic acid, acid anhydrides or C1-C4 lower alkyl ester (e.g., methyl ester, ethyl ester, and isopropyl ester) of the above-listed acids may be used.

Among the above-listed dicarboxylic acids, a use of the aliphatic dicarboxylic acid (preferably, adipic acid, sebacic acid, dodecane dicarboxylic acid, terephthalic acid, isophthalic acid, etc.) alone is particularly preferable, but a copolymer of the aliphatic dicarboxylic acid and the aromatic dicarboxylic acid (preferably, terephthalic acid, isophthalic acid, or t-butyl isophthalic acid; or lower alkyl ester of these aromatic dicarboxylic acids) is also preferably used. In this case, the amount of the aromatic dicarboxylic acid in a copolymer is preferably 20 mol % or smaller.

<Lactone Ring-Opening Polymerization Product>

The lactone ring-opening polymerization product is appropriately selected depending on the intended purpose without any limitation, and examples thereof include a lactone ring-opening polymerization product obtained by subjecting lactones (e.g., C3-C12 monolactone (having one ester group in a ring), such as β-propiolactone, γ-butyrolactone, δ-valerolactone, and ϵ-caprolactone) to ring-opening polymerization using a catalyst (e.g., metal oxide, and an organic metal compound); and a lactone ring-opening polymerization product containing a terminal hydroxy group obtained by subjecting C3-C12 monolactones to ring-opening polymerization using glycol (e.g., ethylene glycol, and diethylene glycol) as an initiator.

The C3-C12 monolactone is appropriately selected depending on the intended purpose without any limitation, but it is preferably ϵ-caprolactone in view of crystallinity.

The lactone ring-opening polymerization product may be selected from commercial products, and examples of the commercial products include highly crystalline polycaprolactone such as H1P, H4, H5, and H7 of PLACCEL series manufactured by Daicel Corporation.

<Polyhydroxycarboxylic Acid>

The preparation method of the polyhydroxycarboxylic acid is appropriately selected depending on the intended purpose without any limitation, and examples thereof include a method in which hydroxycarboxylic acid such as glycolic acid, and lactic acid (e.g., L-lactic acid, D-lactic acid, and racemic lactic acid) is directly subjected to a dehydration-condensation reaction; and a method in which C4-C12 cyclic ester (the number of ester groups in the ring is 2 to 3), which is an equivalent to a dehydration-condensation product between 2 or 3 molecules of hydroxycarboxylic acid, such as glycolide or lactide (e.g., L-lactide acid, D-lactide, and racemic lactic acid) is subjected to a ring-opening polymerization using a catalyst such as metal oxide and an organic metal compound. The method using ring-opening polymerization is preferable because of easiness in adjusting a molecular weight of the resultant.

Among the cyclic esters listed above, L-lactide and D-lactide are preferable in view of crystallinity. Moreover, terminals of the polyhydroxycarboxylic acid may be modified to have a hydroxyl group or carboxyl group.

[Polyurethane Resin]

As for the polyurethane resin, a polyurethane resin synthesized from polyol (e.g., diol, trihydric to octahydric or higher polyol) and polyisocyanate (e.g., diisocyanate, and trivalent or higher polyisocyanate) is included. Among them, the polyurethane resin synthesized from the diol and the diisocyanate is preferable.

As for the diol and trihydric to octahydric or higher polyol, those mentioned as the diol and trihydric to octahydric or higher polyol listed in the description of the polyester resin can be used.

[Polyisocyanate]

As for the polyisocyanate, for example, diisocyanate, and trivalent or higher polyisocyanate are included.

The diisocyanate is appropriately selected depending on the intended purpose without any limitation, and examples thereof include aromatic diisocyanates, aliphatic diisocyanates, alicyclic diisocyanates, and aromatic aliphatic diisocyanates. Among them, preferable examples include the C6-C20 aromatic diisocyanate (the number of the carbon atoms excludes other than those contained in NCO groups, which is the same as follows), the C2-C18 aliphatic diisocyanate, C4-C15 alicyclic diisocyanate, C8-C15 aromatic aliphatic diisocyanate, and modified products (e.g., modified products containing a urethane group, carboxyimide group, allophanate group, urea group, biuret group, uretdione group, uretimine group, isocyanurate group, or oxazolidone group) of the preceding diisocyanates, and a mixture of two or more of the preceding diisocyanates. Optionally, trivalent or higher isocyanate may be used in combination.

The aromatic diisocyanates are appropriately selected depending on the intended purpose without any limitation, and examples thereof include 1,3- and/or 1,4-phenylene diisocyanate, 2,4- and/or 2,6-tolylenediisocyanate (TDI), crude TDI, 2,4'- and/or 4,4'-diphenyl methane diisocyanate (MDI), crude MDI (e.g., a phosgenite product of crude diaminophenyl methane (which is a condensate between formaldehyde and aromatic amine (aniline) or a mixture thereof, or condensate of a mixture of diaminodiphenyl methane and a small amount (e.g., 5% by weight to 20% by weight) of trivalent or higher polyamine) and polyallylpolyisocyanate (PAPI)), 1,5-naphthalene diisocyanate, 4,4',4"-triphenylmethane triisocyanate, and m- and p-isocyanatephenylsulfonyl isocyanate.

The aliphatic diisocyanates are appropriately selected depending on the intended purpose without any limitation, and examples thereof include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

The alicyclic diisocyanates are appropriately selected depending on the intended purpose without any limitation, and examples thereof include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and 2,6-norbornanediisocyanate.

The aromatic aliphatic diisocyanate is appropriately selected depending on the intended purpose without any limitation, and examples thereof include m- and p-xylene diisocyanate (XDI), and $\alpha,\alpha,\alpha',\alpha'$-tetramethylxylene diisocyanate (TMXDI).

Moreover, the modified product of the diisocyanate is appropriately selected depending on the intended purpose without any limitation, and examples thereof include modified products containing a urethane group, carboxyimide group, allophanate group, urea group, biuret group, uretdione group, uretimine group, isocyanurate group, or oxazolidone group. Specific examples thereof include: modified products of diisocyanate such as modified MDI (e.g., urethane-modified MDI, carbodiimide-modified MDI, and trihydrocarbylphosphate-modified MDI), and urethane-modified TDI (e.g., isocyanate-containing prepolymer); and a mixture of two or more of these modified products of diisocyanate (e.g., a combination of modified MDI and urethane-modified TDI).

Among these diisocyanates, C6-C15 aromatic diisocyanate (where the number of carbon atoms excludes those contained in NCO groups, which will be the same as follows), C4-C12 aliphatic diisocyanate, and C4-C15 alicyclic diisocyanate are preferable, and TDI, MDI, HDI, hydrogenated MDI, and IPDI are particularly preferable.

[Polyurea Resin]

As for the polyurea resin, a polyurea resin synthesized from polyamine (e.g., diamine, and trivalent or higher polyamine) and polyisocyanate (e.g., diisocyanate, and trivalent or higher polyisocyanate) is included. Among them, the polyurea resin synthesized from the diamine and the diisocyanate is preferable.

As for the diisocyanate and trivalent or higher polyisocyanate, those listed as the diisocyanate and trivalent or higher polyisocyanate in the description of the polyurethane resin can be used.

<Polyamine>

As for the polyamine, for example, diamine, and trivalent or higher polyamine are included.

The diamine is appropriately selected depending on the intended purpose without any limitation, and examples thereof include aliphatic diamines, and aromatic diamines. Among them, C2-C18 aliphatic diamines, and C6-C20 aromatic diamines are preferable. With this, the trivalent or higher amines may be used in combination, if necessary.

The C2-C18 aliphatic diamines are appropriately selected depending on the intended purpose without any limitation, and examples thereof include: C2-C6 alkylene diamine, such as ethylene diamine, propylene diamine, trimethylene diamine, tetramethylene diamine, and hexamethylene diamine; C4-C18 alkylene diamine, such as diethylene triamine, iminobispropyl amine, bis(hexamethylene)triamine, triethylene tetramine, tetraethylene pentamine, and pentaethylene hexamine; C1-C4 alkyl or C2-C4 hydroxyalkyl substitution products of the alkylene diamine or polyalkylene diamine, such as dialkylaminopropylamine, trimethylhexamethylene diamine, aminoethylethanolamine, 2,5-dimethyl-2,5-hexamethylene diamine, and methyl isobispropyl amine; C4-C15 alicyclic diamine, such as 1,3-diaminocyclohexane, isophorone diamine, menthane diamine, and 4,4'-methylene dichlorohexane diamine (hydrogenated methylene dianiline); C4-C15 heterocyclic diamine, such as piperazine, N-aminoethyl piperazine, 1,4-diaminoethyl piperazine, 1,4-bis(2-amino-2-methylpropyl)piperazine, 3,9-bis(3-aminopropyl)-2,4,8,10-tetraoxapiro[5,5]undecane; and C8-C15 aromatic ring-containing aliphatic amines such as xylylene diamine, and tetrachloro-p-xylylene diamine.

The C6-C20 aromatic diamines are appropriately selected depending on the intended purpose without any limitation, and examples thereof include: unsubstituted aromatic diamine such as 1,2-, 1,3- and 1,4-phenylenediamine, 2,4'- and 4,4'-diphenyl methanediamine, crude diphenyl methanediamine (e.g., polyphenyl polymethylene polyamine), diaminodiphenyl sulfone, benzidine, thiodianiline, bis(3,4-diaminophenyl)sulfone, 2,6-diaminopyridine, m-aminobenzylamine, triphenylmethane-4,4',4"-triamine, and naphthylene diamine; aromatic diamine containing a C1-C4 nuclear substituted alkyl group such as 2,4- and 2,6-tolylenediamine, crude tolylenediamine, diethyltolylenediamine, 4,4'-diamino-3,3'-dimethyldiphenyl methane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenyl methane, 3,5-diethyl-3'-methyl-2',4-diaminodiphenyl methane, 3,3'-diethyl-2,2'-diaminodiphenyl methane, 4,4'-diamino-3,3'-dimethyldiphenyl methane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenylsulfone; mixtures of isomers of the unsubstituted aromatic diamine and/or aromatic diamine containing a C1-C4 nuclear substituted alkyl group at various mixing ratios; methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, and 3-dimethoxy-4-aminoaniline; aromatic diamine containing a nuclear substituted electron-withdrawing group (e.g., halogen such as Cl, Br, I, and F; an alkoxy group such as a methoxy group and ethoxy group; and a nitro group), such as 4,4'-diamino-3,3'-dimethyl-5,5'-dibromodiphenyl methane, 3,3'-dichlorobenzidine, 3,3'dimethoxybenzidine, bis(4-amino-3-chlorophenyl)oxide, bis(4-amino-2-chlorophenyl)propane, bis(4-amino-2-chlorophenyl) sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl) disulfide, 4,4'-methylene bis(2-iodoaniline), 4,4'-methylenebis(2-bromoaniline), 4,4'-methylenebis(2-fluoroaniline), and 4-aminophenyl-2-chloroaniline; and aromatic diamine containing a secondary amino group (e.g., part of or entire primary amino groups of the unsubstituted aromatic diamine, aromatic diamine containing a C1-C4 nuclear substituted alkyl group, mixture of isomers thereof at various mixing ratios, and aromatic diamine containing a nuclear substituted electron-withdrawing group are substituted with secondary amino group using lower alkyl groups such as a methyl group, and ethyl group), such as 4,4'-di (methylamino)diphenyl methane, and 1-methyl-2-methylamino-4-aminobenzene.

As for the diamine, other than those listed above, polyamide polyamine such as low molecular polyamide polyamine obtained by condensation of dicarboxylic acid (e.g., dimer acid) and excess (2 moles or more per mole of acid) of the polyamine (e.g., the alkylene diamine, and the poly alkylene polyamine); and polyether polyamine such as hydride of cyanoethylated product of polyetherpolyol (e.g., polyalkylene glycol) are included.

[Polyamide Resin]

As for the polyamide resin, a polyamide resin synthesized from polyamine (e.g., diamine, and trivalent or higher polyamine), and polycarboxylic acid (e.g., dicarboxylic acid, and trivalent to hexavalent or higher polycarboxylic acid) is included. Among them, the polyamide resin synthesized from diamine and dicarboxylic acid is preferable.

As for the diamine and trivalent or higher polyamine, those listed as the diamine and trivalent or higher polyamine in the description of the polyurea resin can be used.

As for the dicarboxylic acid and trivalent to hexavalent or higher polycarboxylic acid, those listed as the dicarboxylic acid and trivalent to hexavalent or higher polycarboxylic acid in the description of the polyester resin can be used.

[Polyether Resin]

The polyether resin is appropriately selected depending on the intended purpose without any limitation, and examples thereof include crystalline polyoxyalkylene polyol.

The preparation method of the crystalline polyoxyalkylene polyol is appropriately selected from the conventional methods known in the art depending on the intended purpose without any limitation, and examples thereof include: a method in which chiral AO is subjected to ring-opening polymerization using a catalyst that is commonly used for a polymerization of AO (e.g., a method described in Journal of the American Chemical Society, 1956, Vol. 78, No. 18, pp. 4787-4792); and a method in which inexpensive racemic AO is subjected to ring-opening polymerization using a catalyst that is a complex having a three-dimensionally bulky unique chemical structure.

As for the method using the unique complex, a method using a compound in which a lanthanoide complex and organic aluminum are in contact as a catalyst (e.g., a method described in JP-11-12353-A), and a method in which bimetal-μ-oxoalkoxide and a hydroxyl compound are reacted in advance (e.g., a method described in JP-2001-521957-A) have been known.

As for the method for obtaining crystalline polyoxyalkylene polyol having extremely high isotacticity, a method using a salen complex (e.g., the method described in Journal of the American Chemical Society, 2005, Vol. 127, No. 33, pp. 11566-11567) has been known. For example, by using glycol or water as an initiator in the course of a ring-opening polymerization of chiral AO, polyoxyalkylene glycol containing a terminal hydroxyl group, and having isotacticity of 50% or higher is yielded. The polyoxyalkylene glycol having isotacticity of 50% or higher may be the one whose terminal group may be modified to have a carboxyl group. Note that, the isotacticity of 50% or higher generally results in crystallinity. As for the glycol, the aforementioned diol is included. As for the carboxylic acid used for the carboxy-modification, the aforementioned dicarboxylic acid is included.

As for AO used for the production of the crystalline polyoxyalkylene polyol, C3-C9 AO is included. Examples thereof include PO, 1-chlorooxetane, 2-chlorooxetane, 1,2-dichlorooxetane, epichlorohydrin, epibromohydrin, 1,2-BO, methyl glycidyl ether, 1,2-pentyleneoxide, 2,3-pentyleneoxide, 3-methyl-1,2-butyleneoxide, cyclohexene oxide, 1,2-hexyleneoxide, 3-methyl-1,2-pentyleneoxide, 2,3-hexyleneoxide, 4-methyl-2,3-pentyleneoxide, allylglycidyl ether, 1,2-heptyleneoxide, styrene oxide, and phenylglycidyl ether. Among these AOs, PO, 1,2-BO, styrene oxide, and cyclohexene oxide are preferable, PO, 1,2-BO, and cyclohexene oxide are more preferable. These AOs may be used alone or in combination.

The isotacticity of the crystalline polyoxyalkylene polyol is preferably 70% or higher, more preferably 80% or higher, even more preferably 90% or higher, and particularly preferably 95% or higher, in view of high sharp melt properties and blocking resistance of the resulting crystalline polyether resin.

The isotacticity can be calculated by the method described in Macromolecules, Vol. 35, No. 6, pp. 2389-2392 (2002), and can be obtained in the following manner.

About 30 mg of a measuring sample is weight and taken into a sample tube for $^{13}$C-NMR having a diameter of 5 mm, and about 0.5 mL of a deuteration solvent is added thereto to dissolve the sample therein, to thereby prepare a sample for analysis. The deuteration solvent for use is not particularly limited, and appropriately selected from solvents capable of dissolving the sample. Examples of such deuteration solvent include deuterated chloroform, deuterated toluene, deuterated dimethylsulfoxide, and deuterated dimethyl formamide. Three signals of $^{13}$C-NMR derived from a methine group are respectively appeared around the syndiotactic value (S) of 75.1 ppm, heterotactic value (H) of 75.3 ppm, and isotactic value (I) of 75.5 ppm.

The isotacticity is calculated by the following equation 1:

$$\text{Isotacticity (\%)}=[I/(I+S+H)]\times 100 \qquad \text{Equation 1}$$

In the equation 1, I is an integral value of the isotactic signal, S is an integral value of the syndiotactic signal, and H is an integral value of the heterotactic signal.

[Vinyl Resin]

The vinyl resin is appropriately selected depending on the intended purpose without any limitation, provided that it has crystallinity, but it is preferably one containing, in its constitutional unit, a crystalline vinyl monomer and optionally a non-crystalline vinyl monomer.

The crystalline vinyl monomer is appropriately selected depending on the intended purpose without any limitation, and examples thereof preferably include a linear-chain alkyl (meth)acrylate having C12-C50 alkyl group (C12-C50 linear-chain alkyl group is a crystalline group), such as lauryl (meth)acrylate, tetradecyl(meth)acrylate, stearyl(meth)acrylate, eicosyl(meth)acrylate, and behenyl(meth)acrylate.

The non-crystalline vinyl monomer is appropriately selected depending on the intended purpose without any limitation, but it is preferably a vinyl monomer having a molecular weight of 1,000 or smaller. Examples thereof include styrenes, (meth)acryl monomer, a carboxyl group-containing vinyl monomer, other vinyl ester monomers, and aliphatic hydrocarbon vinyl monomer. These may be used alone, or in combination.

The styrenes are appropriately selected depending on the intended purpose without any limitation, and examples thereof include styrene, and alkyl styrene having a C1-C3 alkyl group.

The (meth)acryl monomer is appropriately selected depending on the intended purpose without any limitation, and examples thereof include: (meth)acrylate where the alkyl group has 1 to 11 carbon atoms and branched alkyl(meth) acrylate where the alkyl group has 12 to 18 carbon atoms, such as methyl(meth)acrylate, ethyl(meth)acrylate, butyl (meth)acrylate, and 2-ethylhexyl (meth)acrylate; hydroxylalkyl(meth)acrylate where the alkyl group has 1 to 11 carbon atoms, such as hydroxylethyl(meth)acrylate; and alkylamino group-containing (meth)acrylate where the alkyl group contains 1 to 11 carbon atoms, such as dimethylaminoethyl (meth)acrylate, and diethylaminoethyl(meth)acrylate.

The carboxyl group-containing vinyl monomer is appropriately selected depending on the intended purpose without any limitation, and examples thereof include: C3-C15 monocarboxylic acid such as (meth)acrylic acid, crotonic acid, and cinnamic acid; C4-C15 dicarboxylic acid such as maleic acid (anhydride), fumaric acid, itaconic acid, and citraconic acid; dicarboxylic acid monoester, such as monoalkyl (C1-C18) ester of dicarboxylic acid (e.g., maleic acid monoalkyl ester, fumaric acid monoalkyl ester, itaconic acid monoalkyl ester, and citraconic acid monoalkyl ester).

The aforementioned other vinyl ester monomers are appropriately selected depending on the intended purpose without any limitation, and examples thereof include: C4-C15 aliphatic vinyl ester such as vinyl acetate, vinyl propionate, and isopropenyl acetate; C8-C50 unsaturated carboxylic acid polyhydric (dihydric to trihydric or higher) alcohol ester such as ethylene glycol di (meth)acrylate, propylene glycol di(meth)acrylate, neopentyl glycol di (meth)acrylate, trimethylolpropane tri (meth)acrylate, 1,6-hexanediol diacrylate, and polyethylene glycol di(meth)acrylate; and C9-C15 aromatic vinyl ester such as methyl-4-vinylbenzoate.

The aliphatic hydrocarbon vinyl monomer is appropriately selected depending on the intended purpose without any limitation, and examples thereof include: C2-C10 olefin such as ethylene, propylene, butene, and octene; and C4-C10 diene such as butadiene, isoprene, and 1,6-hexadiene.

[Modified Crystalline Resin (Binder Resin Precursor)]

The modified crystalline resin is appropriately selected depending on the intended purpose without any limitation, provided that it is a crystalline resin having a functional group reactive with an active hydrogen group. Examples of the modified crystalline resin include a crystalline polyester resin, crystalline polyurethane resin, crystalline polyurea resin, crystalline polyamide resin, crystalline polyether resin, and crystalline vinyl resin, all of which contain a functional group reactive with an active hydrogen group. The modified crystalline resin is reacted with a compound having an active hydrogen group (e.g., a resin containing an active hydrogen group, and a crosslinking or elongation agent containing an active hydrogen) during the production of a toner, so that the molecular weight of the resulting resin is increased to form a binder resin. Accordingly, the modified crystalline resin can be used as a binder resin precursor in the production of the toner.

Note that, the binder resin precursor denotes a compound capable of undergoing an elongation reaction or crosslink reaction, including the aforementioned monomers, oligomers, and modified resins or oligomers having a functional group reactive with an active hydrogen group for constituting the binder resin. The binder resin precursor may be a crystalline resin or a non-crystalline resin, provided that it satisfies these conditions. Among them, the binder resin precursor is preferably the modified crystalline resin containing an isocyanate group at least at a terminal thereof, and it is preferred that the binder resin precursor undergo an elongation and/or crosslink reaction with an active hydrogen group during granulating toner particles by dispersing and/or emulsifying in an aqueous medium, to thereby form a binder resin.

As for the binder resin formed from the binder resin precursor in the aforementioned manner, a crystalline resin obtained by an elongation reaction and/or crosslink reaction of the modified resin containing a functional group reactive with an active hydrogen group and the compound containing an active hydrogen group is preferable. Among them, a urethane-modified polyester resin obtained by an elongation and/or crosslink reaction of the polyester resin containing a terminal isocyanate group and the polyol; and a urea-modified polyester resin obtained by an elongation reaction and/or crosslink reaction of the polyester resin containing a terminal isocyanate group and the amines are preferable.

The functional group reactive with an active hydrogen group is appropriately selected depending on the intended purpose without any limitation, and examples thereof include functional groups such as an isocyanate group, an epoxy group, a carboxylic group, and an acid chloride group. Among them, the isocyanate group is preferable in view of the reactivity and stability.

The compound containing an active hydrogen group is appropriately selected depending on the intended purpose without any limitation, provided that it contains an active hydrogen group. In the case where the functional group reactive with an active hydrogen group is an isocyanate group, for example, the compound containing an active hydrogen group includes compounds containing a hydroxyl group (e.g., alcoholic hydroxyl group and phenolic hydroxyl group), an amino group, a carboxyl group, and a mercapto group as the active hydrogen group. Among them, the compound containing an amino group (e.g., amines) is particularly preferable in view of the reaction speed.

The amines are appropriately selected depending on the intended purpose without any limitation, and examples thereof include phenylene diamine, diethyl toluene diamine, 4,4'diaminodiphenylmethane, 4,4'-diamino-3,3' dimethyldicyclohexylmethane, diamine cyclohexane, isophorone diamine, ethylene diamine, tetramethylene diamine, hexamethylene diamine, diethylene triamine, triethylene tetramine, ethanol amine, hydroxyethyl aniline, aminoethylmercaptan, aminopropylmercaptan, amino propionic acid, and amino caproic acid. Moreover, a ketimine compound and oxazoline compound where amino groups of the preceding amines are blocked with ketones (e.g., acetone, methyl ethyl ketone, and methyl isobutyl ketone) are also included as the examples of the amines.

The crystalline resin may be a block copolymer resin having a crystalline segment and a non-crystalline segment, and the crystalline resin can be used as the crystalline segment. A resin used for forming the non-crystalline segment is appropriately selected depending on the intended purpose without any limitation, and examples thereof include a polyester resin, a polyurethane resin, a polyurea resin, a polyamide resin, a polyether resin, a vinyl resin (e.g., polystyrene, and styreneacryl-based polymer), and an epoxy resin.

Since the crystalline segment is preferably at least one selected from the group consisting of a polyester resin, a polyurethane resin, a polyurea resin, a polyamide resin, and a polyether resin, in view of compatibility, the resin used for forming the non-crystalline segment is also preferably selected from a polyester resin, a polyurethane resin, a polyurea resin, a polyamide resin, a polyether resin, and a composite resin thereof, more preferably a polyurethane resin, or a polyester resin. The formulation of the non-crystalline segment can be any combinations of materials which is appropriately selected depending on the intended purpose without any limitation, provided that it is a non-crystalline resin. Examples of a monomer for use include the aforementioned polyol, the aforementioned polycarboxylic acid, the aforementioned polyisocyanate, the aforementioned polyamine, and the aforementioned AO.

[Non-Crystalline Resin]

The non-crystalline resin is appropriately selected from conventional resins known in the art depending on the intended purpose without any limitation, provided that it is non-crystalline. Examples thereof include: homopolymer of styrene or substitution thereof (e.g., polystyrene, poly-p-styrene, and polyvinyl toluene), styrene copolymer (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); other resins (e.g., a polymethyl methacrylate resin, a polybutyl methacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, a polyacrylic acid resin, a rosin resin, a modified rosin resin, a terpene resin, an aliphatic or alicyclic hydrocarbon resin, an aromatic petroleum resin); and modified products of the preceding resins to contain a functional group reactive an active hydrogen group. These may be used alone, or in combination.

<Colorant>

The colorant is appropriately selected from conventional dyes and pigments known in the art depending on the intended purpose without any limitation, and examples thereof include: carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. These may be used alone, or in combination.

A color of the colorant is appropriately selected depending on the intended purpose without any limitation, and examples thereof include a colorant for black, and color colorants for magenta, cyan, and yellow. These may be used alone, or in combination.

Examples of the colorant for black include: carbon black (C.I. Pigment Black 7) such as furnace black, lamp black, acetylene black, and channel black; metals such as copper, iron (C.I. Pigment Black 11), and titanium oxide; and organic pigments such as aniline black (C.I. Pigment Black 1).

Examples of the colorant for magenta include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, 211; C.I. Pigment Violet 19; and C.I. Vat Red 1, 2, 10, 13, 15, 23, 29, 35.

Examples of the colorant for cyan include: C.I. Pigment Blue 2, 3, 15, 15:1, 15:2, 15:3, 15:4, 15:6, 16, 17, 60; C.I. Vat Blue 6; C.I. Acid Blue 45, a copper phthalocyanine pigment, a copper phthalocyanine pigment in which 1 to 5 methyl phthalimide groups have been introduced to the phthalocyanine backbone, Green 7, and Green 36.

Examples of the colorant for yellow include: C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Vat Yellow 1, 3, 20; and C.I. Pigment Orange 36.

An amount of the colorant in the toner is appropriately selected depending on the intended purpose without any limitation, but it is preferably 1% by weight to 15% by weight, more preferably 3% by weight to 10% by weight. When the amount thereof is smaller than 1% by weight, the tinting strength reduces. When the amount thereof is greater than 15% by weight, a dispersion failure of the pigment particles occurs in the toner, which may cause reduction in tinting strength and electric characteristics of the toner.

The colorant may form a composite with a resin for master batch, and may be used as a master batch. The resin for master batch is appropriately selected from those known in the art depending on the intended purpose without any limitation, and examples thereof include polymer of styrene or substitution thereof, styrene copolymer, a polymethyl methacrylate resin, a polybutyl methacrylate resin, a polyvinyl chloride resin, a polyvinyl acetate resin, a polyethylene resin, a polypropylene resin, a polyester resin, an epoxy resin, an epoxypolyol resin, a polyurethane resin, a polyamide resin, a polyvinyl butyral, a polyacrylic acid resin, rosin, modified rosin, a terpene resin, an aliphatic hydrocarbon resin, an alicyclic hydrocarbon resin, an aromatic petroleum resin, chlorinated paraffin, and paraffin wax. These may be used alone, or in combination.

Examples of the polymer of styrene or substitution thereof include a polyester resin, a polystyrene resin, a poly-p-chlorostyrene resin, and polyvinyl toluene resin. Examples of the styrene copolymer include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer.

As for the resin for the master batch, the binder resin of the present invention, such as the aforementioned crystalline resin, can be used without any problem.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

[Other Components]

The toner of the present invention may contain other components than the binder resin, and colorant, if necessary, provided that the obtainable effect of the invention is not impaired. Examples of the aforementioned components include a releasing agent, a charge controlling agent, an external additive, a fluidity improver, a cleanability improver, and a magnetic material.

<Releasing Agent>

The releasing agent is appropriately selected from those known in the art without any limitation, and examples thereof include wax, such as carbonyl group-containing wax, polyolefin wax, and a long chain hydrocarbon. These may be used alone, or in combination. Among them, the carbonyl group-containing wax is preferable.

Examples of the carbonyl group-containing wax include polyalkanoic acid ester, polyalkanol ester, polyalkanoic acid amide, polyalkyl amide, and dialkyl ketone.

Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate. Examples of the polyalkanol ester include tristearyl trimellitate, and distearyl maleate. Examples of the polyalkanoic acid amide include dibehenyl amide. Examples of the polyalkyl amide include trimellitic acid tristearyl amide. Examples of the dialkyl ketone include distearyl ketone. Among the carbonyl group-containing wax mentioned above, polyalkanoic acid ester is particularly preferable.

Examples of the polyolefin wax include polyethylene wax, and polypropylene wax.

Examples of the long chain hydrocarbon include paraffin wax, and Sasol wax.

The melting point of the releasing agent is appropriately selected depending on the intended purpose without any limitation, but it is preferably 40° C. to 160° C., more preferably 50° C. to 120° C., and even more preferably 60° C. to 90° C. When the melting point thereof is lower than 40° C., use of such releasing agent may adversely affect the heat resistant storage stability of the resulting toner. When the melting point thereof is higher than 160° C., the resulting toner is likely to cause cold offset during the fixing at low temperature.

The melting point of the releasing agent can be measured, for example, by means of a differential scanning calorimeter (DSC210, Seiko Instruments Inc.) in the following manner. A sample of the releasing agent is heated to 200° C., cooled from 200° C. to 0° C. at the cooling rate of 10° C./min., followed by heating at the heating rate of 10° C./min. The maximum peak temperature of heat of melting as obtained is determined as a melting point of the releasing agent.

A melt viscosity of the releasing agent, which is measured at the temperature higher than the melting point of the releasing agent by 20° C., is preferably 5 cps to 1,000 cps, more preferably 10 cps to 100 cps. When the melt viscosity thereof is lower than 5 cps, the releasing ability of the toner may be degraded. When the melt viscosity thereof is higher than 1,000 cps, the effect of improving hot offset resistance and low temperature fixability may not be attained.

An amount of the releasing agent in the toner is appropriately selected depending on the intended purpose without any limitation, but it is preferably 0% by weight to 40% by weight, more preferably 3% by weight to 30% by weight. When the amount of the releasing agent is greater than 40% by weight, the flowability of the toner particles may be degraded.

<Charge Controlling Agent>

The charge controlling agent is appropriately selected from those known in the art without any limitation, but it is preferably a no-color or white material as use of a colored material as the charge controlling agent may change a color tone of the toner. Examples of such charge controlling agent include a triphenyl methane dye, a molybdic acid chelate compound, Rhodamine dye, alkoxy amine, a quaternary ammonium salt (including a fluorine-modified quaternary ammonium salt), alkylamide, phosphor and a compound including phosphor, tungsten and a compound including tungsten, a fluorine-containing activator, a metal salt of salicylic acid, and a metal salt of salicylic acid derivative. These may be used alone, or in combination.

The charge controlling agent may be selected from commercial products thereof, and examples of the commercial products include: BONTRON P-51 (quaternary ammonium salt), E-82 (oxynaphthoic acid-based metal complex), E-84 (salicylic acid-based metal complex) and E-89 (phenol condensate), all manufactured by ORIENT CHEMICAL INDUSTRIES CO., LTD; TP-302 and TP-415 (quaternary ammonium salt molybdenum complexes) both manufactured by Hodogaya Chemical Co., Ltd.; COPY CHARGE PSY VP 2038 (quaternary ammonium salt), COPY BLUE PR (triphenylmethane derivative), COPY CHARGE NEG VP2036 and COPY CHARGE NX VP434 (quaternary ammonium salts), all manufactured by Hoechst AG; LRA-901 and LR-147 (boron complexes), both manufactured by Japan Carlit Co., Ltd.; quinacridone; azo pigments; and polymeric compounds having, as a functional group, a sulfonic acid group, carboxyl group, quaternary ammonium salt, etc.

The charge controlling agent may be dissolved and dispersed after being melted and kneaded together with the master batch, or added together with other components of the toner directly to an organic solvent when dissolution and/or dispersion is performed. Alternatively, the charge controlling agents may be fixed on surfaces of toner particles after the production of the toner particles.

An amount of the charge controlling agent in the toner cannot be determined unconditionally, as it varies depending on the binder resin for use, the presence of the additive, the dispersion method, etc. For example, an amount of the charge controlling agent is preferably 0.1 parts by weight to 10 parts by weight, more preferably 0.2 parts by weight to 5 parts by weight, relative to 100 parts by weight of the binder resin. When the amount thereof is smaller than 0.1 parts by weight, the charge controlling ability cannot be attained. When the amount thereof is greater than 10 parts by weight the electrostatic propensity of the resulting toner is excessively large, which reduces the effect of charge controlling agent. As a result, the electrostatic suction force toward the developing roller may increase, which may cause poor flowing ability of the developer, and low image density.

<External Additive>

The external additive is appropriately selected from those known in the art depending on the intended purpose without any restriction, and examples thereof include silica particles, hydrophobic silica particles, a fatty acid metal salt (e.g., zinc stearate, and aluminum stearate), metal oxide (e.g., titanium oxide, alumina, tin oxide, and antimony oxide), hydrophobic metal oxide particles, and fluoropolymer. Among them, hydrophobic silica particles, hydrophobic titanium oxide particles, and hydrophobic alumina particles are preferable.

Examples of the silica particles include: HDK H 2000, HDK H 2000/4, HDK H 2050EP, HVK21, and HDK H1303 (all manufactured by Hoechst AG); and R972, R974, RX200, RY200, R202, R805, and R812 (all manufactured by Nippon Aerosil Co., Ltd.). Examples of the titanium oxide particles include: P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION). Examples of the hydrophobic titanium oxide particles include: T-805 (manufactured by Nippon Aerosil Co., Ltd.); STT-30A, and STT-65S-S (both manufactured by Titan Kogyo, Ltd.); TAF-500T, and TAF-1500T (both manufactured by Fuji Titanium Industry Co., Ltd.); MT-100S, and MT-100T (both manufactured by TAYCA CORPORATION); and IT-S (manufactured by ISHIHARA SANGYO KAISHA, LTD.).

In order to attain hydrophobic silica particles, hydrophobic titanium oxide particles, and hydrophobic alumina particles, hydrophilic particles (e.g., silica particles, titanium oxide particles, and alumina particles) are treated with a silane coupling agent such as methyltrimethoxy silane, methyltriethoxy silane, and octyltrimethoxy silane.

As for the external additive, silicone-oil-treated inorganic particles, which have been treated with silicone oil, optionally with an application of heat, can be suitably used.

As for the silicone oil, for example, dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl or methacryl-modified silicone oil, and α-methylstyrene-modified silicone oil can be used.

Examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica, and titanium dioxide are particularly preferable.

An amount of the external additive for use is preferably 0.1% by weight to 5% by weight, more preferably 0.3% by weight to 3% by weight, relative to the toner.

The number average particle diameter of primary particles of the inorganic particles is preferably 100 nm or smaller, more preferably 3 nm to 70 nm. When the number average particle diameter thereof is smaller than 3 nm, the inorganic particles are embedded into the toner particles, and therefore the inorganic particles do not effectively function. When the number average particle diameter is greater than 100 nm, the inorganic particles may unevenly damage a surface of a latent electrostatic image bearing member, and hence not preferable.

As the external additive, the inorganic particles, hydrophobic inorganic particles and the like may be used in combination. The number average particle diameter of primary particles of hydrophobic particles is preferably 1 nm to 100 nm. Of these, it is preferred that the external additive contain two types of inorganic particles having the number average particle diameter of 5 nm to 70 nm. Further, it is preferred that the external additive contain two types of inorganic particles having the number average particle of hydrophobic-treated primary particles thereof being 20 nm or smaller, and one type of inorganic particles having the number average particle thereof of 30 nm or greater. Moreover, the external additive preferably has BET specific surface area of 20 $m^2/g$ to 500 $m^2/g$.

Examples of the surface treating agent for the external additive containing the oxide particles include: a silane-coupling agent (e.g., dialkyl dihalogenated silane, trialkyl halogenated silane, alkyl trihalogenated silane, and hexaalkyl disilazane), a sililation agent, a silane-coupling agent containing a fluoroalkyl group, an organic titanate-based coupling agent, an aluminum-based coupling agent, silicone oil, and silicone varnish.

As the external additive, resin particles can also be added. Examples of the resin particles include; polystyrene obtained by a soap-free emulsification polymerization, suspension polymerization, or dispersion polymerization; copolymer of methacrylic ester or acrylic ester; polymer particles obtained by polymerization condensation, such as silicone, benzoguanamine, and nylon; and polymer particles formed of a thermoset resin. Use of these resin particles in combination can reinforce the charging ability of the toner, reduces reverse charges of the toner, reducing background deposition. An amount of the resin particles for use is preferably 0.01% by weight to 5% by weight, more preferably 0.1% by weight to 2% by weight, relative to the toner.

<Fluidity Improver>

The fluidity improver is an agent capable of performing surface treatment of the toner to increase hydrophobicity, and preventing degradations of flow properties and charging properties of the toner even in a high humidity environment. Examples of the fluidity improver include a silane-coupling agent, a silylation agent, a silane-coupling agent containing a fluoroalkyl group, an organic titanate-based coupling agent, an aluminum-based coupling agent, silicone oil, and modified silicone oil.

<Cleanability Improver>

The cleanability improver is added to the toner for the purpose of removing the developer remained on a latent electrostatic image bearing member or intermediate transfer member after transferring. Examples of the cleanability improver include: fatty acid metal salt such as zinc stearate, calcium stearate, and stearic acid; and polymer particles produced by soap-free emulsification polymerization, such as polymethyl methacrylate particles, and polystyrene particles. The polymer particles are preferably those having a relatively narrow particle size distribution, and the polymer particles having the weight average particle diameter of 0.01 μm to 1 μm are preferably used.

<Magnetic Material>

The magnetic material is appropriately selected from those known in the art depending on the intended purpose without any limitation, and examples thereof include iron powder, magnetite, and ferrite. Among them, a white magnetic material is preferable in view of color tone.

[Properties of Toner]

In order to achieve both low temperature fixability and heat resistant storage stability of highly desirable level, and to achieve excellent hot offset resistance of the toner of the present invention, the toner satisfies: $45 \leq Ta \leq 70$, and $0.8 \leq Tb/Ta \leq 1.55$, where Ta (° C.) is the maximum peak temperature of heat of melting the toner measured by a differential scanning calorimeter, and Tb (° C.) is a softening point of the toner measured by an elevated flow tester. In addition, the toner preferably satisfies: $1.0\times10^3 \leq G'(Ta+20) \leq 5.0\times10^6$, and $1.0\times10^3 \leq G''(Ta+20) \leq 5.0\times10^6$, where G'(Ta+20) (Pa·s) is the storage elastic modulus of the toner at the temperature of (Ta+20)° C., and G"(Ta+20) (Pa·s) is the loss elastic modulus of the toner at the temperature of (Ta+20)° C.

The maximum peak temperature (Ta) of heat of melting the toner is appropriately selected depending on the intended purpose without any limitation, but it is preferably 45° C. to 70° C., more preferably 53° C. to 65° C., and even more preferably 58° C. to 62° C. When Ta is 45° C. to 70° C., the minimum heat resistant storage stability required for the toner can be secured, and the toner having low temperature fixability more excellent than that of the conventional toner can be attained. When Ta is lower than 45° C., the desirable low temperature fixability of the toner can be attained, but the heat resistant storage stability is insufficient. When Ta is higher than 70° C., the heat resistant storage stability is improved, but the low temperature fixability reduces.

The ratio (Tb/Ta) of the softening temperature (Tb) of the toner to the maximum peak temperature (Ta) of heat of melting the toner is appropriately selected depending on the intended purpose without any limitation, but it is preferably 0.8 to 1.55, more preferably 0.85 to 1.25, even more preferably 0.9 to 1.2, and particularly preferably 0.9 to 1.19. The toner has a property that the resin sharply softens as the value of Tb reduces, which is excellent in terms of both low temperature fixability and heat resistant storage stability.

As for the viscoelasticity of the toner, the storage elastic modulus G'(Ta+20) at the temperature of (Ta+20)° C. is preferably $1.0\times10^3$ Pa·s to $5.0\times10^6$ Pa·s in view of fixing strength and hot offset resistance, and more preferably $1.0\times10^4$ Pa·s to $5.0\times10^5$ Pa·s. Moreover, the loss elastic modulus G"(Ta+20) at the temperature of (Ta+20)° C. is preferably $1.0\times10^3$ Pa·s to $5.0\times10^6$ Pa·s in view of hot offset resistance, and more preferably $1.0\times10^4$ Pa·s to $5.0\times10^5$ Pa·s.

Further, the toner preferably satisfies: $0.05 \leq [G''(Ta+30)/G''(Ta+70)] \leq 50$, where G"(Ta+30) (Pa·s) is the loss elastic modulus of the toner at the temperature of (Ta+30)° C., and G"(Ta+70) (Pa·s) is the loss elastic modulus at the temperature of (Ta+70)° C. By designing the toner to fall into the aforementioned range, the change in the loss elastic modulus of the toner against the temperature becomes mild, so that the resulting toner has excellent hot offset resistance with maintaining low temperature fixability. The value of [G"(Ta+30)/G"(Ta+70)] is preferably 0.05 to 50, more preferably 0.1 to 40, and even more preferably 0.5 to 30.

The viscoelasticity of the toner can be appropriately controlled by adjusting a mixing ratio of the crystalline resin and non-crystalline resin constituting the binder resin, molecular weight of each resin, or formulation of the monomer mixture.

[Preparation Method of Toner]

The toner of the present invention contains at least the binder resin, and the colorant, where the binder resin contains the crystalline resin in an amount of 50% by weight or greater, and a preparation method and materials of the toner can be selected from any of methods and materials known in the art without any limitation, as long as the resulting toner satisfies the aforementioned conditions. Examples of the production method thereof include a kneading-pulverization method, and a method in which toner particles are granulated in an aqueous medium, so-called a chemical method. In the chemical method, it is possible to easily granulate particles of a crystalline resin. Accordingly, the chemical method is preferable.

Examples of the chemical method where toner particles are granulated in an aqueous medium include: a suspension polymerization method, emulsification polymerization method, seed polymerization method, and dispersion polymerization method, all of which use a monomer as a starting material; a dissolution suspension method in which a resin or resin precursor is dissolved in an organic solvent, and the resulting solution is dispersed and/or emulsified in an aqueous medium; a phase-transfer emulsification method in which water is added to a solution containing a resin or resin precursor, and an appropriate emulsifying agent to proceed phase transfer; and an aggregation method in which resin particles formed in any of the aforementioned methods is dispersed in an aqueous medium, and aggregated by heating and fusing to granulate particles of the predetermined size. Among them, the toner obtained by the dissolution suspension method is preferable because of granulation ability of the crystalline resin (e.g., easiness in control of particle size distribution, and control of particle shape).

These production methods will be specifically explained hereinafter.

The kneading-pulverization method is a method for producing toner base particles, for example, by melting and kneading a toner composition containing at least a colorant, a binder resin and a layered inorganic mineral, pulverizing the resulting kneaded product, and classifying the pulverized particles.

In the melting and kneading, materials of the toner composition are mixed, and the resulting mixture is placed in a melt-kneader to perform melting and kneading. As the melt-kneader, for example, a monoaxial or biaxial continuous kneader, or a batch-type kneader with a roll mill can be used. Preferable examples thereof include a twin screw extruder KTT manufactured by KOBE STEEL, LTD., an extruder TEM manufactured by TOSHIBA MACHINE CO., LTD., a twin screw extruder manufactured by ASADA WORKS CO., LTD., a twin screw extruder PCM manufactured by Ikegai Corp., and a cokneader manufactured by Buss. The melt-kneading is preferably performed under the appropriate conditions so as not to cause scission of molecular chains of the binder resin. Specifically, the temperature of the melt-kneading is adjusted under taking the softening point of the binder resin as consideration. When the temperature of the melt-kneading is very high compared to the softening point, the scission occurs significantly. When the temperature thereof is very low compared to the softening point, the dispersing may not be progressed.

In the pulverizing, the kneaded product obtained by the kneading is pulverized. In the pulverizing, it is preferred that the kneaded product be coarsely pulverized, followed by finely pulverized. For the pulverizing, a method in which the kneaded product is pulverized by making the kneaded product to crush into an impact plate in the jet stream, a method in which particles of the kneaded product are made crushed each other in the jet stream to thereby pulverize the kneaded product, or a method in which the kneaded product is pulverized in a narrow gap between a mechanically rotating rotor and a stator is preferably used.

The classifying is classifying the pulverized product obtained by the pulverizing into particles having the predetermined particle diameters. The classifying can be performed by removing the fine particles component by means of a cyclone, a decanter, a centrifugal separator, or the like.

After the completion of the pulverizing and the classifying, the classified pulverized product is classified in an air stream by centrifugal force or the like to thereby produce toner base particles having the predetermined particle diameters.

The chemical method is appropriately selected depending on the intended purpose without any limitation, but the preferable method thereof is a method for granulating toner base particles by dispersing and/or emulsifying a toner composition containing at least the binder resin, and the colorant. As for the toner of the present invention, a toner obtained by granulating toner particles by dispersing and/or emulsifying particles containing at least the binder resin, and the colorant in an aqueous medium is preferable.

As for the chemical method, the preferable method is a method in which an oil phase, which has been prepared by dissolving and/or dispersing in an organic solvent a toner composition containing at least the binder resin and/or the binder resin precursor, and the colorant, is dispersed and/or emulsified in an aqueous medium to granulate base particles of the toner.

Since the crystalline resin excels in impact resistance, it is not suitable for use in a pulverization method in terms of energy efficiency. On the other hand, particles can be easily granulated using the crystalline resin in the dissolution suspension method, or ester elongation method, and these methods are preferable.

The method for producing the resin particles containing at least the binder resin is appropriately selected depending on the intended purpose without any restriction, and examples thereof include the following (a) to (h):

(a) In the case of a vinyl resin particles, a method for directly produce an aqueous dispersion liquid of resin particles by a polymerization reaction of a suspension polymerization method, emulsification polymerization method, seed polymerization method, or dispersion polymerization method, using a monomer as a starting material.

(b) In the case of a polyaddition or condensation resin such as a polyester resin, polyurethane resin, and epoxy resin, a method for producing an aqueous dispersion liquid of resin particles by dispersing a precursor (e.g. a monomer, and oligomer) or a solvent solution thereof in an aqueous medium in the presence of an appropriate dispersant, followed by curing the particles by heating or adding a curing agent.

(c) In the case of a polyaddition or condensation resin such as a polyester resin, polyurethane resin, and epoxy resin, a method in which after dissolving an appropriate emulsifying agent in a precursor (e.g., a monomer and oligomer) or a solvent solution thereof (preferably in form of a liquid, which may be one liquefied by heating), water is added thereto to perform phase transfer emulsification.

(d) A method in which a resin that has been prepared by a polymerization reaction (which may be any polymerization reaction selected from addition polymerization, ring-opening polymerization, polyaddition, addition condensation, and condensation polymerization) in advance is pulverized by means of a pulverizer of mechanical ration system or jet system, followed by classification to obtain resin particles, and the resulting resin particles are dispersed in water in the presence of an appropriate dispersant.

(e) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, the resin solution is sprayed in form of mist to obtain resin particles, and the resulting resin particles are dispersed in water in the presence of an appropriate dispersant.

(f) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, resin particles are precipitated by adding a solvent to the resin solution or cooling the resin solution into which a solvent has been dissolved by heating, followed by removing the solvent to obtain resin particles, and the resulting resin particles are dispersed in water in the presence of an appropriate dispersant.

(g) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, the resulting resin solution is dispersed in an aqueous medium in the presence of an appropriate dispersant, and the solvent is removed therefrom by heating or reducing the pressure.

(h) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, an appropriate emulsifying agent is dissolved in the resulting resin solution, and water is added thereto to perform phase transfer emulsification.

For emulsifying and/or dispersing in an aqueous medium, a surfactant or a polymer protective colloid can be optionally used.

—Surfactant—

The surfactant is appropriately selected depending on the intended purpose without any limitation, and examples thereof include: anionic surfactants such as alkyl benzene sulfonic acid salts, α-olefin sulfonic acid salts and phosphoric acid esters; cationic surfactants, such as amine salts (e.g., alkyl amine salts, amino alcohol fatty acid derivatives, polyamine fatty acid derivatives and imidazoline), and quaternary ammonium salt (e.g., alkyltrimethylammonium salts, dialkyldimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine.

Also, a fluoroalkyl group-containing surfactant can exhibit its dispersing effects even in a small amount. Examples of the fluoroalkyl group-containing surfactant include a fluoroalkyl group-containing anionic surfactant, and a fluoroalkyl group-containing cationic surfactant.

Examples of the fluoroalkyl group-containing anionic surfactant include C2-C10 fluoroalkyl carboxylic acid or a metal salt thereof, disodium perfluorooctane sulfonyl glutamate, sodium 3-[ω-fluoroalkyl(C6-C11)oxy)-1-alkyl(C3-C4) sulfonate, sodium 3-[ω-fluoroalkanoyl(C6-C8)-N-ethylamino]-1-propanesulfonate, fluoroalkyl(C11-C20) carboxylic acid or a metal salt thereof, perfluoroalkylcarboxylic acid(C7-C13) or a metal salt thereof, perfluoroalkyl(C4-C12)sulfonate or a metal salt thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salt, a salt of perfluoroalkyl(C6-C10)-N-ethylsulfonylglycin and monoperfluoroalkyl(C6-C16) ethylphosphate.

Examples of the fluoroalkyl group-containing cationic surfactant include a fluoroalkyl group-containing aliphatic primary or secondary amine acid, aliphatic quaternary ammonium salt such as a perfluoroalkyl(C6 to C10)sulfonic amide propyltrimethyl ammonium salt, benzalkonium salt, benzetonium chloride, pyridinium salt and imidazolinium salt.

—Polymer Protective Colloid—

The polymer protective colloid is appropriately selected depending on the intended purpose without any limitation, and examples thereof include: acids such as acids such as acrylic acid, methacrylic acid, α-cyanoacrylic acid, α-cyanomethacrylic acid, itaconic acid, crotonic acid, fumaric acid, maleic acid and maleic anhydride; (meth)acryl monomer containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acryl amide, and N-methylol methacryl amide; vinyl alcohol or ethers with vinyl alcohol, such as vinyl methyl ether, vinyl ethyl ether, and vinyl propyl ether; ester of vinyl alcohol and a compound containing a carboxyl group, such as vinyl acetate, vinyl propionate, and vinyl butyrate; acryl amide, methacryl amide, diacetone acryl amide or methylol compounds of the preceding amides; acid chlorides, such as acrylic acid chloride, and methacrylic acid chloride; a homopolymer or copolymer containing a nitrogen atom or its heterocycle, such as vinyl pyridine, vinyl pyrrolidone, vinyl imidazole, and ethylene imine; polyoxyethylenes, such as polyoxy ethylene, polyoxypropylene, polyoxy ethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and celluloses such as methyl cellulose, hydroxyethyl cellulose, and hydroxypropyl cellulose.

—Organic Solvent—

As for the organic solvent used for dissolving or dispersing the toner composition containing the binder resin, binder resin precursor, colorant and an organic-modified layered inorganic mineral, a volatile organic solvent having a boiling point of lower than 100° C. is preferable because it can be easily removed in the later step.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methyl isobutyl ketone. These may be used alone, or in combination. Among them, the ester-based solvent such as methyl acetate, and ethyl acetate, the aromatic solvent such as toluene, and xylene, and the halogenated hydrocarbon such as methylene chloride, 1,2-dichloroethane, chloroform, and carbon tetrachloride are preferable.

The solid content of the oil phase, which is obtained by dissolving and/or dispersing the toner composition containing the binder resin or binder resin precursor, the colorant, and the organic-modified layered inorganic mineral is preferably from 40 to 80% by weight. The excessively high solid content thereof causes difficulties in dissolving or dispersing, and increases the viscosity of the oil phase which is difficult to handle. The excessively low solid content thereof leads to a low yield of the toner.

The toner composition excluding the resin, such as the colorant, and the organic-modified layered inorganic mineral, and master batches thereof may be separately dissolved and/or dispersed in an organic solvent, and then mixed with the resin solution and/or dispersion.

—Aqueous Medium—

As for the aqueous medium, water may be used solely, or water may be used in combination with water-miscible solvent. Examples of the water-miscible solvent include alcohol (e.g., methanol, isopropanol, and ethylene glycol), dimethyl formamide, tetrahydrofuran, cellosolves (e.g., methyl cellosolve), and lower ketones (e.g., acetone, and methyl ethyl ketone).

An amount of the aqueous medium used to 100 parts by weight of the toner composition is appropriately selected depending on the intended purpose without any limitation, but it is typically 50 parts by weight to 2,000 parts by weight, preferably 100 parts by weight to 1,000 parts by weight. When the amount of the water-miscible solvent is smaller than 50 parts by weight, the toner composition cannot be desirably dispersed, which enables to provide toner particles having the predetermined particle diameters. When the amount thereof is greater than 2,000 parts by weight, it is not economical.

Inorganic dispersant and/or organic resin particles may be dispersed in the aqueous medium in advance, which is preferable for giving a sharp particle distribution to the resulting toner, and giving dispersion stability.

Examples of the inorganic dispersant include tricalcium phosphate, calcium carbonate, titanium oxide, colloidal silica and hydroxyapatite.

As for the resin for forming the organic resin particles, any resin can be used as long as it is a resin capable of forming an aqueous dispersant, and the resin for forming the organic resin particles may be a thermoplastic resin or thermoset resin. Examples of the resin for forming the organic resin particles include a vinyl resin, a polyurethane resin, an epoxy resin, a polyester resin, a polyamide resin, a polyimide resin, a silicon resin, a phenol resin, a melamine resin, a urea resin, an aniline resin, an ionomer resin, and a polycarbonate resin.

These may be used alone, or in combination. Among them, a vinyl resin, a polyurethane resin, an epoxy resin, a polyester resin, and a combination of any of the preceding resins are preferable because an aqueous dispersion liquid of fine spherical resin particles can be easily obtained.

The method for emulsifying and/or dispersing in the aqueous medium is not particularly limited, and to which a conventional equipment, such as a low-speed shearing disperser, a high-speed shearing disperser, a friction disperser, a high-pressure jetting disperser and ultrasonic wave disperser, can be employed. Among them, the high-speed shearing disperser is preferable in view of miniaturizing size of particles. In use of the high-speed shearing disperser, the rotating speed is appropriately selected without any limitation, but it is typically from 1,000 to 30,000 rpm, preferably from 5,000 to 20,000 rpm. The temperature for dispersing is typically from 0 to 150° C. (in a pressurized state), and preferably from 20 to 80° C.

In the case where the toner composition contains the binder resin precursor, the compound containing an active hydrogen group, which is necessary for an elongation and/or crosslink reaction of the binder resin precursor, may be mixed in an oil phase before dispersing the toner composition in an aqueous medium, or mixed in the aqueous medium. In order to remove the organic solvent from the obtained emulsified dispersion liquid, a conventional method known in the art can be used, and for example, a method, in which the temperature of the entire system is gradually increased under normal pressure or reduced pressure, to completely evaporate and remove the organic solvent in the droplets, can be employed.

In the case where the aggregation method is used in the aqueous medium, the resin particle dispersion liquid, colorant dispersion liquid, and the organic-modified layered inorganic mineral dispersion liquid obtained in the aforementioned manner, and optionally a dispersion liquid of a releasing agent or the like are mixed and aggregated together to thereby granulate particles. The resin particle dispersion liquid may be solely used, or two or more resin particle dispersion liquids may be added. Further, the resin particle dispersion liquid may be added at once, or added stepwise by few times. This can also be said to the other dispersion liquids.

In order to control the aggregation state, a method such as heating, adding a metal salt, and adjusting pH can be preferably used.

The metal salt is appropriately selected depending on the intended purpose without any limitation, and examples thereof include: a monovalent metal salt including salts of sodium and potassium; a bivalent metal salt including salts of calcium and magnesium; and a trivalent metal salt including a salt of aluminum.

Examples of an anion for constituting the aforementioned salt include chloride ion, bromide ion, iodide ion, carbonic ion, and sulfuric ion. Among them, magnesium chloride, aluminum chloride, a complex or multimer thereof are preferable.

Heating during or after the aggregating accelerates fusion between resin particles, which is preferable in terms of homogeneity of the toner. Further, the shapes of the toner particles, i.e., the shape of the toner, can be controlled by the heating. Generally, the shapes of the toner particles become closer to spherical shapes as heating continues.

For washing and drying of the base particles of the toner dispersed in the aqueous medium, conventional techniques can be used.

Specifically, after the solid-liquid separation is performed by a centrifugal separator, or a filter press, the resulting toner cake is again dispersed in ion-exchanged water having the normal temperature to about 40° C., optionally adjusting the pH thereof with acid or alkali, followed by again subjected to solid-liquid separation. This series of operations are repeated a few times to remove impurities or the surfactant, followed by drying by means of a flash dryer, circulation dryer, vacuum dryer, or vibration flash dryer, to thereby obtain toner particles. The fine particle component may be removed from the toner by centrifugal separation or the like during the aforementioned operations, or it may be optionally classified to have the desirable particle size distribution by means of a conventional classifying device after the drying.

The resulting dry toner particles may be mixed with other particles such as releasing agent fine particles, and charge controlling agent fine particles, and also a mechanical impact may be applied to the mixture for immobilization or fusion of other particles on the toner surface, to thereby prevent the other particles from dropping off from the surfaces of the toner particles.

Specific examples of the method include a method in which an impact is applied to a mixture using a high-speed rotating blade, and a method in which an impact is applied by putting mixed particles into a high-speed air flow and accelerating the air speed such that the particles collide against one another or that the particles are crashed into a proper collision plate.

Examples of apparatuses used in these methods include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

(Developer)

The developer of the present invention contains the toner, and may further contain appropriately selected other components, such as carrier, if necessary.

The developer may be a one-component developer, or two-component developer, but is preferably a two-component developer for use in recent high-speed printers corresponded to the improved information processing speed, in view of a long service life.

In the case of the one-component developer using the toner, the diameters of the toner particles do not vary largely even when the toner is balanced, namely, the toner is supplied to the developer, and consumed by developing, the toner does not cause filming to a developing roller, nor fuse to a layer thickness regulating member such as a blade for thinning a thickness of a layer of the toner, and provides excellent and stable developing ability and image even when it is used (stirred) in the developing unit over a long period of time.

In the case of the two-component developer using the toner, the diameters of the toner particles in the developer do not vary largely even when the toner is balanced, and the toner can provide excellent and stabile developing ability even when the toner is stirred in the developing unit over a long period of time.

Namely, the developer of the present invention includes the resin carrier and a toner. The resin carrier prevents itself from adherence to produce high-quality images.

[Image Forming Method, Image Forming Apparatus and Process Cartridge]

The image forming method of the present invention preferably includes at least an electrostatic latent image forming process, a development process, a transfer process and a fixing process; more preferably a cleaning process; and optionally includes other processes such as a discharge process, a recycle process and a control process.

The image forming apparatus of the present invention preferably includes at least an electrostatic latent image bearer, an electrostatic latent image former, an image developer, a transferer and a fixer; more preferably a cleaner; and optionally includes other means such as a discharger, a recycler and a controller.

<Electrostatic Latent Image Forming Process and Electrostatic Latent Image Former>

The electrostatic latent image forming process is a process of forming an electrostatic latent image on the electrostatic latent image bearer (electrophotographic photoreceptor, photoreceptor or image bearer). The material, shape, structure, size, etc. thereof are not particularly limited, and can be selected from known electrostatic latent image bearers. However, the electrostatic latent image bearer preferably has the shape of a drum, and the material is preferably an inorganic material such as amorphous silicon and serene (inorganic photoreceptor), and an organic material such as polysilane and phthalopolymethine (organic photoreceptor). Particularly, the amorphous silicon photoreceptors are preferably used in terms of long lives.

An electrostatic latent image is formed by uniformly charging the surface of the electrostatic latent image bearer and irradiating imagewise light onto the surface thereof with the electrostatic latent image former. The electrostatic latent image former includes at least a charger uniformly charging the surface of the electrostatic latent image bearer and an irradiator irradiating imagewise light onto the surface thereof.

The charging is performed by applying a voltage to the surface of the electrostatic latent image bearer with a charger.

The charger is not particularly limited, and specific examples thereof include known contact chargers including electroconductive or semiconductive rollers, bushes, films, rubber blades, etc, and non-contact chargers using a corona discharge such as corotron and scorotron. The charger is preferably located in contact or not in contact with the electrostatic latent image bearer to charge the surface thereof upon application of a DC voltage and an AC voltage overlapped with each other. In addition, the charger is preferably a charging roller located close to the electrostatic latent image bearer not in contact therewith through a gap tape, to which a DC voltage overlapped with an AC voltage is applied to charge the surface of the electrostatic latent image bearer.

The surface of the electrostatic latent image bearer is irradiated with the imagewise light by the irradiator. The irradiator is not particularly limited, and can be selected in accordance with the purposes, provided that the irradiator can irradiate the surface of the electrostatic latent image bearer with the imagewise light, such as reprographic optical irradiators, rod lens array irradiators, laser optical irradiators and a liquid crystal shutter optical irradiators. In the present invention, a backside irradiation method irradiating the surface of the electrostatic latent image bearer through the backside thereof may be used.

<Development Process and Image Developer>

The development process is a process of forming a visual image by developing the electrostatic latent image with the toner or the developer of the present invention. The image developer is not particularly limited, and can be selected from known image developers, provided that the image developer can develop with the two-component developer of the present invention. For example, an image developer containing the two-component developer of the present invention and being capable of feeding the two-component developer to the electrostatic latent image in contactor not in contact therewith is preferably used.

The image developer may use a dry developing method or a wet developing method, and may develop a single color or a multiple colors. For example, the image developer preferably has a stirrer stirring the developer to be frictionally charged and a rotatable magnet roller.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visual image thereon.

<Transfer Process and Transferer>

The transfer process is a process of transferring the visual image onto a recording medium, and it is preferable that the visual image is firstly transferred onto an intermediate transferer and secondly transferred onto a recording medium thereby.

It is more preferable that two or more visual color images are firstly and sequentially transferred onto the intermediate transferer and the resultant complex full-color image is transferred onto the recording medium thereby. The visual image is transferred by the transferer using a transfer charger charging the electrostatic latent image bearer (photoreceptor).

The transferer preferably includes a first transferer transferring two or more visual color images onto an intermediate transferer and a second transferer transferring the resultant complex full-color image onto the recording medium. The intermediate transferer is not particularly limited, and can be selected from known transferers in accordance with the purposes, such as a transfer belt.

Each of the first and second transferers is preferably at least a transferer chargeable to separate the visual image from the electrostatic latent image bearer (photoreceptor) toward the recoding medium. The transferer may be one, or two or more. The transferer includes a corona transferer using a corona discharge, a transfer belt, a transfer roller, a pressure transfer roller, an adhesive roller, etc. The recording medium is not particularly limited, and can be selected from known recording media (paper).

<Fixing Process and Fixer>

The fixing process is a process of fixing the visual image transferred onto the recording medium with a transferer.

Each color toner may be fixed one by one or layered color toners may be fixed at the same time. The fixer is not particularly limited, can be selected in accordance with the purposes, and known heating and pressurizing means are preferably used. The heating and pressurizing means include a combination of a heating roller and a pressure roller, and a combination of a heating roller, a pressure roller and an endless belt, etc. The fixer of the present invention preferably includes a heater equipped with a heating element, a film contacting the heater and pressurizer contacting the heater through the film, wherein a recording material an unfixed image is formed on passes through between the film and pressurizer to fix the unfixed image upon application of heat. The heating temperature is preferably from 80 to 200° C., and the fixing linear speed is preferably 200 mm/sec or more. In the present invention, a known optical fixer may be used with or instead of the fixer in accordance with the purposes.

<Other Processes and Means>

(Discharge Process and Discharger)

The discharge process is a process of preferably discharging the electrostatic latent image bearer preferably with a discharger upon application of discharge bias. The discharger is not particularly limited, and can be selected from known dischargers, provided that the discharger can apply the discharge bias to the electrostatic latent image bearer, such as a discharge lamp.

(Cleaning Process and Cleaner)

The cleaning process is a process of preferably removing a toner remaining on the electrostatic latent image bearer with a cleaner. The cleaner is not particularly limited, and can be selected from known cleaners, provided that the cleaner can remove the toner remaining thereon, such as a magnetic brush cleaner, an electrostatic brush cleaner, a magnetic roller cleaner, a blade cleaner, a brush cleaner and web cleaner.

(Recycle Process and Recycler)

The recycle process is a process of preferably recycling a toner removed by the cleaner to the image developer with a recycler. The recycler is not particularly limited, and known transporters can be used.

(Control Process and Controller)

The control process is a process of preferably controlling the above-mentioned processes with a controller. The controller is not particularly limited, and can be selected in accordance with the purposes, provided the controller can control the above-mentioned means, such as a sequencer and a computer.

An embodiment of image forming apparatus using the image forming method of the present invention is explained, referring to FIG. 1.

In an image forming apparatus 100, around a photoreceptor drum (hereinafter referred to as a photoreceptor) as an image bearer 10, a charging roller as a charger 20, an irradiator 30, a cleaner having a cleaning blade 60, a discharge lamp as a discharger 70, image developers 45K, 45Y, 45M and 45C and a intermediate transferer 50 are arranged.

The intermediate transferer 50 is suspended by three suspension rollers 51 and endlessly driven by a driver such as motor (not shown) in a direction indicated by an arrow. Some of the suspension rollers 51 are combined with roles of transfer bias rollers feeding a transfer bias to the intermediate transferer and a predetermined transfer bias is applied thereto from an electric source (not shown). A cleaner having a cleaning blade 90 cleaning the intermediate transferer 50 is also arranged. A transfer roller 80 transferring a toner image onto a transfer paper 95 as a final transferer is arranged facing the intermediate transferer 50, to which a transfer bias is applied from an electric source (not shown). Around the intermediate transferer 50, a corona charger 52 is arranged as a charger between a contact point of the photoreceptor 10 and the intermediate transferer 50 and a contact point thereof and a transfer paper 95.

Around the photoreceptor 10, a black image developer 45K, a yellow image developer 45Y, a magenta image developer 45M and a cyan image developer 45C are located facing thereto. The black image developer 45K includes a developer container 42K, a developer feed roller 43K and a developing roller 44K. The yellow image developer 45Y includes a developer container 42Y, a developer feed roller 43Y and a developing roller 44Y. The magenta image developer 45M includes a developer container 42M, a developer feed roller 43M and a developing roller 44M. The cyan image developer 45C includes a developer container 42C, a developer feed roller 43C and a developing roller 44C.

In FIG. 1, after the photoreceptor 10 is uniformly charged rotating in a direction indicated by an arrow, the irradiator 30 irradiates the photoreceptor 10 with an original imagewise light from an optical system (not shown) to form an electrostatic latent image thereon. The electrostatic latent image is developed by the image developers 45K, 45Y, 45M and 45C to form each color toner image thereon. The toner image developed thereby 40 is transferred onto the surface of the intermediate transferer 50 (first transfer), and further transferred onto the transfer paper 95 (second transfer). On the other hand, the toner remaining on the photoreceptor 10 is removed by a cleaner 60, and the photoreceptor 10 is discharged by the discharge lamp 70 to be ready for the following charge.

Figure 2:
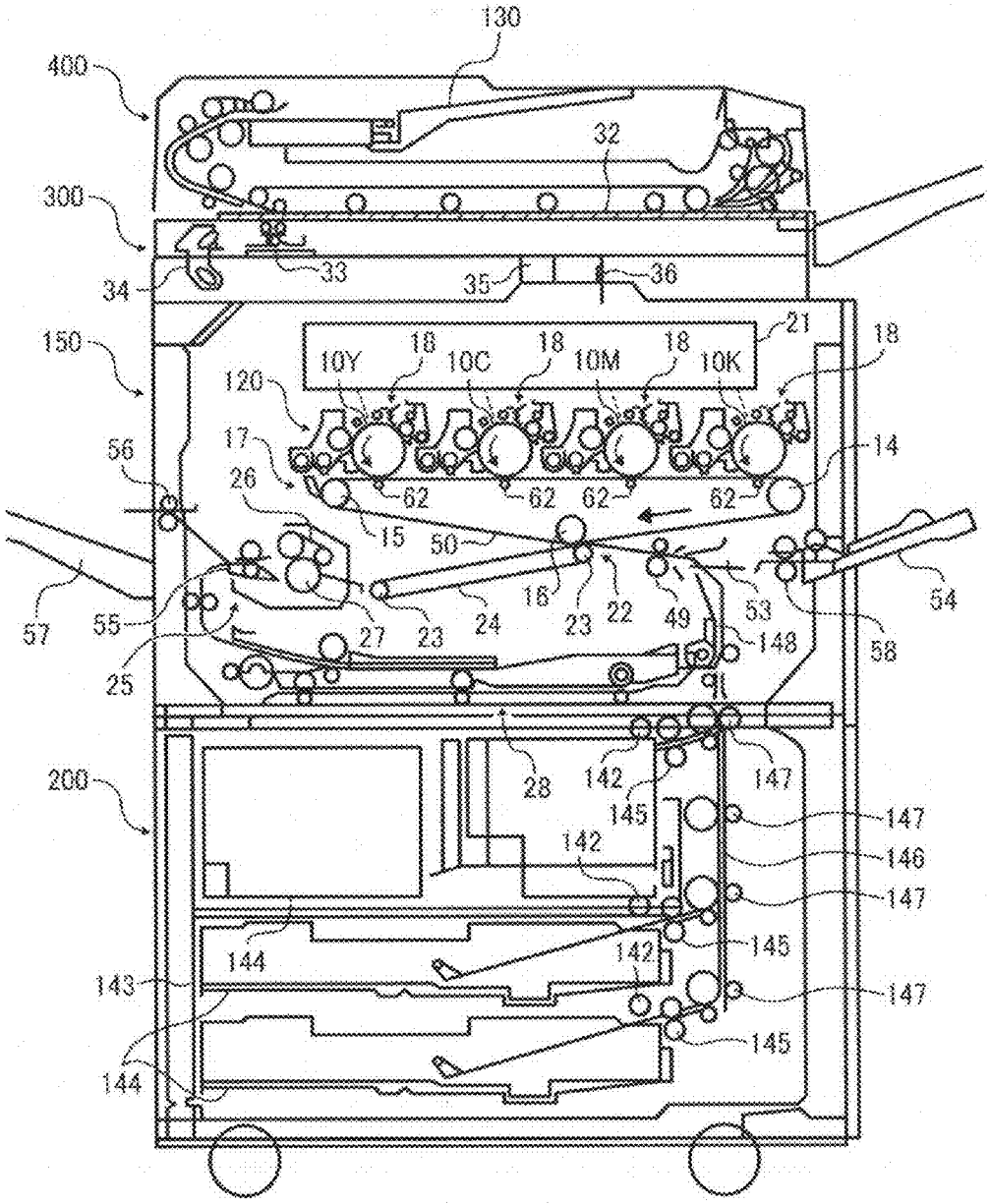
FIG. 2 is a schematic view illustrating an embodiment of tandem color image forming apparatus using the image forming method of the present invention.

Another embodiment of image forming apparatus using the image forming method of the present invention is explained, referring to FIG. 2.

The image forming apparatus therein is a tandem color image forming apparatus including a duplicator 150, a paper feeding table 200, a scanner 300 and an automatic document feeder (ADF) 400.

The duplicator 150 includes an intermediate transferer 50 having the shape of an endless belt. The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to a tandem image forming means 120. Adjacent to the tandem image forming means 120, an irradiator 21 is located.

On the opposite side of the tandem color image forming means 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located. The fixer 25 includes an endless belt 26 and a pressure roller 27 pressed against the belt. Below the second transferer 22 and the fixer 25, a sheet reverser 28 reversing the sheet to form an image on both sides thereof is located in the tandem image forming means 120.

Full-color image formation using the tandem image forming means 120 is explained. First, an original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

Figure 3:
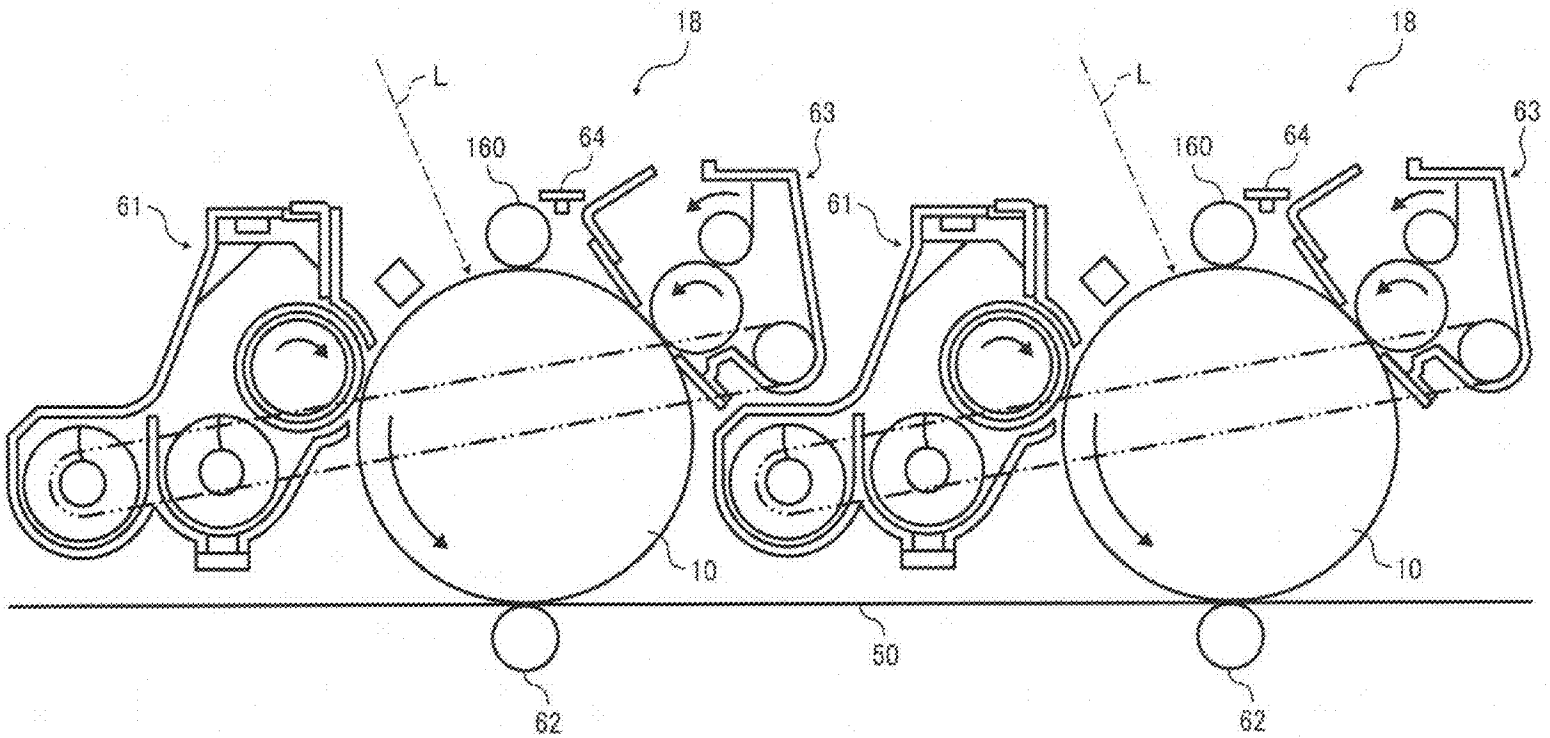
FIG. 3 is a partially amplified schematic view of the image forming apparatus in FIG. 2.

The black, yellow, magenta and cyan image information are transmitted to each image forming units 18, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 18 in the tandem image developer 120 includes, as shown in FIG. 3, a photoreceptor 10, i.e., a photoreceptor for black 10K, a photoreceptor for yellow 10Y, a photoreceptor for magenta 10M and a photoreceptor for cyan 10C; a charger 59 uniformly charging the photoreceptor; an irradiator irradiating the photoreceptor with imagewise light (L in FIG. 3) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 62 transferring the toner image onto an intermediate transferer 50; a photoreceptor cleaner 63; and a discharger 64. A black image (K), a yellow image (Y), a magenta image (M) and cyan image (C) formed on respective photoreceptors 10K, 10Y, 10M and 10C re sequentially transferred (first transfer) onto the intermediate transferer 50 rotated by the suspension rollers 14, 15 and 16 to form a full-color image thereon.

On the other hand, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a registration roller 49. Alternatively, a paper feeding roller 150 is rotated to take a sheet out of a manual feeding tray 51, and a separation roller 52 separates sheets one by one and feed the sheet into a paper feeding route 53 to be stopped against the registration roller 49. The registration roller 49 is typically earthed, and may be biased to remove a paper dust from the sheet. Then, in timing with a synthesized full-color image on the intermediate transferer 50, the registration roller 49 is rotated to feed the sheet between the intermediate transferer 50 and the second transferer 22, and the second transferer transfers (second transfer) the full-color image onto the sheet. The intermediate transferer 50 after transferring an image is cleaned by the intermediate transferer cleaner 17 to remove a residual toner thereon after the image is transferred.

The sheet the full-color image is transferred on is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

<Process Cartridge>

The process cartridge for use in the present invention includes at least an electrostatic latent image bearer and an image developer developing an electrostatic latent image borne thereon with a toner to form a visual image, which is detachable from image forming apparatus and further includes appropriately selected other means when necessary.

The image developer includes at least a developer container containing the developer of the present invention and a developer bearer bearing and transferring the developer in the developer container, and may further include a layer thickness regulator regulating a thickness of a toner layer borne on the developer bearer.

The process cartridge is preferably detachable from various electrophotographic image forming apparatuses.

Figure 4:
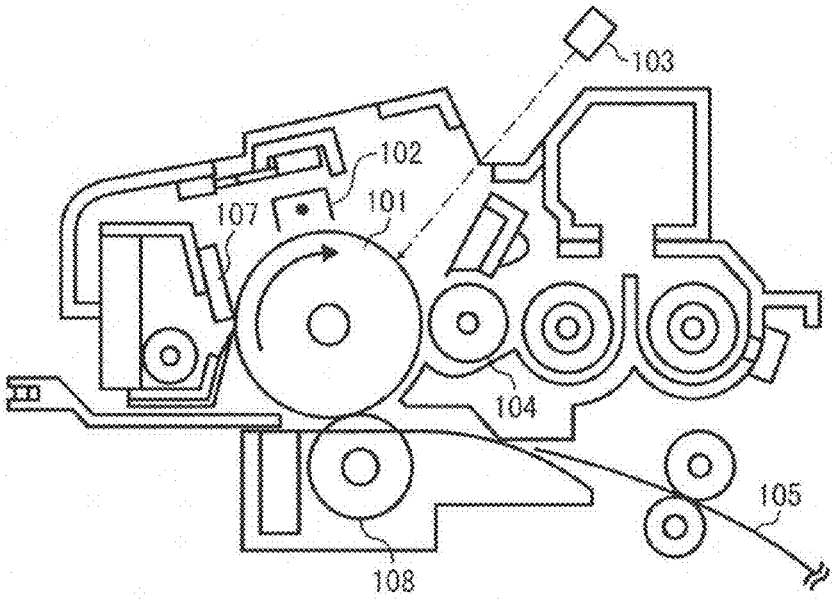
FIG. 4 is a schematic view illustrating an embodiment of the process cartridge of the present invention.

The process cartridge is, for example as illustrated in FIG. 4, equipped therein with an electrostatic latent image bearer 101, and includes a charger 102, an image developer 104, a transferer 108 and a cleaner 107, and further includes other means when necessary. In FIG. 4, 103 represents irradiation by an irradiator and 105 represents a recording medium.

The image forming process in the process cartridge illustrated in FIG. 4 is explained next. While rotating the electrostatic latent image bearer 101 in the direction indicated by an arrow, an electrostatic latent image relevant to imagewise light is formed on the surface of the electrostatic latent image bearer 101 as a result of charging by the charger 102 and the irradiation 103 by the irradiator (not illustrated). The electrostatic latent image is developed with a toner by the image developer 104 to form a toner image, and the developed toner image is transferred onto a recording medium 105 by the transferer 108, followed by output as a print. Next, the surface of the electrostatic image bearer after the transferring is cleaned by the cleaner 107, discharged by a discharger (not illustrated), and again returned to the aforementioned operation.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Preparation of Binder Resin

Binder Resin Preparation Example 1

Preparation of Crystalline Resin A1

A reaction tank equipped with a condenser, a stirrer, and a nitrogen inlet tube was charged with 241 parts by weight of sebacic acid, 31 parts by weight of adipic acid, 164 parts by weight of 1,4-butanediol, and as a condensation catalyst, 0.75 parts by weight of titanium dihydroxybis(triethanolaminate), and the resulting mixture was allowed to react for 8 hours at 180° C. under nitrogen gas stream, with removing the generated water. The mixture was then gradually heated to 225° C., and was allowed to react for 4 hours under nitrogen gas stream, with removing the generated water as well as 1,4-butanediol. The resultant was further reacted under the reduced pressure of 5 mmHg to 20 mmHg until Mw of the resultant reached about 18,000, to thereby obtain Crystalline Resin A1 (crystalline polyester resin) having a melting point of 58° C.

Binder Resin Preparation Example 2

Preparation of Crystalline Resin A2

A reaction tank equipped with a condenser, a stirrer, and a nitrogen inlet tube was charged with 283 parts by weight of sebacic acid, 215 parts by weight of 1,6-hexanediol, and as a condensation catalyst, 1 part by weight of titanium dihydroxybis(triethanolaminate), and the resulting mixture was allowed to react for 8 hours at 180° C. under nitrogen gas stream, with removing the generated water. The mixture was then gradually heated to 220° C., and was allowed to react for 4 hours under nitrogen gas stream, with removing the generated water as well as 1,6-hexanediol. The resultant was further reacted under the reduced pressure of 5 mmHg to 20 mmHg until Mw of the resultant reached about 17,000, to thereby obtain Crystalline Resin A2 (crystalline polyester resin) having a melting point of 63° C.

Binder Resin Preparation Example 3

Preparation of Crystalline Resin A3

A reaction tank equipped with a condenser, a stirrer, and a nitrogen inlet tube was charged with 322 parts by weight of dodecanedioic acid, 215 parts by weight of 1,6-hexanediol, and as a condensation catalyst, 1 part by weight of titanium dihydroxybis(triethanolaminate), and the resulting mixture was allowed to react for 8 hours at 180° C. under nitrogen gas stream, with removing the generated water. The mixture was then gradually heated to 220° C., and was allowed to react for 4 hours under nitrogen gas stream, with removing the generated water as well as 1,6-hexanediol. The resultant was further reacted under the reduced pressure of 5 mmHg to 20 mmHg until Mw of the resultant reached about 16,000, to thereby obtain Crystalline Resin A3 (crystalline polyester resin) having a melting point of 66° C.

Binder Resin Preparation Example 4

Preparation of Crystalline Resin A4

A reaction tank equipped with a condenser, a stirrer, and a nitrogen inlet tube was charged with 530 parts by weight of ϵ-caprolactone, 2 parts by weight of 1,4-butanediol, and as a catalyst, 2 parts by weight of dibutyl tin oxide, and the resulting mixture was allowed to react for 10 hours at 150° C. under nitrogen gas stream, to thereby obtain Crystalline Resin A4 (crystalline polyester resin) having Mw of about 10,000 and a melting point of 60° C.

Binder Resin Preparation Example 5

Preparation of Crystalline Resin A5

A reaction tank equipped with a condenser, a stirrer, and a nitrogen inlet tube was charged with 142 parts by weight of sebacic acid, 136 parts by weight of dimethyl terephthalate, 215 parts by weight of 1,6-hexanediol, and as a condensation catalyst, 1 part by weight of titanium dihydroxybis(triethanolaminate), and the resulting mixture was allowed to react for 8 hours at 180° C. under nitrogen gas stream, with removing the generated water. The mixture was then gradually heated to 220° C., and was allowed to react for 4 hours under nitrogen gas stream, with removing the generated water as well as 1,6-hexanediol. The resultant was further reacted under the reduced pressure of 5 mmHg to 20 mmHg until Mw of the resultant reached about 10,000, to thereby obtain Crystalline Resin A5 (crystalline polyester resin) having a melting point of 52° C.

Binder Resin Preparation Example 6

Preparation of Crystalline Resin A6

A reaction tank equipped with a condenser, a stirrer, and a nitrogen inlet tube was charged with 126 parts by weight of 1,4-butanediol, 215 parts by weight of 1,6-hexanediol, and 100 parts by weight of methyl ethyl ketone (MEK), followed by stirring. To the resultant, 341 parts by weight of hexamethylene diisocyanate (HDI) was added, and the resulting mixture was allowed to react for 8 hours at 80° C. under nitrogen gas stream. Subsequently, MEK was removed by evaporation under the reduced pressure, to thereby obtain Crystalline Resin A6 (crystalline polyurethane resin) having Mw of about 18,000, and a melting point of 59° C.

Binder Resin Preparation Example 7

Preparation of Crystalline Resin A7

A reaction tank equipped with a condenser, a stirrer, and a nitrogen inlet tube was charged with 241 parts by weight of sebacic acid, 31 parts by weight of adipic acid, 164 parts by weight of 1,4-butanediol, and as a condensation catalyst, 0.75 parts by weight of titanium dihydroxybis(triethanolaminate), and the resulting mixture was allowed to react for 8 hours at 180° C. under nitrogen gas stream, with removing the generated water. The mixture was then gradually heated to 225° C., and was allowed to react for 4 hours under nitrogen gas stream, with removing the generated water as well as 1,4-butanediol. The resultant was further reacted under the reduced pressure of 5 mmHg to 20 mmHg until Mw of the resultant reached about 6,000.

The resulting crystalline resin (218 parts by weight) was placed in a reaction tank equipped with a condenser, a stirrer, and a nitrogen inlet tube. To this, 250 parts by weight of ethyl acetate, and 8.6 parts by weight of hexamethylene diisocyanate (HDI) were added, and the resulting mixture was allowed to react for 5 hours at 80° C. under nitrogen gas stream. Subsequently, the ethyl acetate was removed by evaporation under the reduced pressure, to thereby obtain Crystalline Resin A7 (crystalline polyurethane resin) having Mw of about 22,000, and a melting point of 60° C.

Binder Resin Preparation Example 8

Preparation of Crystalline Resin A8

A reaction tank equipped with a condenser, a stirrer, and a nitrogen inlet tube was charged with 283 parts by weight of sebacic acid, 215 parts by weight of 1,6-hexanediol, and as a condensation catalyst, 1 part by weight of titanium dihydroxybis(triethanolaminate), and the resulting mixture was allowed to react for 8 hours at 180° C. under nitrogen gas stream, with removing the generated water. The mixture was then gradually heated to 220° C., and was allowed to react for 4 hours under nitrogen gas stream, with removing the generated water as well as 1,6-hexanediol. The resultant was further reacted under the reduced pressure of 5 mmHg to 20 mmHg until Mw of the resultant reached about 6,000.

The resulting crystalline resin (249 parts by weight) was placed in a reaction tank equipped with a condenser, a stirrer, and a nitrogen inlet tube. To this, 250 parts by weight of ethyl acetate, and 9 parts by weight of hexamethylene diisocyanate (HDI) were added, and the resulting mixture was allowed to react for 5 hours at 80° C. under nitrogen gas stream. Subsequently, the ethyl acetate was removed by evaporation under the reduced pressure, to thereby obtain Crystalline Resin A8 (crystalline polyurethane resin) having Mw of about 20,000, and a melting point of 65° C.

Binder Resin Preparation Example 9

Preparation of Crystalline Resin A9

A reaction tank equipped with a condenser, a stirrer, and a nitrogen inlet tube was charged with 322 parts by weight of dodecanedioic acid, 215 parts by weight of 1,6-hexanediol, and as a condensation catalyst, 1 part by weight of titanium dihydroxybis(triethanolaminate), and the resulting mixture was allowed to react for 8 hours at 180° C. under nitrogen gas stream, with removing the generated water. The mixture was then gradually heated to 220° C., and was allowed to react for 4 hours under nitrogen gas stream, with removing the generated water as well as 1,6-hexanediol. The resultant was further reacted under the reduced pressure of 5 mmHg to 20 mmHg until Mw of the resultant reached 6,000.

The resulting crystalline resin (269 parts by weight) was placed in a reaction tank equipped with a condenser, a stirrer, and a nitrogen inlet tube. To this, 280 parts by weight of ethyl acetate, and 10.4 parts by weight of tolylene diisocyanate (TDI) were added, and the resulting mixture was allowed to react for 5 hours at 80° C. under nitrogen gas stream. Subsequently, the ethyl acetate was removed by evaporation under the reduced pressure, to thereby obtain Crystalline Resin A9 (crystalline polyurethane resin) having Mw of about 18,000, and a melting point of 68° C.

Binder Resin Preparation Example 10

Preparation of Crystalline Resin A10

A 1 L autoclave was charged with 180 parts by weight of 1,2-propylene oxide, and 30 parts by weight of potassium hydroxide, and the resulting mixture was stirred for 48 hours at room temperature to proceed to polymerization. The obtained polymer was heated to 70° C. to melt the polymer, and to the melted polymer, 100 parts by weight of toluene and 100 parts by weight of water were added to perform partitioning. The operation of the partitioning was performed 3 times. The obtained toluene phase was neutralized with a 0.1 mol/L hydrochloric acid, and to this, 100 parts by weight of water was further added to perform partitioning. The operation of the partitioning was performed 3 times. The toluene was then removed from the resulting toluene phase by evaporation, to thereby obtain Crystalline Resin A10 (crystalline polyether resin) having Mw of about 12,000, melting point of 55° C., and isotacticity of 99%.

Binder Resin Preparation Example 11

Preparation of Crystalline Resin A11

A reaction tank equipped with a condenser, a stirrer, a dripping funnel and a nitrogen inlet tube was charged with 500 parts by weight of toluene. Separately to this, a glass beaker was charged with 350 parts by weight of toluene, 120 parts by weight of behenyl acrylate, 20 parts by weight of 2-ethylhexyl acrylate, 10 parts by weight of methacrylic acid, and 7.5 parts by weight of azobisisobutyronitrile (AIBN), and the resulting mixture was stirred and mixed at 20° C. to thereby prepare a monomer solution. The resulting monomer solution was poured into the dripping funnel.

After a vapor phase in the reaction tank was replaced with nitrogen gas, the monomer solution was added dropwise over the period of 2 hours at 80° C. in the sealed condition. After the completion of the dripping, the resultant was aged for 2 hours at 85° C., followed by removing the toluene therefrom for 3 hours at 130° C. under the reduced pressure, to thereby obtain Crystalline Resin A11 (crystalline vinyl resin) having Mw of about 87,000, and a melting point of 56° C.

Binder Resin Preparation Example 12

Preparation of Crystalline Resin A12

A reaction tank equipped with a condenser, a stirrer, and a nitrogen inlet tube was charged with 123 parts by weight of 1,4-butanediamine, 211 parts by weight of 1,6-hexanediamine, and 100 parts by weight of methyl ethyl ketone (MEK), and the resulting mixture was stirred. To this, 341 parts by weight of hexamethylene diisocyanate (HDI) was added, and the resulting mixture was allowed to react for 5 hours at 60° C. under nitrogen gas stream. Subsequently, MEK was removed from the reaction mixture by evaporation under the reduced pressure, to thereby obtain Crystalline Resin A12 (crystalline polyurea resin) having Mw of about 22,000, and a melting point of 63° C.

Binder Resin Preparation Example 13

Preparation of Crystalline Resin A13

A reaction tank equipped with a condenser, a stirrer, and a nitrogen inlet tube was charged with 283 parts by weight of sebacic acid, 215 parts by weight of 1,6-hexanediol, and as a condensation catalyst, 1 part by weight of titanium dihydroxybis(triethanolaminate), and the resulting mixture was allowed to react for 8 hours at 180° C. under nitrogen gas stream, with removing the generated water. The mixture was then gradually heated to 220° C., and was allowed to react for 4 hours under nitrogen gas stream, with removing the generated water as well as 1,6-hexanediol. The resultant was further reacted under the reduced pressure of 5 mmHg to 20 mmHg until Mw of the resultant reached about 6,000, to thereby obtain Crystalline Resin A13 (crystalline polyester resin) having a melting point of 44° C.

Binder Resin Preparation Example 14

Preparation of Crystalline Resin Precursor B1

A reaction tank equipped with a condenser, a stirrer, and a nitrogen inlet tube was charged with 28 parts by weight of hexamethylene diisocyanate (HDI), and 28 parts by weight of ethyl acetate. To the resulting mixture, a resin solution in which 249 parts by weight of Crystalline Resin A8 had been dissolved in 249 parts by weight of ethyl acetate was added, and the resulting mixture was allowed to react for 5 hours at 80° C. under nitrogen gas stream, to thereby a 50% by weight Crystalline Resin Precursor B1 having a terminal isocyanate group (modified polyester resin) ethyl acetate solution.

Binder Resin Preparation Example 15

Preparation of Non-Crystalline Resin C1

A reaction tank equipped with a condenser, a stirrer, and a nitrogen inlet tube was charged with 240 parts by weight of 1,2-propanediol, 226 parts by weight of terephthalic acid, and as a condensation catalyst 0.64 parts by weight of tetrabutoxy titanate, and the resulting mixture was allowed to react for 8 hours at 180° C. under nitrogen gas stream, with removing the generated methanol. Subsequently, the resultant was gradually heated to 230° C., and was allowed to react for 4 hours under nitrogen gas stream with removing the generated water and 1,2-propanediol, followed by reacted for 1 hour under the reduced pressure of 5 mmHg to 20 mmHg. The resulting reaction mixture was cooled to 180° C., and to this, 8 parts by weight of trimellitic anhydride, and 0.5 parts by weight of tetrabutoxy titanate were added, and the resulting mixture was allowed to react for 1 hour. The resultant was further reacted under the reduced pressure of 5 mmHg to 20 mmHg until Mw of the resultant reached about 7,000, to thereby obtain Non-Crystalline Resin C1 (non-crystalline polyester resin) having a melting point of 61° C.

Binder Resin Preparation Example 16

Preparation of Non-Crystalline Resin C2

A reaction tank equipped with a condenser, a stirrer, and a nitrogen inlet tube was charged with 215 parts by weight of bisphenol A propylene oxide 2 mol adduct, 132 parts by weight of bisphenol A ethylene oxide 2 mol adduct, 126 parts by weight of terephthalic acid, and as a condensation catalyst, 1.8 parts by weight of tetrabutoxy titanate, and the resulting mixture was allowed to react for 6 hours at 230° C. under nitrogen gas stream with removing the generated water. Subsequently, the reactant was allowed to react for 1 hour under the reduced pressure of 5 mmHg to 20 mmHg, followed by cooling to 180° C. To this, 8 parts by weight of trimellitic anhydride was added, and the resulting mixture was allowed to react under the reduced pressure of 5 mmHg to 20 mmHg until Mw of the resultant reached about 10,000, to thereby obtain Non-Crystalline Resin C2 (non-crystalline polyester resin) having a melting point of 60° C.

TABLE 1

| Binder Resin | | Resin | Glass transition temperature Tg (° C.) | Melting point (° C.) | Softening point Tb (° C.) | Tb/Ta (° C.) | Weight-average molecular weight Mw |
|---|---|---|---|---|---|---|---|
| Crystalline Resin | A1 | Polyester | — | 58 | 56 | 0.97 | 18,000 |
| | A2 | Polyester | — | 63 | 63 | 1.00 | 17,000 |
| | A3 | Polyester | — | 66 | 79 | 1.20 | 16,000 |
| | A4 | Polyester | — | 60 | 69 | 1.15 | 10,000 |
| | A5 | Polyester | — | 52 | 58 | 1.12 | 10,000 |
| | A6 | Polyurethane | — | 59 | 69 | 1.17 | 18,000 |
| | A7 | Polyurethane | — | 60 | 61 | 1.02 | 22,000 |
| | A8 | Polyurethane | — | 65 | 75 | 1.15 | 20,000 |
| | A9 | Polyurethane | — | 68 | 81 | 1.19 | 18,000 |
| | A10 | Polyether | — | 55 | 53 | 0.96 | 12,000 |
| | A11 | Polyvinyl | — | 56 | 65 | 1.16 | 87,000 |
| | A12 | Polyurea | — | 63 | 65 | 1.03 | 22,000 |
| | A13 | Polyester | — | 42 | 41 | 0.98 | 6,000 |
| Crystalline Resin precursor | B1 | Modified polyester | | 65 | 76 | 1.17 | 20,000 |
| Non-crystalline Resin | C1 | Polyester | 55 | 61 | 137 | 2.25 | 7,600 |
| | C2 | Polyester | 53 | 60 | 144 | 2.40 | 10,000 |

Colorant Master Batch Preparation Example 1

Preparation of Colorant Master Batch P1

Crystalline Resin A 1 (100 parts by weight), a cyan pigment (C.I. Pigment Blue 15:3) (100 parts by weight), and ion-exchanged water (30 parts by weight) were sufficiently mixed, and kneaded by means of an open-roll kneader (KNEADEX from Mitsui Mining Co., Ltd.). As for the kneading temperature, the kneading was initiated at 90° C., followed by gradually cooling to 50° C. In the manner as described, Colorant Master Batch P1, in which a ratio (weight ratio) of the resin and the pigment was 1:1, was prepared.

Colorant Master Batch Preparation Example 2

Preparation of Colorant Master Batch P2

The procedure for preparation of Colorant Master Batch P1 was repeated to prepare Colorant Master Batch P2 except for replacing Crystalline Resin A1 with Crystalline Resin A2.

Colorant Master Batch Preparation Example 3

Preparation of Colorant Master Batch P3

The procedure for preparation of Colorant Master Batch P1 was repeated to prepare Colorant Master Batch P3 except for replacing Crystalline Resin A1 with Crystalline Resin A3.

Colorant Master Batch Preparation Example 4

Preparation of Colorant Master Batch P4

The procedure for preparation of Colorant Master Batch P1 was repeated to prepare Colorant Master Batch P4 except for replacing Crystalline Resin A1 with Crystalline Resin A4.

Colorant Master Batch Preparation Example 5

Preparation of Colorant Master Batch P5

The procedure for preparation of Colorant Master Batch P1 was repeated to prepare Colorant Master Batch P5 except for replacing Crystalline Resin A1 with Crystalline Resin A5.

Colorant Master Batch Preparation Example 6

Preparation of Colorant Master Batch P6

The procedure for preparation of Colorant Master Batch P1 was repeated to prepare Colorant Master Batch P6 except for replacing Crystalline Resin A1 with Crystalline Resin A6.

Colorant Master Batch Preparation Example 7

Preparation of Colorant Master Batch P7

The procedure for preparation of Colorant Master Batch P1 was repeated to prepare Colorant Master Batch P7 except for replacing Crystalline Resin A1 with Crystalline Resin A7.

Colorant Master Batch Preparation Example 8

Preparation of Colorant Master Batch P8

The procedure for preparation of Colorant Master Batch P1 was repeated to prepare Colorant Master Batch P8 except for replacing Crystalline Resin A1 with Crystalline Resin A8.

Colorant Master Batch Preparation Example 9

Preparation of Colorant Master Batch P9

The procedure for preparation of Colorant Master Batch P1 was repeated to prepare Colorant Master Batch P9 except for replacing Crystalline Resin A1 with Crystalline Resin A9.

Colorant Master Batch Preparation Example 10

Preparation of Colorant Master Batch P10

The procedure for preparation of Colorant Master Batch P1 was repeated to prepare Colorant Master Batch P10 except for replacing Crystalline Resin A1 with Crystalline Resin A10.

Colorant Master Batch Preparation Example 11

Preparation of Colorant Master Batch P11

The procedure for preparation of Colorant Master Batch P1 was repeated to prepare Colorant Master Batch P11 except for replacing Crystalline Resin A1 with Crystalline Resin A11.

Colorant Master Batch Preparation Example 12

Preparation of Colorant Master Batch P12

The procedure for preparation of Colorant Master Batch P1 was repeated to prepare Colorant Master Batch P12 except for replacing Crystalline Resin A1 with Crystalline Resin A12.

Colorant Master Batch Preparation Example 13

Preparation of Colorant Master Batch P13

The procedure for preparation of Colorant Master Batch P1 was repeated to prepare Colorant Master Batch P13 except for replacing Crystalline Resin A1 with Crystalline Resin A13.

[Preparation of Wax Dispersion]

A reaction vessel equipped with a condenser, a thermometer, and a stirrer was charged with 20 parts by weight of paraffin wax (HNP-9 (melting point: 75° C.), manufactured by NIPPON SEIRO CO., LTD.), and 80 parts by weight of ethyl acetate, and the resulting mixture was heated to 78° C. to sufficiently dissolve the wax in the ethyl acetate, followed by cooling to 30° C. over the period of 1 hour with stirring. The resultant was then subjected to wet pulverization by means of ULTRA VISCOMILL (of AIMEX CO., Ltd.) under the following conditions: a liquid feed rate of 1.0 Kg/hr, disc circumferential velocity of 10 m/s, 0.5 mm-zirconia beads packed to 80% by volume, and 6 passes, to thereby obtain Wax Dispersion.

Toner Preparation Example 1

Preparation of Toner 1

A container equipped with a thermometer and a stirrer was charged with 37 parts by weight of Crystalline Resin A1, and 37 parts by weight of ethyl acetate, and the resulting mixture was heated to the temperature equal to or higher than the melting point of the resin to sufficiently dissolve Crystalline Resin A1. To this, 88 parts by weight of a 50% by weight Non-Crystalline Resin C1 ethyl acetate solution, 30 parts by weight of Wax Dispersion Liquid, 12 parts by weight of Colorant Master Batch P1, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 1. Note that, the temperature of Oil Phase 1 was kept at 50° C. in the container, and Oil Phase 1 was used within 5 hours from the production so as not to crystallize the contents.

Next, a separate container equipped with a stirrer and a thermometer was charged with 90 parts by weight of ion-exchanged water, 3 parts by weight of a 5% by weight polyoxyethylene lauryl ether nonionic surfactant (NL450, manufactured by Dai-ichi Kogyo Seiyaku Co., Ltd.) aqueous solution, and 10 parts by weight of ethyl acetate, and the resulting mixture was mixed and stirred at 40° C. to thereby produce an aqueous phase solution. The resulting aqueous phase solution was added to 50 parts by weight of Oil Phase 1 the temperature of which had been kept at 50° C., and the resulting mixture was mixed for 1 minute by means of TK Homomixer (of Tokushu Kika Kogyo Co., Ltd.) at 40° C. to 50° C. and at 13,000 rpm, to thereby obtain Emulsified Slurry 1.

A container equipped with a stirrer and a thermometer was charged with Emulsified Slurry 1, and the solvent was removed from Emulsified Slurry 1 over the period of 6 hours at 60° C., to thereby obtain Slurry 1.

The obtained toner base particles in Slurry 1 (100 parts by weight) were subjected to filtration under the reduced pressure, followed by subjected to the following washing procedure.

(1): ion-exchanged water (100 parts) was added to the filtration cake, followed by mixing with TK Homomixer (at 6,000 rpm for 5 minutes) and then filtration;

(2): a 10% by weight aqueous sodium hydroxide solution (100 parts by weight) was added to the filtration cake obtained in (1), followed by subjected to mixing with TK Homomixer (at 6,000 rpm for 10 minutes) and then filtration under reduced pressure;

(3): a 10% by weight hydrochloric acid (100 parts by weight) was added to the filtration cake obtained in (2), followed by subjected to mixing with TK Homomixer (at 6,000 rpm for 5 minutes) and then filtration; and (4): ion-exchanged water (300 parts) was added to the filtration cake obtained in (3), followed by mixing with TK Homomixer (at 6,000 rpm for 5 minutes) and then filtration. This operation was performed twice, to thereby obtain Filtration Cake 1.

Filtration Cake 1 was dried by means of an air-circulating drier for 48 hours at 45° C., followed by passed through a sieve with a mesh size of 75 μm, to thereby produce Toner Base Particles 1.

Next, Toner Base Particles 1 (100 parts by weight) were mixed with hydrophobic silica (HDK-2000, manufactured by Wacker Chemie AG) (1.0 part by weight) by means of HENSCHEL MIXER, to thereby obtain Toner 1 having the volume average particle diameter of 5.8 μm.

Toner 1 was evaluated in the manner described below. The results are presented in Tables 2 and 3. Further, binder resin and the amount thereof in Toner Preparation Example 1, as well as the below-described Toner Preparation Examples 2 to 20 and Comparative Examples 1 to 6, are presented in Table 2.

Toner Preparation Example 2

Preparation of Toner 2

A container equipped with a thermometer and a stirrer was charged with 81 parts by weight of Crystalline Resin A1, and 81 parts by weight of ethyl acetate, and the resulting mixture was heated to the temperature equal to or higher than the melting point of the resin to sufficiently dissolve Crystalline Resin A1. To this, 30 parts by weight of Wax Dispersion Liquid, 12 parts by weight of Colorant Master Batch P1, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 2.

The procedure for preparation of Toner 1 in Toner Preparation Example 1 was repeated to prepare a Toner 2 except for replacing Oil phase 1 with Oil Phase 2. Properties of the toners were measured and the results are shown in Tables 2 and 3.

Toner Preparation Example 3

Preparation of Toner 3

The procedure for preparation of Toner 1 in Toner Preparation Example 1 was repeated to prepare a Toner 3 except for replacing Crystalline Resin A1 with Crystalline Resin A2, and Colorant Master Batch P1 with Colorant Master Batch P2, respectively. Properties of the toners were measured and the results are shown in Tables 2 and 3.

Toner Preparation Example 4

Preparation of Toner 4

The procedure for preparation of Toner 1 in Toner Preparation Example 1 was repeated to prepare a Toner 4 except for replacing Crystalline Resin A1 with Crystalline Resin A3, and Colorant Master Batch P1 with Colorant Master Batch P3, respectively. Properties of the toners were measured and the results are shown in Tables 2 and 3.

Toner Preparation Example 5

Preparation of Toner 5

The procedure for preparation of Toner 1 in Toner Preparation Example 1 was repeated to prepare a Toner 5 except for replacing Crystalline Resin A1 with Crystalline Resin A4, and Colorant Master Batch P1 with Colorant Master Batch P4, respectively. Properties of the toners were measured and the results are shown in Tables 2 and 3.

Toner Preparation Example 6

Preparation of Toner 6

The procedure for preparation of Toner 1 in Toner Preparation Example 1 was repeated to prepare a Toner 6 except for replacing Crystalline Resin A1 with Crystalline Resin A5, and Colorant Master Batch P1 with Colorant Master Batch P5, respectively. Properties of the toners were measured and the results are shown in Tables 2 and 3.

Toner Preparation Example 7

Preparation of Toner 7

A container equipped with a thermometer and a stirrer was charged with 37 parts by weight of Crystalline Resin A1, and 37 parts by weight of ethyl acetate, and the resulting mixture was heated to the temperature equal to or higher than the melting point of the resin to sufficiently dissolve Crystalline Resin A1. To this, 88 parts by weight of a 50% by weight Non-Crystalline Resin C2 ethyl acetate solution, 30 parts by weight of Wax Dispersion Liquid, 12 parts by weight of Colorant Master Batch P1, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 7.

The procedure for preparation of Toner 1 in Toner Preparation Example 1 was repeated to prepare a Toner 7 except for replacing Oil phase 1 with Oil Phase 7. Properties of the toners were measured and the results are shown in Tables 2 and 3.

Toner Preparation Example 8

Preparation of Toner 8

The procedure for preparation of Toner 1 in Toner Preparation Example 1 was repeated to prepare a Toner 8 except for replacing Crystalline Resin A1 with Crystalline Resin A6, and Colorant Master Batch P1 with Colorant Master Batch P6, respectively. Properties of the toners were measured and the results are shown in Tables 2 and 3.

Toner Preparation Example 9

Preparation of Toner 9

The procedure for preparation of Toner 1 in Toner Preparation Example 1 was repeated to prepare a Toner 9 except for replacing Crystalline Resin A1 with Crystalline Resin A7, and Colorant Master Batch P1 with Colorant Master Batch P7, respectively. Properties of the toners were measured and the results are shown in Tables 2 and 3.

Toner Preparation Example 10

Preparation of Toner 10

A container equipped with a thermometer and a stirrer was charged with 37 parts by weight of Crystalline Resin A8, and 37 parts by weight of ethyl acetate, and the resulting mixture was heated to the temperature equal to or higher than the melting point of the resin to sufficiently dissolve Crystalline Resin A8. To this, 88 parts by weight of a 50% by weight Non-Crystalline Resin C1 ethyl acetate solution, 30 parts by weight of Wax Dispersion Liquid, 12 parts by weight of Colorant Master Batch P8, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 10.

The procedure for preparation of Toner 1 in Toner Preparation Example 1 was repeated to prepare a Toner 10 except for replacing Oil phase 1 with Oil Phase 10. Properties of the toners were measured and the results are shown in Tables 2 and 3.

Toner Preparation Example 11

Preparation of Toner 11

The procedure for preparation of Toner 1 in Toner Preparation Example 1 was repeated to prepare a Toner 11 except for replacing Crystalline Resin A1 with Crystalline Resin A9, and Colorant Master Batch P1 with Colorant Master Batch P9, respectively. Properties of the toners were measured and the results are shown in Tables 2 and 3.

Toner Preparation Example 12

Preparation of Toner 12

A container equipped with a thermometer and a stirrer was charged with 50 parts by weight of Crystalline Resin A8, and 50 parts by weight of ethyl acetate, and the resulting mixture was heated to the temperature equal to or higher than the melting point of the resin to sufficiently dissolve Crystalline Resin A8. To this, 62 parts by weight of a 50% by weight Non-Crystalline Resin C1 ethyl acetate solution, 30 parts by weight of Wax Dispersion Liquid, 12 parts by weight of Colorant Master Batch P8, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 12.

The procedure for preparation of Toner 1 in Toner Preparation Example 1 was repeated to prepare a Toner 12 except for replacing Oil phase 1 with Oil Phase 12. Properties of the toners were measured and the results are shown in Tables 2 and 3.

Toner Preparation Example 13

Preparation of Toner 13

A container equipped with a thermometer and a stirrer was charged with 63 parts by weight of Crystalline Resin A8, and 63 parts by weight of ethyl acetate, and the resulting mixture was heated to the temperature equal to or higher than the melting point of the resin to sufficiently dissolve Crystalline Resin A8. To this, 36 parts by weight of a 50% by weight Non-Crystalline Resin C1 ethyl acetate solution, 30 parts by weight of Wax Dispersion Liquid, 12 parts by weight of Colorant Master Batch P8, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 13.

The procedure for preparation of Toner 1 in Toner Preparation Example 1 was repeated to prepare a Toner 13 except for replacing Oil phase 1 with Oil Phase 13. Properties of the toners were measured and the results are shown in Tables 2 and 3.

Toner Preparation Example 14

Preparation of Toner 14

A container equipped with a thermometer and a stirrer was charged with 81 parts by weight of Crystalline Resin A8, and 81 parts by weight of ethyl acetate, and the resulting mixture was heated to the temperature equal to or higher than the melting point of the resin to sufficiently dissolve Crystalline Resin A8. To this, 30 parts by weight of Wax Dispersion Liquid, 12 parts by weight of Colorant Master Batch P8, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 14.

The procedure for preparation of Toner 1 in Toner Preparation Example 1 was repeated to prepare a Toner 14 except for replacing Oil phase 1 with Oil Phase 14. Properties of the toners were measured and the results are shown in Tables 2 and 3.

Toner Preparation Example 15

Preparation of Toner 15

A container equipped with a thermometer and a stirrer was charged with 37 parts by weight of Crystalline Resin A8, and 37 parts by weight of ethyl acetate, and the resulting mixture was heated to the temperature equal to or higher than the melting point of the resin to sufficiently dissolve Crystalline Resin A8. To this, 30 parts by weight of Wax Dispersion Liquid, 12 parts by weight of Colorant Master Batch P8, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents. To the resultant, 88 parts by weight of a 50% by weight Crystalline Resin Precursor B1 ethyl acetate solution was further added, and the resulting mixture was stirred by means of TK Homomixer at 50° C. and at 10,000 rpm to uniformly dissolve and disperse, to thereby obtain Oil Phase 15. Note that, the temperature of Oil Phase 15 was kept at 50° C. in the container, and Oil Phase 15 was used within 5 hours from the production so as not to crystallize the contents.

Next, a separate container equipped with a stirrer and a thermometer was charged with 90 parts by weight of ion-exchanged water, 3 parts by weight of a 25% by weight organic resin particles (copolymer of styrene, methacrylic acid, butyl acrylate, and sodium sulfate of methacrylic acid ethylene oxide adduct) dispersion liquid (manufactured by Sanyo Chemical Industries Ltd.) for stabilizing a dispersion state, 1 part by weight of sodium carboxymethyl cellulose, 16 parts by weight of a 48.5% aqueous solution of sodium dodecyldiphenyl ether disulfonate (ELEMINOL MON-7, manufactured by Sanyo Chemical Industries Ltd.), and 5 parts by weight of ethyl acetate, and the resulting mixture was mixed and stirred at 40° C. to thereby prepare an aqueous phase solution. To this, 80 parts by weight of Oil Phase 15 the temperature of which had been kept at 50° C., and 7.5 parts by weight of isophorone diamine were added, the resulting mixture was mixed for 1 minute by means of TK Homomixer (of Tokushu Kika Kogyo Co., Ltd.) at 40° C. to 50° C. and at 11,000 rpm, to thereby obtain Emulsified Slurry 15.

A container equipped with a stirrer and a thermometer was charged with Emulsified Slurry 15, and the solvent was removed from Emulsified Slurry 15 over the period of 6 hours at 60° C., followed by allowing the unreacted crystalline resin precursor to react (age) for 10 hours at 45° C., to thereby obtain Slurry 15.

The procedure for preparation of Toner 1 in Toner Preparation Example 1 was repeated to prepare a Toner 15 except for replacing Slurry 1 with Slurry 15. Properties of the toners were measured and the results are shown in Tables 2 and 3.

Toner Preparation Example 16

Preparation of Toner 16

The procedure for preparation of Toner 1 in Toner Preparation Example 1 was repeated to prepare a Toner 16 except for replacing Crystalline Resin A1 with Crystalline Resin A10, and Colorant Master Batch P1 with Colorant Master Batch P10, respectively. Properties of the toners were measured and the results are shown in Tables 2 and 3.

Toner Preparation Example 17

Preparation of Toner 17

The procedure for preparation of Toner 1 in Toner Preparation Example 1 was repeated to prepare a Toner 17 except for replacing Crystalline Resin A1 with Crystalline Resin A11, and Colorant Master Batch P1 with Colorant Master Batch P11, respectively. Properties of the toners were measured and the results are shown in Tables 2 and 3.

Toner Preparation Example 18

Preparation of Toner 18

Crystalline Resin A1 (37 parts by weight), Non-Crystalline Resin C1 (44 parts by weight), paraffin wax (HNP-9 (melting point: 75° C.), manufactured by NIPPON SEIRO CO., LTD.) (6 parts by weight), and Colorant Master Batch P1 (12 parts by weight) were pre-mixed by means of HENSCHEL MIXER (FM10B, manufactured by Nippon Cole & Engineering Co., Ltd.), followed by being melted and kneaded by means of two-axial kneader (PCM-30, manufactured by Ikegai Corp) at the temperature of 80° C. to 120° C. The obtained kneaded product was cooled to room temperature, followed by pulverized by a hammer mill into the size of 200 μm to 300 μm. Subsequently, the resultant was finely pulverized by means of Supersonic Jet Mill Labo Jet (manufactured by Nippon Pneumatic Mfg. Co., Ltd.) with appropriately adjusting the pulverizing air pressure to give the weight average particle diameter of 6.2 μm±0.3 μm, followed by subjected to classification by means of an air classifier (MDS-I, manufactured by Nippon Pneumatic Mfg. Co., Ltd.) with appropriately adjusting the opening degree of the louver so that the weight average particle diameter was to be 7.0 μm±0.2 μm, and the amount of the fine powder having the diameter of 4 μm or smaller was to be 10% by number or less, to thereby obtain Toner Base Particles 18.

The procedure for preparation of Toner 1 in Toner Preparation Example 1 was repeated to prepare a Toner 18 except for replacing Toner Base Particles 1 with Toner Base Particles 18. Properties of the toners were measured and the results are shown in Tables 2 and 3.

Toner Preparation Example 19

Preparation of Toner 19

To an aqueous phase in which 100 parts by weight of water, 5 parts by weight of a 48.5% aqueous solution of sodium dodecyldiphenyl ether disulfonate (ELEMINOL MON-7, manufactured by Sanyo Chemical Industries Ltd.), and 2 parts by weight of a 2% by weight of sodium hydroxide aqueous solution were mixed, 100 parts by weight of Oil Phase 1 was added, and the resulting mixture was emulsified by means of a homogenizer (ULTRA-TURRAX T50, of IKA), followed by subjected to emulsification by means of Manton-Gaulin high-pressure homogenizer (of Gaulin (SPX Corporation)), to thereby obtain Emulsified Slurry 19.

Subsequently, a container equipped with a stirrer and a thermometer was charged with Emulsified Slurry 19, and the solvent was removed from Emulsified Slurry 19 over the period of 4 hours at 60° C., to thereby obtain slurry. The particles contained in the obtained slurry were subjected to the measurement of the volume average particle diameter by means of a particle size distribution measuring device (LA-920, manufactured by Horiba Ltd.), and the result was 0.2 μm.

A container equipped with a stirrer and a thermometer was charged with 1,000 parts by weight of water, 5 parts by weight of a 48.3% by weight sodium dodecyl diphenyl ether sulfonate, 800 parts by weight of the aforementioned slurry, and the resulting mixture was adjusted with a 2% by weight sodium hydroxide aqueous solution to give a pH of 10. To the resultant, a solution in which 40 parts by weight of magnesium chloride hexahydrate had been dissolved in 40 parts by weight of ion-exchanged water was added little by little with stirring, and heated up to 80° C. The temperature of the resultant was kept at 80° C. until the aggregated particles therein grew into the size of 5.8 μm, to thereby Slurry 19.

The procedure for preparation of Toner 1 in Toner Preparation Example 1 was repeated to prepare a Toner 19 except for replacing Slurry 1 with Slurry 19. Properties of the toners were measured and the results are shown in Tables 2 and 3.

Toner Preparation Example 24

Preparation of Toner 24

The procedure for preparation of Toner 1 in Toner Preparation Example 1 was repeated to prepare a Toner 24 except for replacing Crystalline Resin A1 with Crystalline Resin A12. Properties of the toners were measured and the results are shown in Tables 2 and 3.

Toner Preparation Example 25

Preparation of Toner a

A container equipped with a thermometer and a stirrer was charged with 82 parts by weight of Crystalline Resin A1, and 82 parts by weight of ethyl acetate, and the resulting mixture was heated to the temperature equal to or higher than the melting point of the resin to sufficiently dissolve Crystalline Resin A13. To this, 30 parts by weight of Wax Dispersion Liquid, 12 parts by weight of Colorant Master Batch P13, and 46 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase a.

The procedure for preparation of Toner 1 in Toner Preparation Example 1 was repeated to prepare a Toner a except for replacing Oil phase 1 with Oil Phase a. Properties of the toners were measured and the results are shown in Tables 2 and 3.

Toner Preparation Example 26

Preparation of Toner b

A container equipped with a thermometer and a stirrer was charged with 38 parts by weight of Crystalline Resin A8, and 38 parts by weight of ethyl acetate, and the resulting mixture was heated to the temperature equal to or higher than the melting point of the resin to sufficiently dissolve Crystalline Resin A8. To this, 30 parts by weight of Wax Dispersion Liquid, 12 parts by weight of Colorant Master Batch P8, and 46 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents. To the resultant, 88 parts by weight of a 50% by weight Crystalline Resin Precursor B1 ethyl acetate was further added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase b.

The procedure for preparation of Toner 15 in Toner Preparation Example 15 was repeated to prepare a Toner b except for replacing Oil phase 15 with Oil Phase b. Properties of the toners were measured and the results are shown in Tables 2 and 3.

Toner Preparation Example 27

Preparation of Toner c

A container equipped with a thermometer and a stirrer was charged with 33 parts by weight of Crystalline Resin A1, and 33 parts by weight of ethyl acetate, and the resulting mixture was heated to the temperature equal to or higher than the melting point of the resin to sufficiently dissolve Crystalline Resin A1. To this, 96 parts by weight of a 50% by weight Non-Crystalline Resin C1 ethyl acetate solution, 30 parts by weight of Wax Dispersion Liquid, 12 parts by weight of Colorant Master Batch P1, and 47 parts by weight of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase c.

The procedure for preparation of Toner 1 in Toner Preparation Example 1 was repeated to prepare a Toner c except for replacing Oil phase 1 with Oil Phase c. Properties of the toners were measured and the results are shown in Tables 2 and 3.

TABLE 2

| | | Binder Resin | | | | | |
|---|---|---|---|---|---|---|---|
| | | Crystalline Resin A | | Crystalline Resin B | | Crystalline Resin C | |
| Toner | Preparation Method | Name | Content (parts by weight) | Name | Content (parts by weight) | Name | Content (parts by weight) |
| Toner 1 | Dissolution suspension | A1 | 50 | — | — | C1 | 50 |
| Toner 2 | Dissolution suspension | A1 | 100 | — | — | — | — |
| Toner 3 | Dissolution suspension | A2 | 50 | — | — | C1 | 50 |
| Toner 4 | Dissolution suspension | A3 | 50 | — | — | C1 | 50 |
| Toner 5 | Dissolution suspension | A4 | 50 | — | — | C1 | 50 |
| Toner 6 | Dissolution suspension | A5 | 50 | — | — | C1 | 50 |
| Toner 7 | Dissolution suspension | A1 | 50 | — | — | C1 | 50 |
| Toner 8 | Dissolution suspension | A6 | 50 | — | — | C1 | 50 |
| Toner 9 | Dissolution suspension | A7 | 50 | — | — | C1 | 50 |
| Toner 10 | Dissolution suspension | A8 | 50 | — | — | C1 | 50 |
| Toner 11 | Dissolution suspension | A9 | 50 | — | — | C1 | 50 |
| Toner 12 | Dissolution suspension | A8 | 65 | — | — | C1 | 35 |
| Toner 13 | Dissolution suspension | A8 | 80 | — | — | C1 | 20 |
| Toner 14 | Dissolution suspension | A8 | 100 | — | — | — | — |
| Toner 15 | Dissolution suspension | A8 | 50 | B1 | 50 | — | — |
| Toner 16 | Dissolution suspension | A11 | 50 | — | — | C1 | 50 |
| Toner 17 | Dissolution suspension | A12 | 50 | — | — | C1 | 50 |
| Toner 18 | Kneading-pulverization | A1 | 50 | — | — | C1 | 50 |
| Toner 19 | Aggregation | A1 | 50 | — | — | C1 | 50 |
| Toner 24 | Dissolution suspension | A12 | 50 | — | — | C1 | 50 |
| Toner a | Dissolution suspension | A13 | 100 | — | — | — | — |
| Toner b | Dissolution suspension | A8 | 25 | B1 | 75 | — | — |
| Toner c | Dissolution suspension | A1 | 45 | — | — | C1 | 55 |

TABLE 3

| Toner | Melting point Ta (° C.) | Softening point Tb (° C.) | Tb/Ta | Visco- elasticity G'(Ta + 20) (Pa) | G"(Ta + 20) (Pa) | G"(Ta + 30) (Pa) | G"(Ta + 70) (Pa) | G"(Ta + 30)/ G"(Ta + 70) |
|---|---|---|---|---|---|---|---|---|
| Toner 1 | 59 | 63 | 1.07 | $4.4 \times 10^3$ | $2.1 \times 10^3$ | $1.2 \times 10^3$ | $2.4 \times 10^1$ | 50.0 |
| Toner 2 | 58 | 60 | 1.03 | $4.0 \times 10^3$ | $1.3 \times 10^3$ | $8.7 \times 10^2$ | $3.4 \times 10^1$ | 25.6 |
| Toner 3 | 63 | 70 | 1.11 | $4.7 \times 10^3$ | $2.3 \times 10^3$ | $9.8 \times 10^2$ | $4.6 \times 10^1$ | 21.3 |
| Toner 4 | 67 | 87 | 1.30 | $6.0 \times 10^5$ | $7.6 \times 10^4$ | $1.4 \times 10^4$ | $8.8 \times 10^2$ | 15.9 |
| Toner 5 | 60 | 75 | 1.25 | $2.7 \times 10^3$ | $8.3 \times 10^2$ | $8.1 \times 10^2$ | $5.6 \times 10^1$ | 14.5 |
| Toner 6 | 53 | 67 | 1.26 | $2.0 \times 10^5$ | $3.1 \times 10^4$ | $7.2 \times 10^3$ | $2.6 \times 10^2$ | 27.7 |
| Toner 7 | 58 | 61 | 1.05 | $4.6 \times 10^3$ | $1.9 \times 10^3$ | $1.2 \times 10^3$ | $5.8 \times 10^1$ | 20.7 |
| Toner 8 | 59 | 76 | 1.29 | $4.8 \times 10^5$ | $3.3 \times 10^4$ | $2.9 \times 10^4$ | $8.5 \times 10^3$ | 3.4 |
| Toner 9 | 60 | 65 | 1.08 | $1.7 \times 10^5$ | $1.2 \times 10^4$ | $9.5 \times 10^3$ | $3.8 \times 10^3$ | 2.5 |
| Toner 10 | 66 | 84 | 1.27 | $5.6 \times 10^5$ | $5.3 \times 10^4$ | $4.2 \times 10^4$ | $1.7 \times 10^4$ | 2.5 |
| Toner 11 | 70 | 91 | 1.30 | $6.1 \times 10^5$ | $7.8 \times 10^4$ | $7.2 \times 10^4$ | $3.2 \times 10^4$ | 2.3 |
| Toner 12 | 65 | 79 | 1.22 | $9.2 \times 10^5$ | $8.7 \times 10^4$ | $8.4 \times 10^4$ | $3.6 \times 10^4$ | 2.3 |
| Toner 13 | 65 | 77 | 1.18 | $2.5 \times 10^6$ | $2.4 \times 10^5$ | $1.6 \times 10^5$ | $7.5 \times 10^4$ | 2.1 |
| Toner 14 | 65 | 75 | 1.15 | $4.8 \times 10^6$ | $4.1 \times 10^5$ | $4.0 \times 10^5$ | $1.9 \times 10^5$ | 2.1 |
| Toner 15 | 66 | 83 | 1.26 | $2.6 \times 10^6$ | $2.1 \times 10^5$ | $2.0 \times 10^5$ | $1.9 \times 10^5$ | 1.1 |
| Toner 16 | 57 | 68 | 1.19 | $1.7 \times 10^3$ | $9.8 \times 10^2$ | $7.3 \times 10^2$ | $1.2 \times 10^1$ | 60.8 |
| Toner 17 | 58 | 66 | 1.14 | $3.1 \times 10^4$ | $3.3 \times 10^4$ | $9.3 \times 10^3$ | $5.2 \times 10^3$ | 1.8 |
| Toner 18 | 58 | 60 | 1.03 | $1.1 \times 10^3$ | $7.6 \times 10^2$ | $6.9 \times 10^2$ | $1.2 \times 10^1$ | 57.5 |
| Toner 19 | 59 | 63 | 1.07 | $4.2 \times 10^3$ | $2.3 \times 10^3$ | $1.2 \times 10^3$ | $2.4 \times 10^1$ | 50.0 |
| Toner 24 | 62 | 68 | 1.10 | $2.0 \times 10^5$ | $1.8 \times 10^4$ | $1.5 \times 10^4$ | $1.0 \times 10^4$ | 1.5 |
| Toner a | 44 | 48 | 1.09 | $9.7 \times 10^2$ | $2.6 \times 10^2$ | $1.2 \times 10^2$ | $5.0 \times 10^1$ | 2.4 |
| Toner b | 76 | 88 | 1.16 | $5.5 \times 10^6$ | $5.3 \times 10^6$ | $2.3 \times 10^6$ | $7.8 \times 10^4$ | 29.5 |
| Toner c | 59 | 64 | 1.08 | $8.7 \times 10^2$ | $6.5 \times 10^2$ | $5.2 \times 10^2$ | — | — |

Carrier Preparation Example 1

Preparation of Carrier A

<Preparation of Kneaded Product of Magnetic Material>

A styrene-butyl acrylate copolymer (glass transition temperature Tg: 62° C., weight average molecular weight Mw: 156,000) (75 parts by weight) and SmFeN (Wellmax-S3A, product of SUMITOMO METAL MINING CO., LTD., resin content: 10% by weight, average particle diameter: 1 μm) (25 parts by weight) were thoroughly mixed together. The resultant mixture was kneaded by being passed twice through an open roll kneader (KNEADEX, product of NIPPON COKE & ENGINEERING, CO., LTD.) under the following conditions: front-roller-supply side: 140° C., front-roller-discharge side: 50° C., back-roller-supply side: 100° C., back-roller-discharge side: 40° C., front roller rotation speed: 35 rpm, back roller rotation speed: 31 rpm, and gap: 0.25 mm, followed by pulverizing with a pulverizer (product of HOSOKAWA MICRON CORPORATION) to thereby obtain a kneaded product of a magnetic material.

<Preparation of Magnetic Material-Dispersed Resin Powder>

The thus-obtained kneaded product of a magnetic material was pulverized for 60 hours with a ball mill pulverizer (V1-ML, product of IRIE SHOKAI Co., Ltd.) at 46 rpm under the following conditions: the amount of balls filled: 1.5 L and ball size: 500 μm, 3.8 kg. The pulverized product was classified with an elbow-jet classifier (product of Nittetsu Mining Co., Ltd.) to thereby obtain a magnetic material-dispersed resin powder having a number-average particle diameter of 10 μm. Notably, the number average particle diameter was measured with FPIA3000 (product of SYSMEX CORPORATION).

<Provision of Magnetic Anisotropy>

The thus-classified magnetic material-dispersed resin powder was placed in a glass cylindrical container having a diameter of 30 mm, and left for 5 min in a magnetic flux density of 8 T using a high magnetic field application apparatus (product of Sumitomo Heavy Industries, Ltd.) to thereby obtain resin carrier A.

Notably, the following method was employed to judge whether the obtained carrier had a magnetic anisotropy in which the magnetic field had been oriented in the same direction.

First, a cell having a volume of 5.655 $cm^3$ (cc) was charged with the carrier A in substantially the closest packed state and closed with a cap to prepare a sample (a first sample). The amount of the carrier A charged in the first sample was found to be 0.0425 g. Next, another cell was charged with the carrier in an amount of 75% by weight of the amount of the carrier in the first sample and closed with a cap to prepare a sample (a second sample). Further, another cap was charged with the carrier in an amount of 50% by weight of the amount of the carrier in the first sample and closed with a cap to prepare a sample (a third sample).

Each of these samples was set in a sample holder of a magnetization meter VSM-C7-10A (product of TOEI INDUSTRY CO., LTD.) and measured for hysteresis curve at a magnetic field of ±5 kOe.

As a result, the first, second and third samples charged with the carrier A were found to be 7.26 emu/g, 20.21 emu/g and 23.82 emu/g, respectively.

Here, when the carrier having magnetic anisotropy is charged in the closest packed state, it cannot rotate in the direction of the magnetic field, resulting in that the maximum value is not observed. In other words, when the carrier has magnetic anisotropy, the second or third sample has a higher saturated magnetization than the first sample which is charged with the carrier in the closest packed state.

In this manner, it was confirmed that the carrier A had magnetic anisotropy.

Carrier Preparation Example 2

Preparation of Carrier B

The procedure for preparation of Carrier A in Carrier Preparation Example 1 was repeated to prepare a resin carrier B except for changing the number-average particle diameter of the anisotropic magnetic material-dispersed resin powder from 10 to 16 μm.

Carrier Preparation Example 3

Preparation of Carrier C

The procedure for preparation of Carrier A in Carrier Preparation Example 1 was repeated to prepare a resin carrier C except for changing the number-average particle diameter of the anisotropic magnetic material-dispersed resin powder from 10 to 36 μm.

Carrier Preparation Example 4

Preparation of Carrier D

Figure 5:
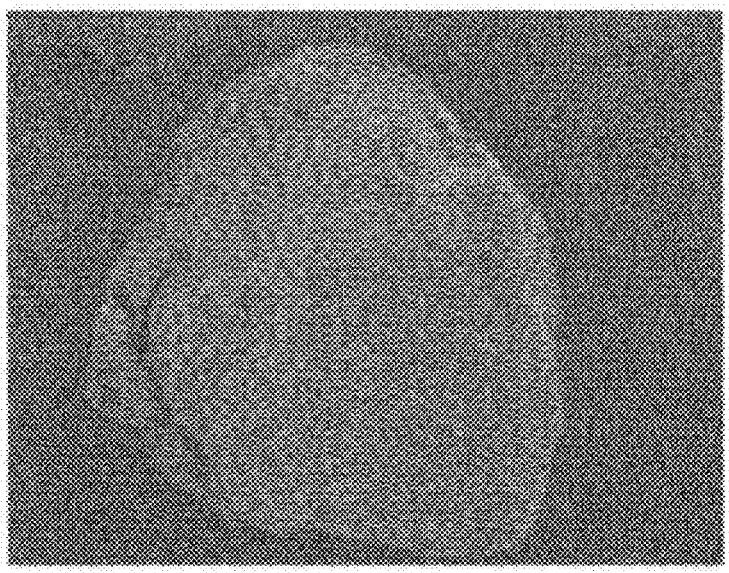
FIG. 5 is micrographic image of the resin carrier D.

The procedure for preparation of Carrier A in Carrier Preparation Example 1 was repeated to prepare a resin carrier D except for changing the number-average particle diameter of the anisotropic magnetic material-dispersed resin powder from 10 to 50 μm. A microscopic photographic image thereof is shown in FIG. 5.

Carrier Preparation Example 5

Preparation of Carrier E

The procedure for preparation of Carrier A in Carrier Preparation Example 1 was repeated to prepare a resin carrier E except for changing the number-average particle diameter of the anisotropic magnetic material-dispersed resin powder from 10 to 80 μm.

Carrier Preparation Example 6

Preparation of Carrier F

The procedure for preparation of Carrier A in Carrier Preparation Example 1 was repeated to prepare a resin carrier F except for changing the number-average particle diameter of the anisotropic magnetic material-dispersed resin powder from 10 to 100 μm.

Carrier Preparation Example 7

Preparation of Carrier G

The procedure for preparation of Carrier B in Carrier Preparation Example 2 was repeated to prepare a resin carrier G except for changing the mixing ratio by weight of the binder resin to the particulate magnetic material from 75/25 to 60/40.

Carrier Preparation Example 8

Preparation of Carrier H

The procedure for preparation of Carrier B in Carrier Preparation Example 2 was repeated to prepare a resin carrier H except for changing the mixing ratio by weight of the binder resin to the particulate magnetic material from 75/25 to 70/30.

Carrier Preparation Example 9

Preparation of Carrier I

The procedure for preparation of Carrier B in Carrier Preparation Example 2 was repeated to prepare a resin carrier I except for changing the mixing ratio by weight of the binder resin to the particulate magnetic material from 75/25 to 80/20.

Carrier Preparation Example 10

Preparation of Carrier J

The procedure for preparation of Carrier B in Carrier Preparation Example 2 was repeated to prepare a resin carrier J except for changing the mixing ratio by weight of the binder resin to the particulate magnetic material from 75/25 to 85/15.

Carrier Preparation Example 11

Preparation of Carrier K

The procedure for preparation of Carrier B in Carrier Preparation Example 2 was repeated to prepare a resin carrier K except that the classified magnetic material-dispersed resin powder was further treated with hot air of 300° C. using a suffusion system (product of Nippon Pneumatic Mfg. Co., Ltd.) to make the magnetic material-dispersed resin powder have an average circularity of 0.98, to there by obtain resin carrier K.

Carrier Preparation Example 12

Preparation of Carrier L

The procedure for preparation of Carrier B in Carrier Preparation Example 2 was repeated to prepare a resin carrier L except for changing the magnetic flux density of the high magnetic field application apparatus from 8 T to 2 T.

Carrier Preparation Example 13

Preparation of Carrier M

The procedure for preparation of Carrier B in Carrier Preparation Example 2 was repeated to prepare a resin carrier M except for changing the magnetic flux density of the high magnetic field application apparatus from 8 T to 0.1 T.

Carrier Preparation Example 14

Preparation of Carrier N

The procedure for preparation of Carrier B in Carrier Preparation Example 2 was repeated to prepare a resin carrier N except for changing the magnetic material from SmFeN to $Sm_2Co_{17}$ (Wellmax-PH, product of SUMITOMO METAL MINING CO., LTD., resin content: 10% by weight, average particle diameter: 1 μm).

Carrier Preparation Example 15

Preparation of Carrier O

A spherical particulate ferrite having an average particle diameter of 35 μm as a carrier core material (MFL-35S from POWDER TECH CO.) was coated with a mixture of a silicone resin and a melamine resin as a coating material (from Dow Corning Toray Co., Ltd.) to prepare a carrier O.

The properties of the above-obtained resin carriers A to O are shown below.

Notably, the number average particle diameter or the average circularity was measured as a number average of measurements obtained using FPIA3000 (product of SYSMEX CORPORATION). Also, the saturated magnetization and the coercive force were measured as described above using VSM-C7-10A (product of TOEI INDUSTRY CO., LTD.). Here, the saturated magnetization of each resin carrier was a measurement obtained when the amount of the carrier charged was 75% by weight of the amount of the carrier charged in the closest packed state.

The magnetic particulate carriers A to M were SmFeN, and the fine magnetic particles of carrier N was $Sm_2Co_{17}$. The results are shown in Table 4.

TABLE 4

| | Ratio by weight (Resin/Magnetic material) | Avg. particle diameter after classified (μm) | Avg. circularity | Applied Magnetic flux density (T) | Saturated magnetization (emu/g) | Coercive force (kA/m) |
|---|---|---|---|---|---|---|
| Carrier A | 75/25 | 10 | 0.94 | 8 | 25.3 | 14.4 |
| Carrier B | 75/25 | 16 | 0.92 | 8 | 23.1 | 12.4 |
| Carrier C | 75/25 | 36 | 0.91 | 8 | 21.3 | 12.2 |
| Carrier D | 75/25 | 50 | 0.88 | 8 | 19.3 | 14.3 |
| Carrier E | 75/25 | 80 | 0.85 | 8 | 18.6 | 13.6 |
| Carrier F | 75/25 | 100 | 0.86 | 8 | 17.5 | 13.0 |
| Carrier G | 60/40 | 36 | 0.92 | 8 | 12.3 | 6.72 |
| Carrier H | 70/30 | 36 | 0.92 | 8 | 19.8 | 15.0 |
| Carrier I | 80/20 | 36 | 0.92 | 8 | 28.2 | 24.2 |
| Carrier J | 85/15 | 36 | 0.92 | 8 | 33.9 | 28.3 |
| Carrier K | 75/25 | 36 | 0.98 | 8 | 21.6 | 12.3 |
| Carrier L | 75/25 | 36 | 0.92 | 2 | 17.2 | 15.2 |
| Carrier M | 75/25 | 36 | 0.92 | 0.1 | 6.1 | 1.5 |
| Carrier N | 75/25 | 36 | 0.9 | 8 | 20.1 | 10.9 |
| Carrier O | — | 36 | 0.98 | — | 70.0 | 0.1 |

Examples 1 to 28 and Comparative Examples 1 to 9

Preparation of Two-Component Developer and Evaluation

[Toner and Developer Properties]

The image forming apparatus in FIG. 2 was modified to detachably mount a process cartridge including an electrostatic latent image bearer, a charger, an image developer and a cleaner. The toner and the developer were evaluated using the image forming apparatus. The results are shown in Tables 5-1, 5-2 and 5-3.

Example 1

Seven (7) parts by weight of Toner 1 was uniformly mixed with 100 parts by weight of Carrier A in Table 4 at 48 rpm for 3 min to be charged by a turbular mixer (from Willy A. Bachofen (WAB) AG) rolling a container to mix materials therein. Then, 200 g of Carrier A and 14 g of Toner 1 were placed the container made of stainless.

The two-component developer was filled in a developing unit of the indirect transfer tandem image forming apparatus using a contact charging method, a two-component developing method, a second transfer method, a blade cleaning method and an outer heating roller fixing method to produce images for evaluating the toner and the developer.

The image forming apparatus therein is a tandem color image forming apparatus including a duplicator 150, a paper feeding table 200, a scanner 300 and an automatic document feeder (ADF) 400.

Examples 2 to 28 and Comparative Examples 1 to 9

The procedure for preparation of the developer in Example 1 was repeated to prepare developers in Example 2 to 28 and Comparative Examples 1 to 9 except for changing the combination of the carriers and the toners as shown in Tables 5-1, 5-2 and 5-3, and evaluation of the toner and the developer in Example 1 was repeated to evaluate the toners and the developers in Example 2 to 28 and Comparative Examples 1 to 9. The results are shown in Tables 5-1, 5-2 and 5-3.

<Evaluation>

The evaluation methods for the binder resin for use, toner, and developer will be specifically explained hereinafter.

[Melting Point Ta and Softening Point Tb of Binder Resin and Toner, and Ratio Ta/Tb of Melting Point to Softening Point]

The melting points (the maximum peak temperature of heat of melting, Ta) of the binder resin and toner were measured by a differential scanning calorimeter (DSC)(TA-60WS and DSC-60, manufactured by Shimadzu Corporation). A sample provided for the measurement of the maximum peak of heat of melting was subjected to the pretreatment. As for the pretreatment, the sample was melted at 130° C., followed by cooling from 130° C. to 70° C. at the cooling rate of 1.0° C./min. The sample was then cooled from 70° C. to 10° C. at the cooling rate of 0.5° C./min. The sample was subjected to the measurement of endothermic and exothermic changes in DSC by heating at the heating rate of 20° C., to thereby plot "absorption or evolution heat capacity" verses "temperature" in a graph. The endothermic peak temperature in the range of 20° C. to 100° C. appeared in the graph was determined as "Ta*." Note that, in the case where there were few endothermic peaks, the temperature of the peak having the largest endothermic value was determined as Ta*. Thereafter, the sample was stored for 6 hours at the temperature of (Ta*-10)° C., followed by stored for 6 hours at the temperature of (Ta*−15)° C. Next, the sample was cooled to 0° C. at the cooling rate of 10° C./min., heated at the heating rate of 20° C./min. to measure the endothermic and exothermic changes by means of DSC, creating a graph in the same manner as the above. In the graph, the temperature corresponding to the maximum peak of the absorption or evolution heat capacity was determined as the maximum peak temperature of heat of melting.

The softening points (Tb) of the binder resins and the toners were measured by means of an elevated flow tester (e.g., CFT-500D, manufactured by Shimadzu Corporation). As a sample, 1 g of the binder resin or toner was used. The sample was heated at the heating rate of 6° C./min., and at the same time, load of 1.96 Mpa was applied by a plunger to extrude the sample from a nozzle having a diameter of 1 mm and length of 1 mm, during which an amount of the plunger of the flow tester pushed down relative to the temperature was plotted. The temperature at which half of the sample was flown out was determined as a softening point of the sample.

From the results above obtained in the aforementioned manner, a ratio (softening point/maximum peak temperature of heat of melting: Ta/Tb) of the softening point of the binder resin or toner to the melting point of the binder resin or toner was obtained. The results of the binder resins and the toners are presented Tables 1 and 3, respectively.

(Viscoelasticity of Toner)

The dynamic viscoelastic values (storage elastic modulus G', loss elastic modulus G") of the toner, specifically, storage elastic modulus G'(Ta+20) and loss elastic modulus G"(Ta+20) at the temperature of (the maximum peak temperature of heat of melting)+20° C., loss elastic modulus G"(Ta+30) at the temperature of (the maximum peak temperature of heat of melting)+30° C., loss elastic modulus G"(Ta+70) at the temperature of (the maximum peak temperature of heat of melting)+70° C., and a ratio (G"(30/70)) of G"(Ta+30) to G"(Ta+70), were measured by means of a dynamic viscoelasticity measuring device (ARES, of TA INSTRUMENTS JAPAN INC.), with frequency of 1 Hz. A sample was formed into a pellet having a diameter of 8 mm, and a thickness of 1 mm to 2 mm, and the pellet sample was fixed to a parallel plate having a diameter of 8 mm, followed by stabilizing at 40° C. Then, the sample was heated to 200° C. at the heating rate of 2.0° C./min. with frequency of 1 Hz (6.28 rad/s), and strain of 0.1% (in a strain control mode) to thereby measure dynamic viscoelastic values of the sample. The results are presented in Table 3.

(Low Temperature Fixability (Minimum Fixing Temperature))

Using Image Forming Apparatus A, a solid image (the image size: 3 cm×8 cm) having a toner deposition amount of 0.85 mg/cm$^2$±0.1 mg/cm$^2$ (after transferring) on transfer paper (Copy Print Paper <70>, of Ricoh Business Expert, Ltd.) was formed, and the transferred image was fixed with varying the temperature of the fixing belt. The surface of the obtained fixed image was drawn with a ruby needle (point diameter: 260 μm to 320 μm, point angle: 60 degrees) by means of a drawing tester AD-401 (from Ueshima Seisakusho Co., Ltd.) with a load of 50 g. The drawn surface was rubbed 5 times with fibers (HaniCot #440, available from Sakata Inx Eng. Co., Ltd.). The temperature of the fixing belt at which hardly any image was scraped in the resulting image was determined as the minimum fixing temperature. Moreover, the solid image was formed in the position of the transfer paper, which was 3.0 cm from the edge of the paper from which the sheet was fed. Note that, the speed of the sheet passing the nip in the fixing device was 280 mm/s. The lower the minimum fixing temperature is, more excellent the low temperature fixability of the toner is. The results are presented in Tables 5-1, 5-2 and 5-3.

(Hot Offset Resistance (Fixable Temperature Range))

Using Image Forming Apparatus A, a solid image (the image size: 3 cm×8 cm) having a toner deposition amount of 0.85 mg/cm$^2$±0.1 mg/cm$^2$ (after transferring) on transfer paper (Type 6200, manufactured by Ricoh Company Limited) was formed, and the transferred image was fixed with varying the temperature of the fixing belt. Then, occurrences of hot offset was visually evaluated, and the temperature range between the upper temperature at which the hot offset did not occur, and the minimum fixing temperature was determined as the fixable temperature range. Moreover, the solid image was formed in the position of the transfer paper, which was 3.0 cm from the edge of the paper from which the sheet was fed. Note that, the speed of the sheet passing the nip in the fixing device was 280 mm/s. The toner has more excellent hot offset resistance as the fixable temperature range widens, and about 50° C. is the average fixable temperature range of a conventional full color toner. The results are presented in Tables 5-1, 5-2 and 5-3.

(Contamination of Carrier)

The contamination of the carrier is properties for indicating the contamination of carrier with the toner. The higher the mechanical strength of the toner is, less likely contamination of the carrier occurs.

The image forming apparatus in FIG. 2 was used to perform a running test for outputting 30,000 sheets of the print on which an image chart having an imaging area of 50% was printed in a monochrome mode. After the test, the developer was taken out from the image forming apparatus, and an appropriate amount of the developer was placed in a cage which had been covered with a mesh having an opening size of 32 μm. Then, the toner and carrier were separated from each other by air blow. Next, 1.0 g of the obtained carrier was placed in a 50 mL glass bottle, 10 mL of chloroform was added to the glass bottle, followed by shaking the bottle 50 times by hand. Then, it was left to stand for 10 minutes. Thereafter, the supernatant, that was the chloroform solution, was placed in a glass cell, and the transmittance of the chloroform solution was measured by means of a tribidimeter. The results are presented in Table 5.

[Evaluation Standard]

Excellent: transmittance of 95% or higher

Good: transmittance of 90% or higher, but lower than 95%

Fair: transmittance of 80% or higher, but lower than 90%

Poor: transmittance of 70% or higher, but lower than 80%

Worst: transmittance of lower than 70%

(Heat Resistant Storage Stability)

A 50 mL glass container was filled with the toner, and the container was left to stand in a thermostat of 50° C. for 24 hours, followed by cooling to 24° C. The resulting toner was subjected to a penetration degree test (JIS K2235-1991) to thereby measure a penetration degree (mm), and the result was evaluated in terms of the heat resistant storage stability based on the following criteria. The greater the penetration degree is, more excellent the heat resistant storage stability of the toner is. The toner having the penetration degree of lower than 10 mm more likely causes a problem on practice. The results are presented in Table 4.

[Evaluation Standard]

Excellent: penetration degree of 25 mm or greater

Good: penetration degree of 20 mm or greater, but less than 25 mm

Fair: penetration degree of 15 mm or greater, but less than 20 mm

Poor: penetration degree of 10 mm or greater, but less than 15 mm

Worst: penetration degree of less than 10 mm (Reproducibility in Halftone Portion and Carrier Adherence (1))

The image forming apparatus was adjusted such that a toner adherence amount after transferred was 0.85±0.1 mg/cm$^2$ on a transfer paper POD GLOSS (from Oji paper Co., Ltd.) The fixing belt was set to have a minimum fixing temperature of +10° C. The A4 size paper passed a nip of the fixer at 280 mm/s. One hundred thousand (100,000) images of a dither pattern of 1,200 dpi and 16 gradation were continuously produced. These printed images were visually compared with each other to evaluate reproducibility in the half-tone portion according to the following evaluation criteria.

[Evaluation Standard]

Good: High reproducibility

Fair: Irregularities were slightly observed but caused no problem in practical use Poor: Irregularities were observed.

After completion of the above printing, carrier adherence was visually observed and evaluated according to the following evaluation standard.

[Evaluation Standard]

Good: No adherence was observed

Fair: Adherence was partially observed but caused no image failures

Poor: Adherence was observed and caused image failures such as voids (Uniformity of Solid Image and Carrier Adherence (2))

The image forming apparatus was adjusted such that a toner adherence amount after transferred was 0.6±0.1 mg/cm$^2$ on a transfer paper (Type 6000 A4 paper from Ricoh Company, Ltd.). The fixing belt was set to have a minimum fixing temperature of +10° C. The A4 size paper passed a nip of the fixer at 280 mm/s. Five (5) solid images were continuously produced to evaluate solid image uniformity according to the following evaluation standard.

[Evaluation Standard for Solid Image Uniformity]

Good: Variation in ID<0.1

Fair: Variation in ID<0.3

Poor: 0.3≤variation in ID

Notably, the variation in ID was measured as follows. Specifically, each of the five sheets having the solid image was divided into 9 areas which were measured for ID with X-Rite914. Variation in 45 IDs in total was used as the variation in ID.

After completion of the above printing, carrier adherence was visually observed and evaluated according to the following evaluation standard.

[Evaluation Standard]

Good: No adherence

Fair: Adherence was partially observed but caused no image failures

Poor: Adherence was observed and caused image failures (Aggregation in Image Developer)

After the above evaluation for half-tone reproducibility and solid image uniformity, the complex machine was operated without printing to visually observe flowability of the developer in the image developer and the presence or absence of aggregates and evaluate them according to the following criteria.

[Evaluation Standard]

Good: No aggregates were observed in the developer

Fair: Aggregates were observed in the developer but immediately separated

Poor: Aggregates were observed in the developer and impeded circulation in the image developer or resided in a part thereof.

(White Spot)

The image forming apparatus was adjusted such that a toner adherence amount after transferred was 0.85±0.1 mg/cm$^2$ on a transfer paper (Type 6000 A4 paper from Ricoh Company, Ltd.). The fixing belt was set to have a minimum fixing temperature of +10° C. The A4 size paper passed a nip of the fixer at 280 mm/s. First, after 10,000 monochrome images having an image area of 5% were produced, 10 solid images were continuously produced to average the number of white spots in the 10 printed images.

Good: 0 to 4

Fair: 5 to 9

Poor: 10 or more

TABLE 5-1

| | Toner | Carrier | Minimum Fixing Temperature | Fixable Temperature Range | Contamination of Carrier | Heat resistant storage stability |
|---|---|---|---|---|---|---|
| Comparative Example 1 | Toner 1 | Carrier A | 110 | 40 | Fair | Fair |
| Example 1 | Toner 1 | Carrier B | 110 | 40 | Fair | Fair |
| Example 2 | Toner 1 | Carrier C | 110 | 40 | Good | Fair |
| Example 3 | Toner 1 | Carrier D | 110 | 40 | Good | Fair |
| Example 4 | Toner 1 | Carrier E | 110 | 40 | Good | Fair |
| Comparative Example 2 | Toner 1 | Carrier F | 110 | 40 | Good | Fair |
| Comparative Example 3 | Toner 1 | Carrier G | 110 | 40 | Fair | Fair |
| Example 5 | Toner 1 | Carrier H | 110 | 40 | Good | Fair |
| Example 6 | Toner 1 | Carrier I | 110 | 40 | Good | Fair |
| Comparative Example 4 | Toner 1 | Carrier J | 110 | 40 | Good | Fair |
| Example 7 | Toner 1 | Carrier K | 110 | 40 | Good | Fair |
| Example 8 | Toner 1 | Carrier L | 110 | 40 | Good | Fair |
| Comparative Example 5 | Toner 1 | Carrier M | 110 | 40 | Good | Fair |
| Example 9 | Toner 1 | Carrier N | 110 | 40 | Good | Fair |
| Comparative Example 6 | Toner 1 | Carrier O | 110 | 40 | Fair | Fair |
| Example 10 | Toner 2 | Carrier O | 105 | 65 | Fair | Good |
| Example 11 | Toner 3 | Carrier O | 115 | 60 | Good | Good |
| Example 12 | Toner 4 | Carrier O | 120 | 65 | Good | Excellent |
| Example 13 | Toner 5 | Carrier O | 125 | 65 | Good | Good |
| Example 14 | Toner 6 | Carrier O | 140 | 65 | Good | Fair |
| Example 15 | Toner 7 | Carrier O | 115 | 40 | Good | Fair |
| Example 16 | Toner 8 | Carrier O | 135 | 85 | Good | Good |
| Example 17 | Toner 9 | Carrier O | 110 | 75 | Good | Fair |

TABLE 5-1-continued

| | Toner | Carrier | Minimum Fixing Temperature | Fixable Temperature Range | Contamination of Carrier | Heat resistant storage stability |
|---|---|---|---|---|---|---|
| Example 18 | Toner 10 | Carrier O | 120 | 75 | Good | Good |
| Example 19 | Toner 11 | Carrier O | 125 | 75 | Good | Excellent |
| Example 20 | Toner 12 | Carrier O | 120 | 75 | Good | Good |
| Example 21 | Toner 13 | Carrier O | 110 | 90 | Good | Excellent |
| Example 22 | Toner 14 | Carrier O | 105 | 100 | Good | Excellent |
| Example 23 | Toner 15 | Carrier O | 105 | 125 or more | Excellent | Excellent |
| Example 24 | Toner 16 | Carrier O | 120 | 40 | Fair | Fair |
| Example 25 | Toner 17 | Carrier O | 135 | 55 | Fair | Good |
| Example 26 | Toner 18 | Carrier O | 110 | 40 | Fair | Fair |
| Example 27 | Toner 19 | Carrier O | 135 | 55 | Good | Good |
| Example 28 | Toner 24 | Carrier O | 115 | 85 | Good | Good |
| Comparative Example 7 | Toner a | Carrier O | 100 | 20 | Poor | Poor |
| Comparative Example 8 | Toner b | Carrier O | 150 | 65 or more | Excellent | Excellent |
| Comparative Example 9 | Toner c | Carrier O | 115 | 25 | Fair | Poor |

TABLE 5-2

| | Toner | Carrier | White Spot | Halftone Reproducibility | Carrier Adherence (1) |
|---|---|---|---|---|---|
| Comparative Example 1 | Toner 1 | Carrier A | Fair | Good | Poor |
| Example 1 | Toner 1 | Carrier B | Fair | Good | Good |
| Example 2 | Toner 1 | Carrier C | Good | Good | Good |
| Example 3 | Toner 1 | Carrier D | Good | Good | Good |
| Example 4 | Toner 1 | Carrier E | Good | Fair | Good |
| Comparative Example 2 | Toner 1 | Carrier F | Good | Poor | Good |
| Comparative Example 3 | Toner 1 | Carrier G | Fair | Fair | Good |
| Example 5 | Toner 1 | Carrier H | Good | Good | Good |
| Example 6 | Toner 1 | Carrier I | Good | Good | Good |
| Comparative Example 4 | Toner 1 | Carrier J | Good | Good | Poor |
| Example 7 | Toner 1 | Carrier K | Good | Good | Good |
| Example 8 | Toner 1 | Carrier L | Good | Good | Good |
| Comparative Example 5 | Toner 1 | Carrier M | Good | Poor | Poor |
| Example 9 | Toner 1 | Carrier N | Good | Good | Good |
| Comparative Example 6 | Toner 1 | Carrier O | Poor | Poor | Good |
| Example 10 | Toner 2 | Carrier O | Good | Good | Good |
| Example 11 | Toner 3 | Carrier O | Good | Good | Good |
| Example 12 | Toner 4 | Carrier O | Good | Good | Good |
| Example 13 | Toner 5 | Carrier O | Good | Good | Good |
| Example 14 | Toner 6 | Carrier O | Good | Good | Good |
| Example 15 | Toner 7 | Carrier O | Good | Good | Good |
| Example 16 | Toner 8 | Carrier O | Good | Good | Good |
| Example 17 | Toner 9 | Carrier O | Good | Good | Good |
| Example 18 | Toner 10 | Carrier O | Good | Good | Good |
| Example 19 | Toner 11 | Carrier O | Good | Good | Good |
| Example 20 | Toner 12 | Carrier O | Good | Good | Good |
| Example 21 | Toner 13 | Carrier O | Good | Good | Good |
| Example 22 | Toner 14 | Carrier O | Good | Good | Good |
| Example 23 | Toner 15 | Carrier O | Good | Good | Good |
| Example 24 | Toner 16 | Carrier O | Fair | Good | Good |
| Example 25 | Toner 17 | Carrier O | Good | Good | Good |
| Example 26 | Toner 18 | Carrier O | Fair | Good | Good |
| Example 27 | Toner 19 | Carrier O | Good | Good | Good |
| Example 28 | Toner 24 | Carrier O | Good | Good | Good |
| Comparative Example 7 | Toner a | Carrier O | Poor | Fair | Poor |
| Comparative Example 8 | Toner b | Carrier O | Good | Good | Good |
| Comparative Example 9 | Toner c | Carrier O | Poor | Good | Good |

TABLE 5-3

| | Toner | Carrier | Solid Image Uniformity | Carrier Adherence (2) | Aggregation in Image Developer |
|---|---|---|---|---|---|
| Comparative Example 1 | Toner 1 | Carrier A | Fair | Poor | Poor |
| Example 1 | Toner 1 | Carrier B | Good | Good | Good |
| Example 2 | Toner 1 | Carrier C | Good | Good | Good |
| Example 3 | Toner 1 | Carrier D | Good | Good | Good |
| Example 4 | Toner 1 | Carrier E | Fair | Good | Good |
| Comparative Example 2 | Toner 1 | Carrier F | Poor | Good | Good |
| Comparative Example 3 | Toner 1 | Carrier G | Fair | Good | Poor |
| Example 5 | Toner 1 | Carrier H | Good | Good | Good |
| Example 6 | Toner 1 | Carrier I | Good | Good | Good |
| Comparative Example 4 | Toner 1 | Carrier J | Fair | Poor | Good |
| Example 7 | Toner 1 | Carrier K | Good | Good | Fair |
| Example 8 | Toner 1 | Carrier L | Good | Good | Good |
| Comparative Example 5 | Toner 1 | Carrier M | Poor | Poor | Poor |
| Example 9 | Toner 1 | Carrier N | Good | Good | Good |
| Comparative Example 6 | Toner 1 | Carrier O | Poor | Good | Good |
| Example 10 | Toner 2 | Carrier O | Good | Good | Good |
| Example 11 | Toner 3 | Carrier O | Good | Good | Good |
| Example 12 | Toner 4 | Carrier O | Good | Good | Good |
| Example 13 | Toner 5 | Carrier O | Good | Good | Good |
| Example 14 | Toner 6 | Carrier O | Good | Good | Good |
| Example 15 | Toner 7 | Carrier O | Good | Good | Good |
| Example 16 | Toner 8 | Carrier O | Good | Good | Good |
| Example 17 | Toner 9 | Carrier O | Good | Good | Good |
| Example 18 | Toner 10 | Carrier O | Good | Good | Good |
| Example 19 | Toner 11 | Carrier O | Good | Good | Good |
| Example 20 | Toner 12 | Carrier O | Good | Good | Good |
| Example 21 | Toner 13 | Carrier O | Good | Good | Good |
| Example 22 | Toner 14 | Carrier O | Good | Good | Good |
| Example 23 | Toner 15 | Carrier O | Good | Good | Good |
| Example 24 | Toner 16 | Carrier O | Good | Good | Good |
| Example 25 | Toner 17 | Carrier O | Good | Good | Good |
| Example 26 | Toner 18 | Carrier O | Good | Good | Good |
| Example 27 | Toner 19 | Carrier O | Good | Good | Good |
| Example 28 | Toner 24 | Carrier O | Good | Good | Good |
| Comparative Example 7 | Toner a | Carrier O | Fair | Poor | Poor |
| Comparative Example 8 | Toner b | Carrier O | Good | Good | Good |
| Comparative Example 9 | Toner c | Carrier O | Good | Good | Fair |

Having now fully described the invention, it will be apparent to one of ordinary skill in the art that many changes and modifications can be made thereto without departing from the spirit and scope of the invention as set forth therein.

What is claimed is:

1. A developer, comprising:

a toner comprising:

a binder resin comprising a crystalline resin; and a colorant, and a resin carrier comprising:

a resin;

wherein the resin carrier has a magnetic particulate material having a magnetic anisotropy, dispersed in the resin, and wherein the resin carrier has a saturated magnetization of from 16 to 30 emu/g, a coercive force of from 15 to 40 kA/m and an average particle diameter not less than 15 μm and less than 100 μm, wherein the binder resin comprises the crystalline resin in an amount not less than 50% by weight.

2. The developer of claim 1, wherein the toner is prepared by dispersing or emulsifying at least the binder resin and the colorant in an aqueous medium.

3. The developer of claim 1, wherein the crystalline resin is at least a resin selected from the group consisting of a polyester resin, a polyurethane resin, a polyurea resin, a polyamide resin and a polyether resins.

4. The developer of claim 1, wherein the crystalline resin comprises at least one of a urethane skeleton and a urea skeleton.

5. The developer of claim 1, wherein the crystalline resin comprises a crystalline resin (A) and a crystalline resin (B) having a weight-average molecular weight (Mw) different from each other.

6. The developer of claim 1, wherein the toner satisfies the following relationships:

$$45 \leq Ta \leq 70, \text{ and } 0.8 \leq Tb/Ta \leq 1.55$$

wherein Ta (° C.) is the maximum peak temperature of heat of melting the toner measured by a differential scanning calorimeter, and Tb (° C.) is a softening point of the toner measured by an elevated flow tester; and $$1.0\times10^3 \leq G'(Ta+20) \leq 5.0\times10^6 \text{ and } 1.0\times10^3 \leq G''(Ta+20) \leq 5.0\times10^6$$

wherein G'(Ta+20) (Pa·s) is the storage elastic modulus of the toner at the temperature of (Ta+20)° C., and G"(Ta+20) (Pa·s) is the loss elastic modulus of the toner at the temperature of (Ta+20)° C.

7. The developer of claim 1, wherein the resin carrier comprises the resin and the magnetic particulate material in a weight ratio (binder resin/magnetic particulate material) of from 65/35 to 80/20.

8. The developer of claim 1, wherein the resin carrier is a rare earth-iron-nitrogen magnet powder.

9. The developer of claim 1, wherein the resin carrier is prepared by melt-kneading the magnetic particulate material in the resin and then leaving the resultant resin powder for 10 sec or longer in a magnetic flux density of 2 T (tesla) or higher.

10. An image forming method, comprising:

forming an electrostatic latent image;

developing the electrostatic latent image with the developer according to claim 1 to form a toner image;

transferring the toner image onto a transfer paper; and fixing the toner image thereon.

* * * * *